US011241857B2

(12) United States Patent
Dai et al.

(10) Patent No.: US 11,241,857 B2
(45) Date of Patent: Feb. 8, 2022

(54) HORIZONTAL HIGH-SPEED PAPER CUP/PAPER BOWL FORMING MACHINE

(71) Applicant: Zhejiang New Debao Machinery Co., Ltd, Wenzhou (CN)

(72) Inventors: Daojin Dai, Wenzhou (CN); Ziliang Peng, Wenzhou (CN); Gaofeng Chen, Wenzhou (CN)

(73) Assignee: ZHEJIANG NEW DEBAO MACHINERY CO., LTD, Wenzhou (CN)

( * ) Notice: Subject to any disclaimer, the term of this patent is extended or adjusted under 35 U.S.C. 154(b) by 214 days.

(21) Appl. No.: 16/810,871

(22) Filed: Mar. 6, 2020

(65) Prior Publication Data

US 2021/0170711 A1 Jun. 10, 2021

(30) Foreign Application Priority Data

Dec. 7, 2019 (CN) ..... 201911245431.3

(51) Int. Cl.
*B31B 50/64* (2017.01)
*B31B 50/00* (2017.01)
*B31D 1/00* (2017.01)

(52) U.S. Cl.
CPC ..... *B31B 50/64* (2017.08); *B31B 50/00* (2017.08); *B31D 1/005* (2013.01)

(58) Field of Classification Search
CPC ..... B31B 50/322; B31B 50/64; B31B 50/024; B31B 50/005; B31B 50/00; B31B 2105/0022; B31B 2110/20; B31B 2110/10; B31D 1/005
See application file for complete search history.

(56) References Cited

U.S. PATENT DOCUMENTS 3,134,307 A * 5/1964 Loeser ..... B31B 50/64 493/135
3,289,552 A * 12/1966 Corazzo ..... B31B 50/322 493/107

(Continued)

FOREIGN PATENT DOCUMENTS

CN 205997421 U 3/2017
WO 2018059878 A1 4/2018

*Primary Examiner* — Thomas M Wittenschlaeger
(74) *Attorney, Agent, or Firm* — Bayramoglu Law Offices LLC

(57) ABSTRACT

A horizontal high-speed paper cup/paper bowl forming machine is provided. Specifically, the seven-station main rotation tower forming mechanism has a stamping die station, a paper feeding connection station, a first cup bottom preheating station, a second cup bottom preheating station, a bottom crimping station, a rolling station, and a main and auxiliary tower connection station. The seven-station auxiliary rotation tower forming mechanism has the main and auxiliary tower connection station, a cup rim lubrication station, a pre-crimping station, a first final crimping station, a second final crimping station, a cup outlet station, and a reserved vacant station. The stations arranged in sequence along the circumferential direction of the seven-station main rotation tower forming mechanism is in an opposite order to the stations arranged in sequence along the circumferential direction of the seven-station auxiliary rotation tower forming mechanism.

10 Claims, 35 Drawing Sheets

(56) References Cited

U.S. PATENT DOCUMENTS

| | | | | | |
|---|---|---|---|---|---|
| 3,990,353 | A * | 11/1976 | Richards | B31D 1/005 | 493/108 |
| 4,349,400 | A * | 9/1982 | Gilden | B29C 65/10 | 156/217 |
| 4,409,045 | A * | 10/1983 | Busse | B29C 65/7847 | 156/69 |
| 4,490,130 | A * | 12/1984 | Konzal | B29B 13/025 | 493/106 |
| 4,680,016 | A * | 7/1987 | Lynch | B31F 1/0038 | 493/159 |
| 5,135,462 | A * | 8/1992 | Stahlecker | B31D 1/005 | 493/87 |
| 5,324,249 | A * | 6/1994 | Konzal | B31B 50/00 | 493/109 |
| 5,624,367 | A * | 4/1997 | Budziszewski | B31D 1/005 | 493/167 |
| 6,676,585 | B1 * | 1/2004 | Stahlecker | B65D 17/502 | 493/87 |
| 6,722,104 | B1 * | 4/2004 | Haggman | B65B 3/027 | 53/412 |
| 7,175,585 | B2 * | 2/2007 | Okushita | B31F 1/10 | 493/269 |
| 8,603,276 | B2 * | 12/2013 | Riethmueller | B65D 3/22 | 156/191 |
| 9,713,906 | B2 * | 7/2017 | Chapman | B29C 35/02 | |
| 2006/0094577 | A1 * | 5/2006 | Mannlein | B31B 50/81 | 493/52 |
| 2021/0170711 | A1 * | 6/2021 | Dai | B31B 50/322 | |

* cited by examiner

HORIZONTAL HIGH-SPEED PAPER CUP/PAPER BOWL FORMING MACHINE

CROSS REFERENCE TO THE RELATED APPLICATIONS

This application is based upon and claims priority to Chinese Patent Application No. 201911245431.3, filed on Dec. 7, 2019, the entire contents of which are incorporated herein by reference.

TECHNICAL FIELD

The present disclosure relates to a paper cup/paper bowl forming equipment.

BACKGROUND

A horizontal high-speed paper cup/paper bowl forming machine can perform paper forming to make a paper cup or paper bowl. Previous layouts for horizontal high-speed paper cup/paper bowl forming machines, however, are not efficient for optimal functioning. Specifically, prior forming machines typically occupy a large amount of space and are not organized for efficient space utilization. Moreover, the main transmission structure is poorly arranged and lacks compartmentalization.

Functional relationships of prior machines also have shortcomings. The forming machine shapes the fan/ring-shaped paper into a paper cup or paper bowl. The flip cup clamp, which performs the flipping, opening and closing operations of the cup clamp mechanism in the forming machine, cooperates with the mold during the forming. The flip cup clamp of the cup clamp mechanism wraps the paper onto the cup mold. In order to stabilize the wrapping process and make the forming effect better, the cup clamp mechanism is equipped with a paper pressing strip, which is characterized by a rise and fall movement. The paper pressing strip rises to press the paper onto the lower side of the mold. Next, the paper is wrapped on the mold by way of the flip cup clamp. The paper pressing strip uses an extra power source, which decreases efficiency and complicates control. The flip cup clamp is divided into a left part and a right part that cooperate with each other to accomplish the opening and closing. The left part and the right part of the flip cup clamp are connected, respectively, to the corresponding connecting rods in a manner similar to that of a transmission. The flip cup clamp is thus driven by the connecting rods to open and close. When the connecting rods rise, fall and swing, dust and oil isolation as well as stability of the unit can become troublesome.

The rolling apparatus in the forming machine rolls the bottom of the formed paper cup or paper bowl to be compacted or embossed. Typically, the service life of the rolling wheel bearing is relatively short. Another problem with the rolling apparatus heretofore is that it has a complex structure making it troublesome to assemble and unstable during operation. In addition, the structure of the transmission mechanism the rolling apparatus requires is also complex. In order to further increase the speed, the stability of the transmission mechanism also needs to be improved. The rolling wheel for rolling is arranged on the movable block device and is thus driven to move eccentrically. The movable block device cooperates with the rolling shaft having wedge part, the rolling shaft rotates and moves axially, and the rolling wheel carries a profiling die to accomplish the rolling. When the lubrication oil channel is formed in the rolling apparatus, it is necessary to prevent the lubrication oil from leaking to the rolling wheel, so as to avoid polluting the paper cup or paper bowl. Additionally, it is required to prevent the paper powder at the rolling wheel from entering the oil channel to avoid affecting the transmission. The rolling wheel is driven by the rolling shaft and, therefore, when the rolling shaft not only need to move axially and rotate concurrently, it is very important to ensure the stable operation of the rolling shaft.

The forming machine includes a crimping assembly and a crimping device. Examples may include a rim crimping device or a bottom crimping device, which is typically installed on the crimping assembly to crimp the corresponding bottom and rim of the paper tube. The stability of the crimping assembly is a constant concern because it influences the effect and speed of crimping.

SUMMARY

In view of the technical problems described in the background, the objective of the present invention is to provide a new horizontal high-speed paper cup/paper bowl forming machine. The new forming machine has a more compartmentalized station layout, and the structure thereof is more space-efficient. The new gripper device of the forming machine of the invention cooperates with the turntable and thus the forming machine can be operated at higher speeds.

In order to solve the above technical problems, the present invention adopts the following technical solution. A new horizontal high-speed paper cup/paper bowl forming machine includes a four-station turntable paper feeding mechanism, a seven-station main rotation tower forming mechanism and a seven-station auxiliary rotation tower forming mechanism. Specifically, the seven-station main rotation tower forming mechanism has a stamping die station, a paper feeding connection station, a first cup bottom preheating station, a second cup bottom preheating station, a bottom crimping station, a rolling station and a main and auxiliary tower connection station, which are sequentially along a circumferential direction. The seven-station auxiliary rotation tower forming mechanism has the main and auxiliary tower connection station, a cup rim lubrication station, a pre-crimping station, a first final crimping station, a second final crimping station, a cup outlet station, and a reserved vacant station, which are arranged sequentially along a circumferential direction. The stations arranged in sequence along the circumferential direction of the seven-station main rotation tower forming mechanism is in an opposite order to the stations arranged in sequence along the circumferential direction of the seven-station auxiliary rotation tower forming mechanism. The seven-station main rotation tower forming mechanism shares the main and auxiliary tower connection station with the seven-station auxiliary rotation tower forming mechanism. The four-station turntable paper feeding mechanism is connected to the paper feeding connection station. The four-station turntable paper feeding mechanism includes a turntable. The turntable is connected to a rotational transmission device. Gripper devices are arranged on the turntable by indexing. An opening is provided at the rotation center of the turntable, and a gripper opening lifting shaft is arranged at the opening. The gripper opening lifting shaft is connected to a gripper opening plate, and the gripper opening plate is positioned above the turntable. The gripper device includes a paper gripper, and the paper gripper is hinged on a first mounting base. The first mounting base is connected to the surface of the turntable. A paper supporting part on the turntable is positioned under the paper gripper. The paper gripper is further equipped with a gripper reset device. The gripper opening plate cooperates with the paper gripper. The rotation transmission device includes a servo motor.

A stamping die assembly is positioned at the stamping die station. A cup clamp mechanism is further arranged at the paper feeding connection station. A first cup bottom preheating assembly is positioned at the first cup bottom preheating station. A second cup bottom preheating assembly is positioned at the second cup bottom preheating station. A bottom crimping assembly is positioned at the bottom crimping station A rolling assembly is positioned at the rolling station. A cup rim lubrication assembly is positioned at the cup rim lubrication station. A pre-crimping assembly is positioned at the pre-crimping station. A first final crimping assembly is positioned at the first final crimping station. A second final crimping assembly is positioned at the second final crimping station. A cup outlet assembly is positioned at the cup outlet station.

The stamping die assembly includes a bottom forming device. The bottom forming device includes a stamping transmission hollow shaft and a forming transmission shaft, and the stamping transmission hollow shaft and the forming transmission shaft are transversely arranged. A first guide sleeve is provided, respectively, on the outer sides of each of the front and rear portions of the stamping transmission hollow shaft. The forming transmission shaft is located inside the stamping transmission hollow shaft. A second guide sleeve is provided, respectively, on the outer sides of the front and rear portions of the forming transmission shaft. The second guide sleeve is located between the stamping transmission hollow shaft and the forming transmission shaft. A first rotation drive vertical shaft is arranged under the stamping transmission hollow shaft, and the first rotation drive vertical shaft is connected, respectively, to the stamping transmission hollow shaft and the forming transmission shaft in a drive manner. The front end of the forming transmission shaft is connected to a forming male die, and the front end of the stamping transmission hollow shaft is connected to a stamping male knife. A fixing frame is arranged in front of the stamping male knife, and the fixing frame is provided with a stamping female knife. The fixing frame is further provided with a molding female die. The stamping female knife is integrated with or separated from the molding female die. The first rotation drive vertical shaft is provided with a cam transmission mechanism and a first eccentric wheel transmission mechanism. The stamping transmission hollow shaft is provided with a lower hollow. The cam transmission mechanism is located at the lower hollow, and the cam transmission mechanism is connected to the forming transmission shaft in a drive manner. The first eccentric wheel transmission mechanism is connected to the stamping transmission hollow shaft in a drive manner. The cam transmission mechanism includes a cam connected to the first rotation drive vertical shaft. The first eccentric wheel transmission mechanism includes a first eccentric wheel connected to the first rotation drive vertical shaft. The cam is located above the first eccentric wheel. The cam adopts a conjugate cam. The forming transmission shaft is provided with a first front roller and a first rear roller. The first front roller is located on the front side of the conjugate cam, the first rear roller is located on the rear side of the conjugate cam, and the first front roller and the first rear roller are correspondingly connected to the conjugate cam in a drive manner, respectively. The stamping transmission hollow shaft is provided with the lower hollow. The first front roller, the first rear roller and the conjugate cam are located at the lower hollow. The first eccentric wheel is connected to a first sleeve base in a drive manner, and the sleeve hole of the first sleeve base is sleeved on the first eccentric wheel in a drive manner. The rear end of the first sleeve base is a first connection part, the left and right sides of the first connection part are respectively provided with a pull rod hole, and a first pull rod is arranged in the pull rod hole. A first spring and a first limiting part are arranged on the first pull rod, and the first limiting part and the first spring are, respectively, arranged on the front and rear sides of the pull rod hole. The rear part of the stamping transmission hollow shaft is connected to a first transmission block, and the first transmission block is hinged with a first coupling base located under the first transmission block. The left part of the first coupling base is connected to the first pull rod on the left side of the first connection part, and the right part of the first coupling base is connected to the first pull rod on the right side of the first connection part.

The cup clamp mechanism includes a mounting shaft arranged on a first support frame. The mounting shaft is connected to a flip cup clamp, and the flip cup clamp is connected to the connecting rod in a drive manner. The first support frame includes a diaphragm plate. The diaphragm plate is provided with a movable hole. A sliding sleeve is arranged in the movable hole. A first joint bearing is arranged in the sliding sleeve. The upper part of the diaphragm plate is connected to an upper cover located above the diaphragm plate, and the lower part of the diaphragm plate is connected to a lower bracket located under the diaphragm plate. The sliding sleeve in the movable hole slides and matches with the upper cover and the lower bracket. The upper cover is provided with an upper movable channel for the connecting rod to pass through, and the lower bracket is provided with a lower movable channel for the connecting rod to pass through. A guide sleeve is arranged in the inner hole of the first joint bearing, and the connecting rod is arranged and connected in the guide sleeve. A paper pressing strip is arranged between the flip cup clamp, and the paper pressing strip is located above the mounting shaft. The paper pressing strip is connected to a lifting shaft in a drive manner, and the lifting shaft is provided with a falling transmission part. The falling transmission part cooperates with the flip cup clamp in a rotary and drive manner. The lifting shaft is further connected to a rising reset device.

The cup outlet assembly includes a cup outlet mechanism, and the cup outlet mechanism includes a second support frame. The second support frame is provided with a bend pipe, and the bend pipe is connected to a second input wheel and a rotation positioning disc. The inlet of the bend pipe is coaxially arranged with the second input wheel and the rotation positioning disc. The second input wheel is connected to the rotation transmission device in a drive manner. One side of the second support frame is provided with a positioning wheel, and the rotation positioning disc cooperates with the positioning wheel. A first receiving port and a second receiving port are arranged at the outlet of the bend pipe.

The bottom crimping assembly and the pre-crimping assembly adopt a crimping assembly, respectively. The crimping assembly includes a crimping movable shaft arranged transversely. The front part of the crimping movable shaft is provided with a crimping device. The crimping movable shaft is arranged on a base cover. The base cover is provided with a front support base and a rear support base, the front support base is provided with a front mounting hole, and the rear support base is provided with a rear mounting hole. A second bearing is arranged between the crimping movable shaft and the front mounting hole, and between the crimping movable shaft and the rear mounting hole, respectively. The base cover is connected to a base, the base is provided with a second rotation drive vertical shaft, and the second rotation drive vertical shaft is connected to the crimping movable shaft in a drive manner. The second rotation drive vertical shaft is provided with a second eccentric wheel transmission mechanism, and the second eccentric wheel transmission mechanism includes a second eccentric wheel connected to the second rotation drive vertical shaft. The second eccentric wheel is connected to the crimping movable shaft in a drive manner. The second eccentric wheel is connected to a second sleeve base in a drive manner, and the sleeve hole of the second sleeve base is connected to the second eccentric wheel in a drive manner. The rear end of the second sleeve base is a second connection part, the left and right sides of the second connection part are respectively provided with a pull rod hole, and a second pull rod is arranged in the pull rod hole. A second spring and a second limiting part are arranged on the second pull rod, and the second limiting part and the second spring are respectively arranged on the front and rear sides of the pull rod hole. The rear part of the crimping movable shaft is connected to a second transmission block. The second transmission block is hinged with a second coupling base located under the second transmission block. The left part of the second coupling base is connected to the second pull rod on the left side of the second connection part, and the right part of the second coupling base is connected to the second pull rod on the right side of the second connection part.

The rolling assembly includes a rolling mechanism, and the rolling mechanism includes a support housing. The support housing is provided with a rolling shaft, and the rolling shaft rotates and moves axially. A rolling sleeve base device is arranged in front of the support housing. The rolling sleeve base device includes a rolling sleeve base and a profiling die, and the profiling die is connected to the front end of the rolling sleeve base. The front end of the rolling shaft is provided with a wedge part. The front end of the rolling shaft is connected to a movable block device. The movable block device includes an inner movable block and an outer movable block. The inner movable block is provided with a wedge hole to match with the wedge part. A sixth bearing is connected between the inner movable block and the outer movable block. The outer movable block is located in the rolling sleeve base. The outer movable block is further provided with a support shaft, the support shaft is provided with a seventh bearing, and the seventh bearing is provided with a rolling wheel. The rolling wheel is located in the inner hole of the profiling die.

The forming machine further includes a main transmission mechanism, and the main transmission mechanism includes a main motor, a main shaft, a first transmission auxiliary shaft and a second transmission auxiliary shaft. The main motor is connected to the main shaft in a drive manner. The main shaft is respectively connected to an A cylindrical indexing camshaft of the seven-station main rotation tower forming mechanism and a B cylindrical indexing camshaft of the seven-station auxiliary rotation tower forming mechanism in a drive manner. The A cylindrical indexing camshaft, the B cylindrical indexing camshaft and the main shaft are parallel to the second transmission auxiliary shaft. The first transmission auxiliary shaft is connected between the A cylindrical indexing camshaft and the second transmission auxiliary shaft in a drive manner. The first transmission auxiliary shaft is perpendicular to the second transmission auxiliary shaft. The stamping die assembly includes a stamping drive wheel device. The first cup bottom preheating assembly includes a first cup bottom preheating drive wheel device. The second cup bottom preheating assembly includes a second cup bottom preheating drive wheel device. The bottom crimping assembly includes a bottom crimping drive wheel device. The rolling assembly includes a rolling drive wheel device. The cup rim lubrication assembly includes a cup rim lubrication drive wheel device. The pre-crimping assembly includes a pre-crimping drive wheel device. The first final crimping assembly includes a first final crimping drive wheel device. The second final crimping assembly includes a second final crimping drive wheel device. The main shaft is connected to a first drive wheel device in a drive manner. The first drive wheel device is connected to the second final crimping drive wheel device and the first final crimping drive wheel device in a drive manner. The first drive wheel device is further connected to the rolling drive wheel device and the bottom crimping drive wheel device in a drive manner. The second transmission auxiliary shaft is connected to a second drive wheel device and a third drive wheel device in a drive manner, respectively. The second drive wheel device is connected to the pre-crimping drive wheel device, the stamping drive wheel device and the cup rim lubrication drive wheel device in a drive manner. The third drive wheel device is connected to the first cup bottom preheating drive wheel device and the second cup bottom preheating drive wheel device in a drive manner.

The second transmission auxiliary shaft is connected to a first cam device, and the first cam device is connected to the cup clamp mechanism in a drive manner. The second transmission auxiliary shaft is further connected to a second cam device. The second cam device is connected to the lifting shaft at the center of the turntable of the four-station turntable paper feeding mechanism in a drive manner.

The horizontal high-speed paper cup/paper bowl forming machine adopts the brand-new four-four-seven station layout arrangement, the station layout is more reasonable, the spatial structure is more compact, and the space utilization is higher. In addition, the main transmission mechanism is adopted to match with the brand-new four-four-seven station layout, which is more reasonable and more compact. These provide technical support for subsequent modular assembly, and facilitate the maintenance and replacement. Further, some of these assemblies can also be optimized to meet the needs of speed increase.

BRIEF DESCRIPTION OF THE DRAWINGS

The embodiments and the working principle of the present disclosure are described in detail in combination with the drawings.

DETAILED DESCRIPTION OF THE EMBODIMENTS

Figure 1:
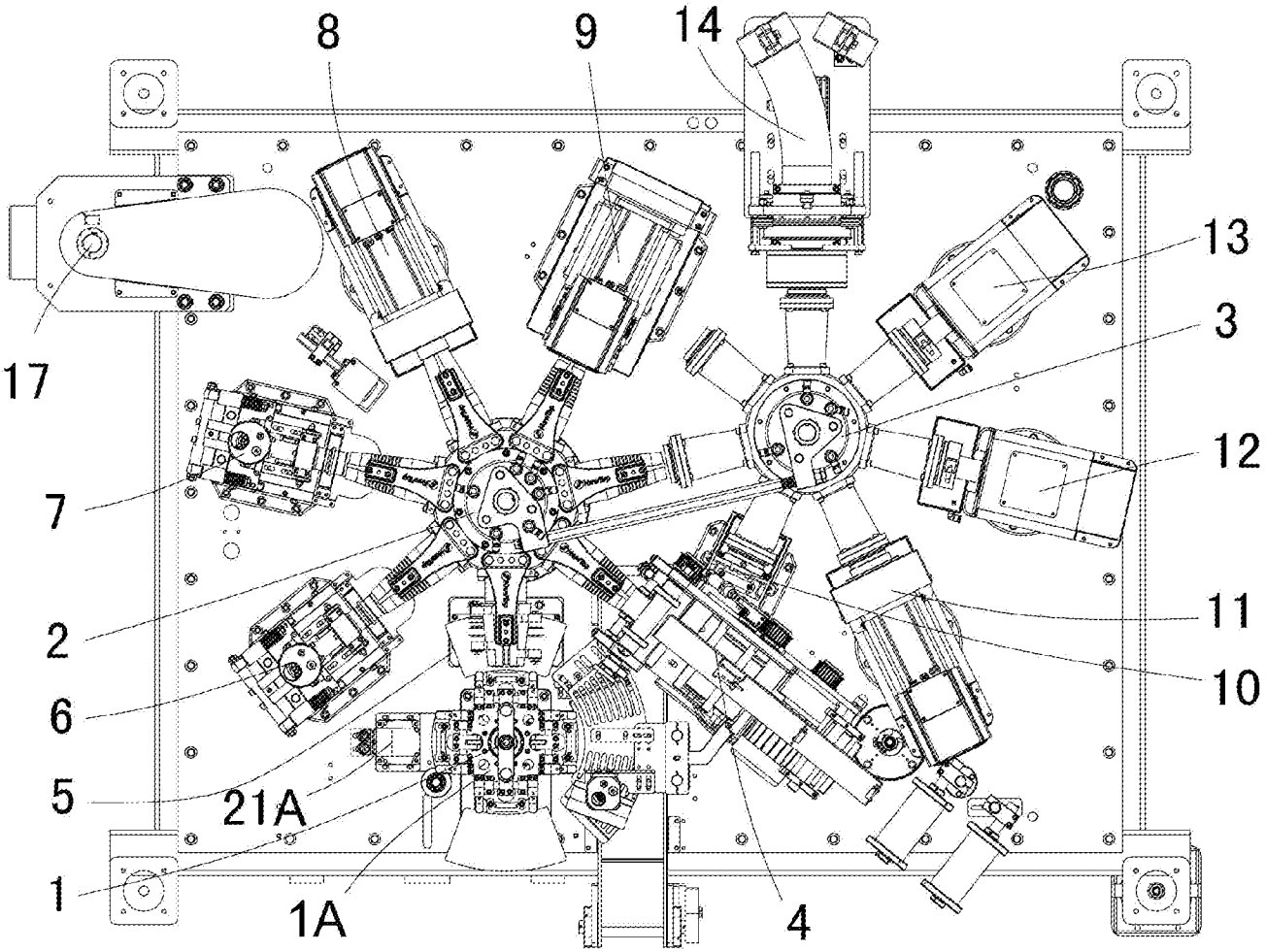
FIG. 1 is a top view of the structure of the forming machine of the present disclosure.
Figure 2:
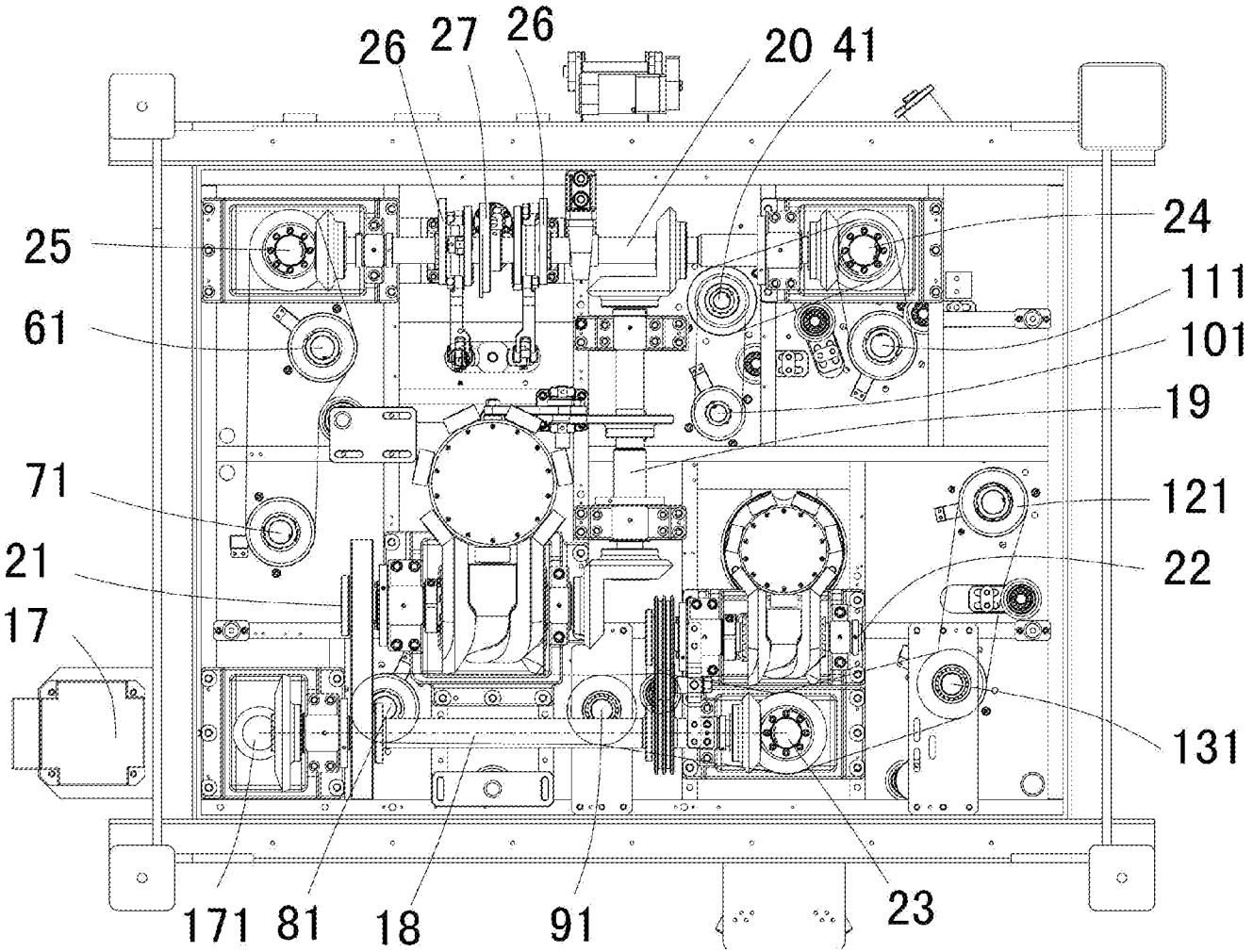
FIG. 2 is a bottom view of the structure of the forming machine of the present disclosure.
Figure 3:
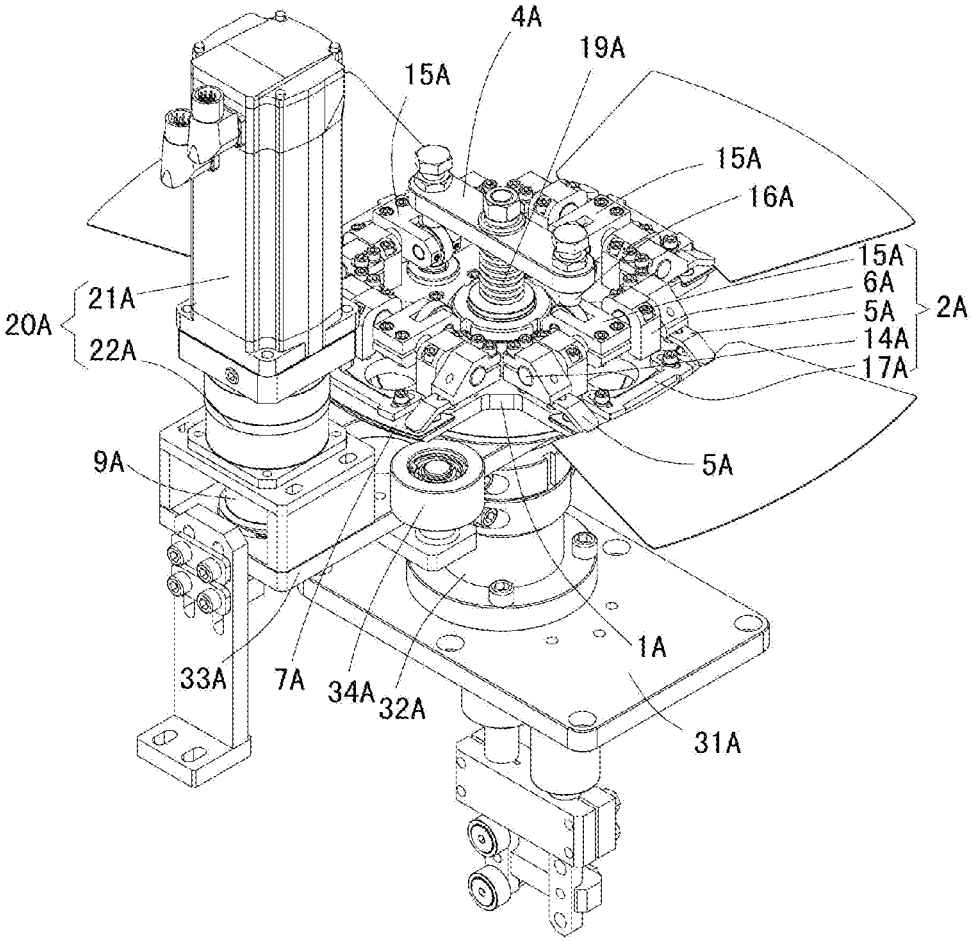
FIG. 3 is a perspective view of the paper feeding mechanism.

In one embodiment, a new horizontal high-speed paper cup/paper bowl forming machine includes the four-station turntable paper feeding mechanism 1, the seven-station main rotation tower forming mechanism 2 and the seven-station auxiliary rotation tower forming mechanism 3. The turntable paper feeding mechanism 1 adopts a four-station layout, that is, the turntable paper feeding mechanism is provided with four gripper devices and performs an indexing rotation at 90 degrees. The main rotation tower forming mechanism 2 adopts a seven-station layout. The main rotation tower of the main rotation tower forming mechanism is provided with seven horizontal main tower molds (for paper cups sleeved outside) and performs a seven equal dividing indexing rotation. The main rotation tower forming mechanism is equipped with a corresponding globoidal indexing cam mechanism (including the A cylindrical indexing cam) to drive the seven equal dividing indexing rotation of the main rotation tower. The auxiliary rotation tower forming mechanism 3 adopts a seven-station layout. The auxiliary rotation tower of the auxiliary rotation tower forming mechanism is provided with seven horizontal auxiliary tower molds (for paper cups sleeved inside) and performs a seven equal dividing indexing rotation. The auxiliary rotation tower forming mechanism is equipped with a corresponding cylindrical indexing cam mechanism (including the B cylindrical indexing cam) to drive the seven equal dividing indexing rotation of the auxiliary rotation tower. The main rotation tower forming mechanism and the auxiliary rotation tower forming mechanism are both prior art, and present disclosure aims to redesign and rearrange the stations thereof.

The seven-station main rotation tower forming mechanism 2 has the stamping die station, the paper feeding connection station, the first cup bottom preheating station, the second cup bottom preheating station, the bottom crimping station, the rolling station and the main and auxiliary tower connection station, which are arranged in sequence along a circumferential direction.

The seven-station auxiliary rotation tower forming mechanism 3 has the main and auxiliary tower connection station, the cup rim lubrication station, the pre-crimping station, the first final crimping station, the second final crimping station, the cup outlet station and the reserved vacant station, which are arranged in sequence along a circumferential direction.

The stations arranged in sequence along the circumferential direction of the seven-station main rotation tower forming mechanism 2 is in an opposite order to the stations arranged in sequence along the circumferential direction of the seven-station auxiliary rotation tower forming mechanism 3. The seven-station main rotation tower forming mechanism 2 shares the main and auxiliary tower connection station with the seven-station auxiliary rotation tower forming mechanism 3, and the four-station turntable paper feeding mechanism 1 is connected to the paper feeding connection station.

By adopting the brand-new four-four-seven station layout arrangement, the station layout is more reasonable, the spatial structure is more compact, and the spaces utilization is higher. The station layout is suitable for the forming of round paper cup, square paper cup and elliptical paper cup. By relying on the four-four-seven station layout, the corresponding device and assembly are efficiently configured and the resulting structure is space-efficient and compact. The first cup bottom preheating station is arranged next to the second cup bottom preheating station to improve the preheating effect, thereby saving the energy consumption.

Each station is equipped with the corresponding assembly or mechanism. Specifically, the stamping die assembly 4 is arranged at the stamping die station. The cup clamp mechanism 5 is also positioned at the paper feeding connection station. The first cup bottom preheating assembly 6 is positioned at the first cup bottom preheating station. The second cup bottom preheating assembly 7 is positioned at the second cup bottom preheating station. The bottom crimping assembly 8 is positioned at the bottom crimping station. The rolling assembly 9 is positioned at the rolling station. The cup rim lubrication assembly 10 is positioned at the cup rim lubrication station. The pre-crimping assembly 11 is positioned at the pre-crimping station. The first final crimping assembly 12 is positioned at the first final crimping station. The second final crimping assembly 13 is positioned at the second final crimping station. The cup outlet assembly 14 is positioned at the cup outlet station.

The turntable paper feeding mechanism 1 adopts the four-station layout, that is, the turntable paper feeding mechanism is provided with four gripper devices and performs an indexing rotation at 90 degrees.

In the embodiment, the four-station turntable paper feeding mechanism 1 includes the turntable 1A. The turntable 1A is connected to the rotation transmission device 20A in a drive manner, and the rotation transmission device 20A drives the turntable to rotate. Four gripper devices 2A are arranged on the turntable 1A by indexing, the gripper device 2A can be subjected to an indexing rotation with the turntable 1A, the turntable corresponds to four stations, and the turntable 1A performs an indexing rotation to cooperate with the gripper device 2A. The four-station layout is more reasonable. The gripper device 2A clamps and releases the input paper.

Figure 4:
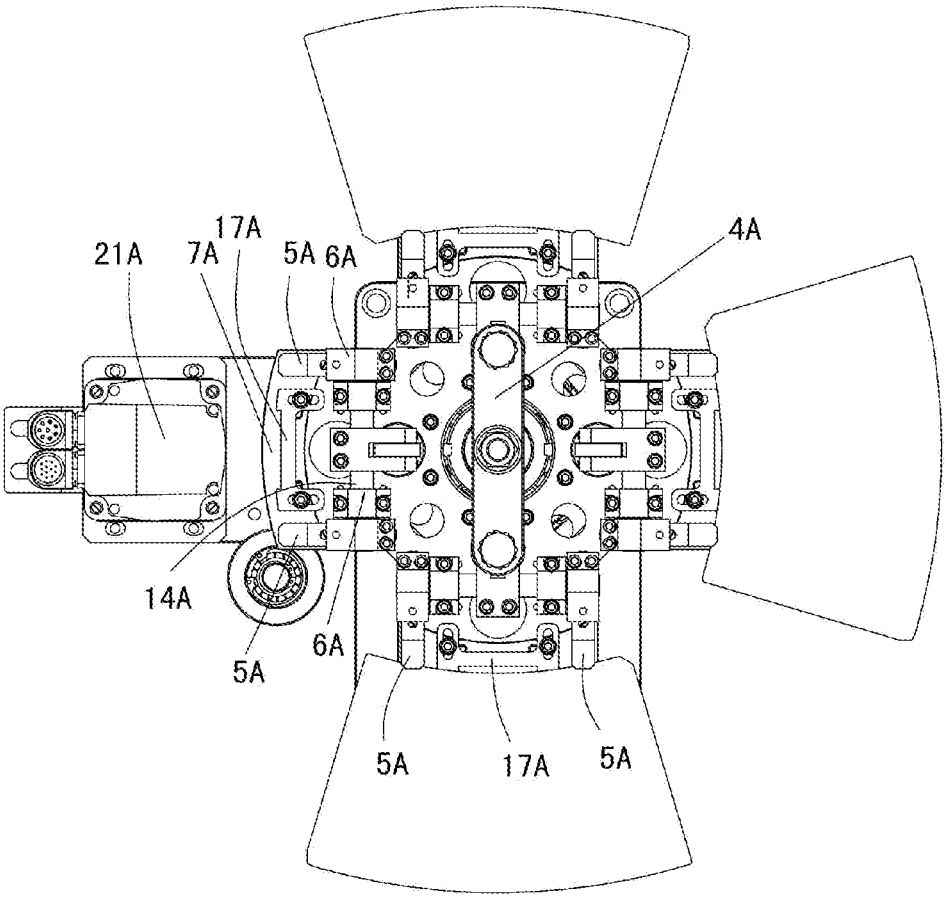
FIG. 4 is the top view of FIG. 3.
Figure 5:
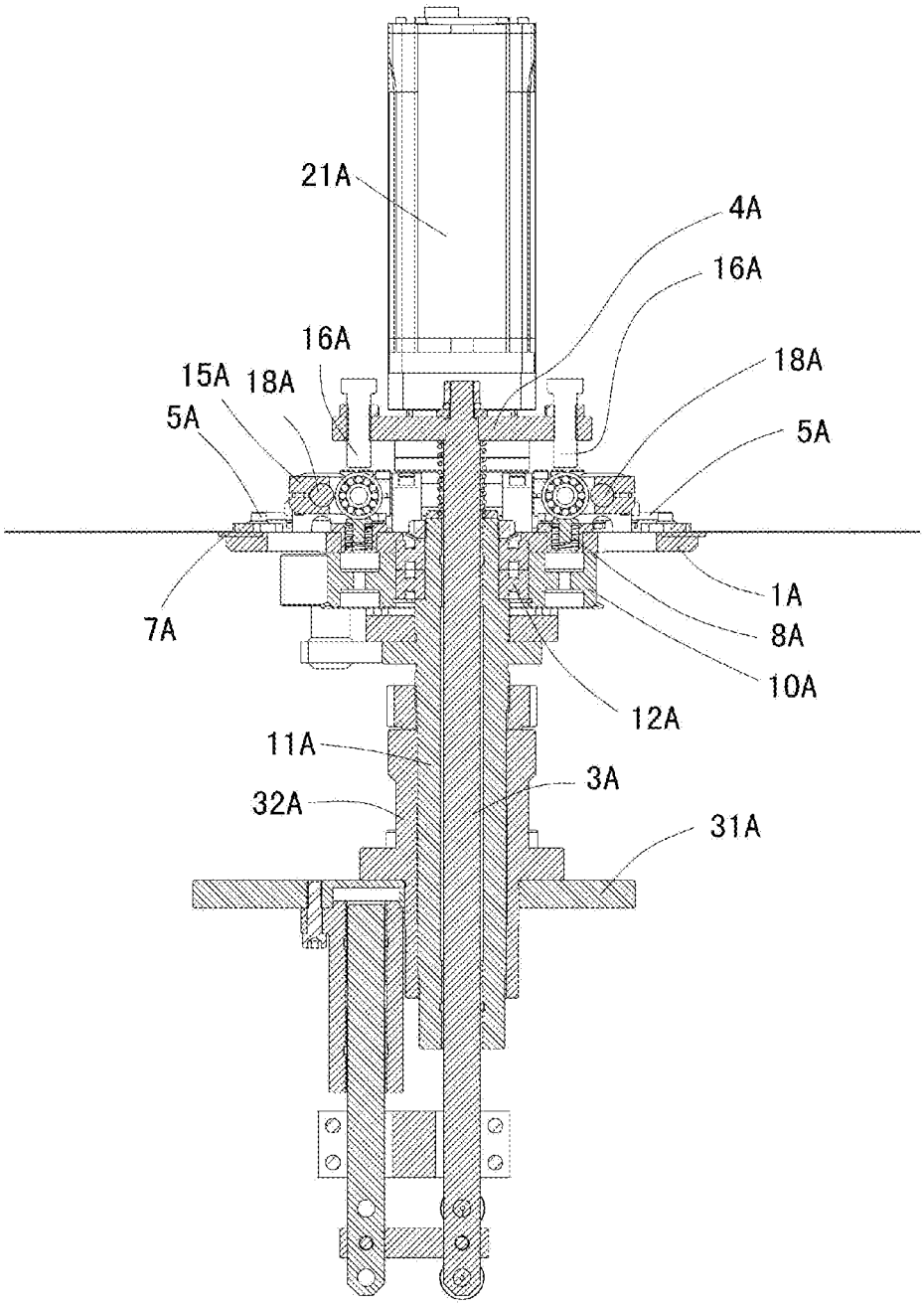
FIG. 5 is a sectional view of the structure of the paper feeding mechanism.
Figure 6:
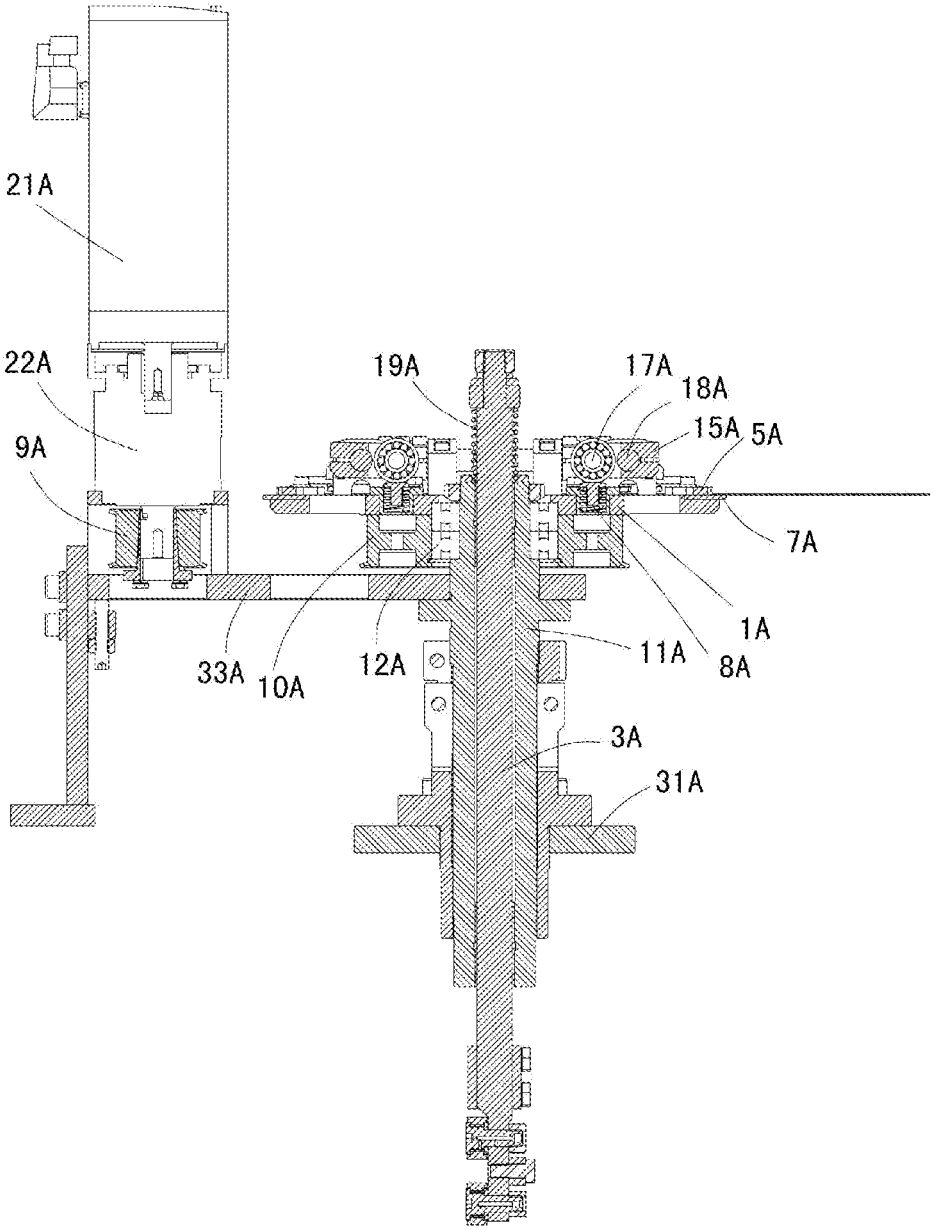
FIG. 6 is a sectional view of the structure of the paper feeding mechanism from another angle.
Figure 7:
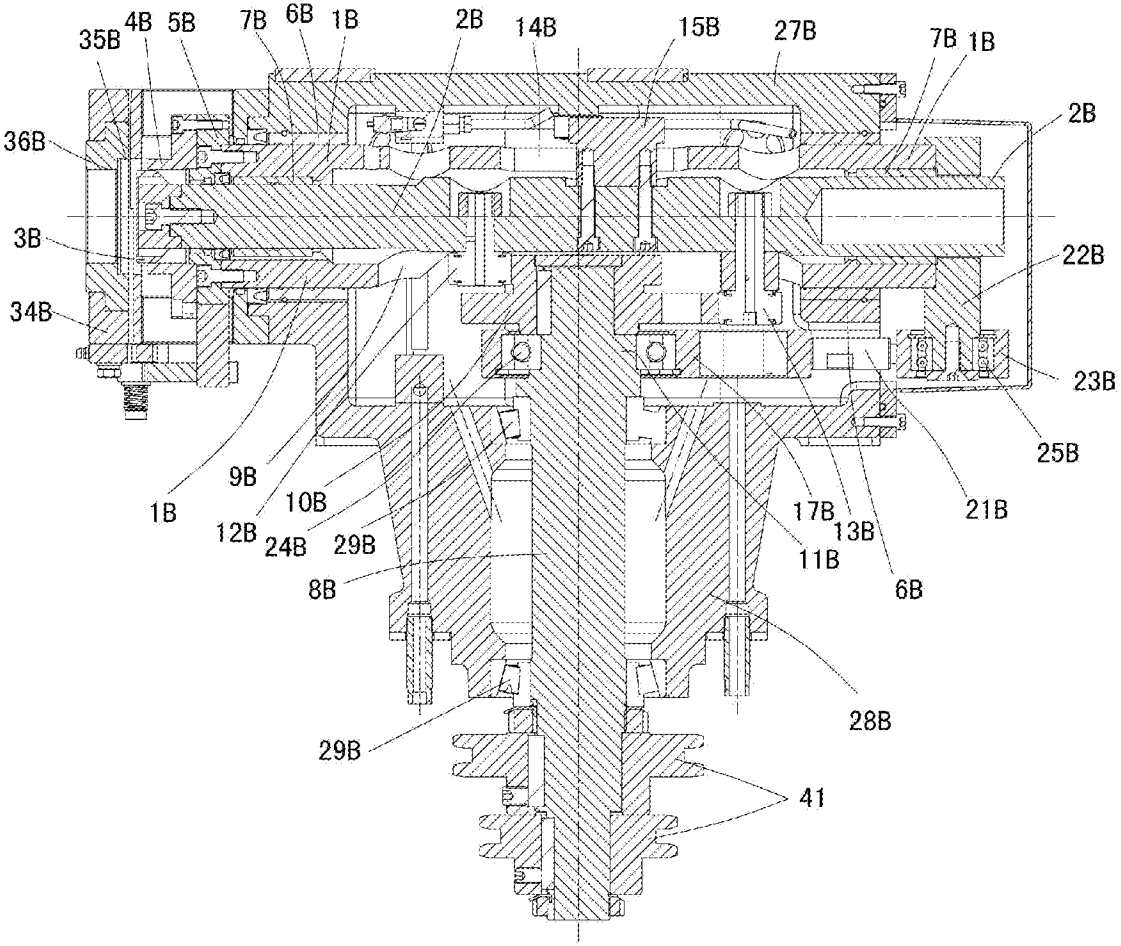
FIG. 7 is a sectional view of the stamping die assembly.
Figure 8:
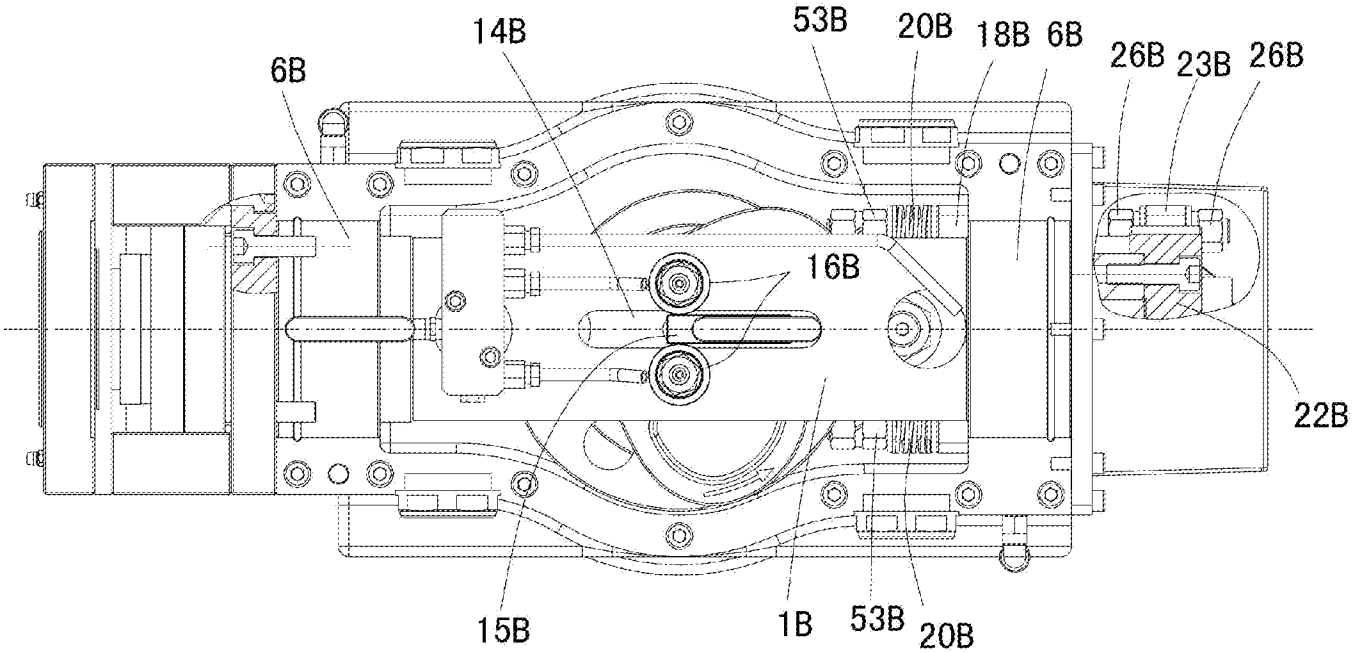
FIG. 8 is the top view of FIG. 7, wherein the upper fixing base 27B is hidden.
Figure 9:
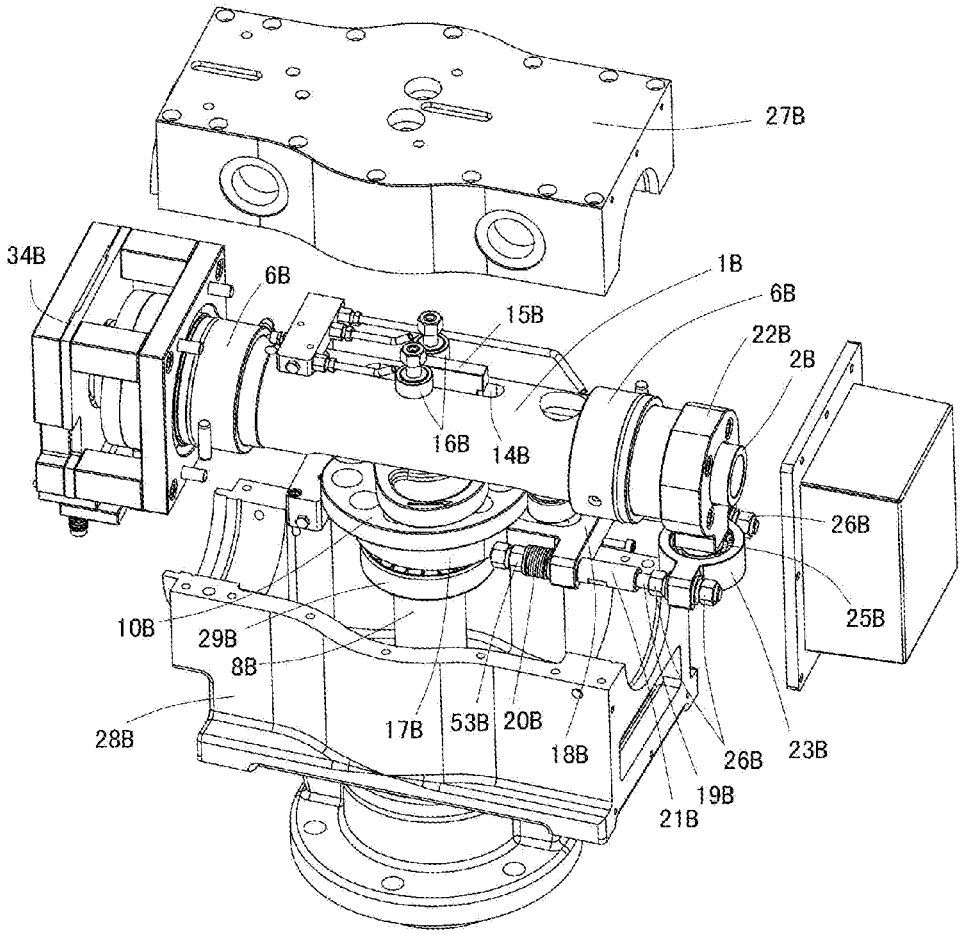
FIG. 9 is an exploded view of the three-dimensional structure of the stamping die assembly.
Figure 10:
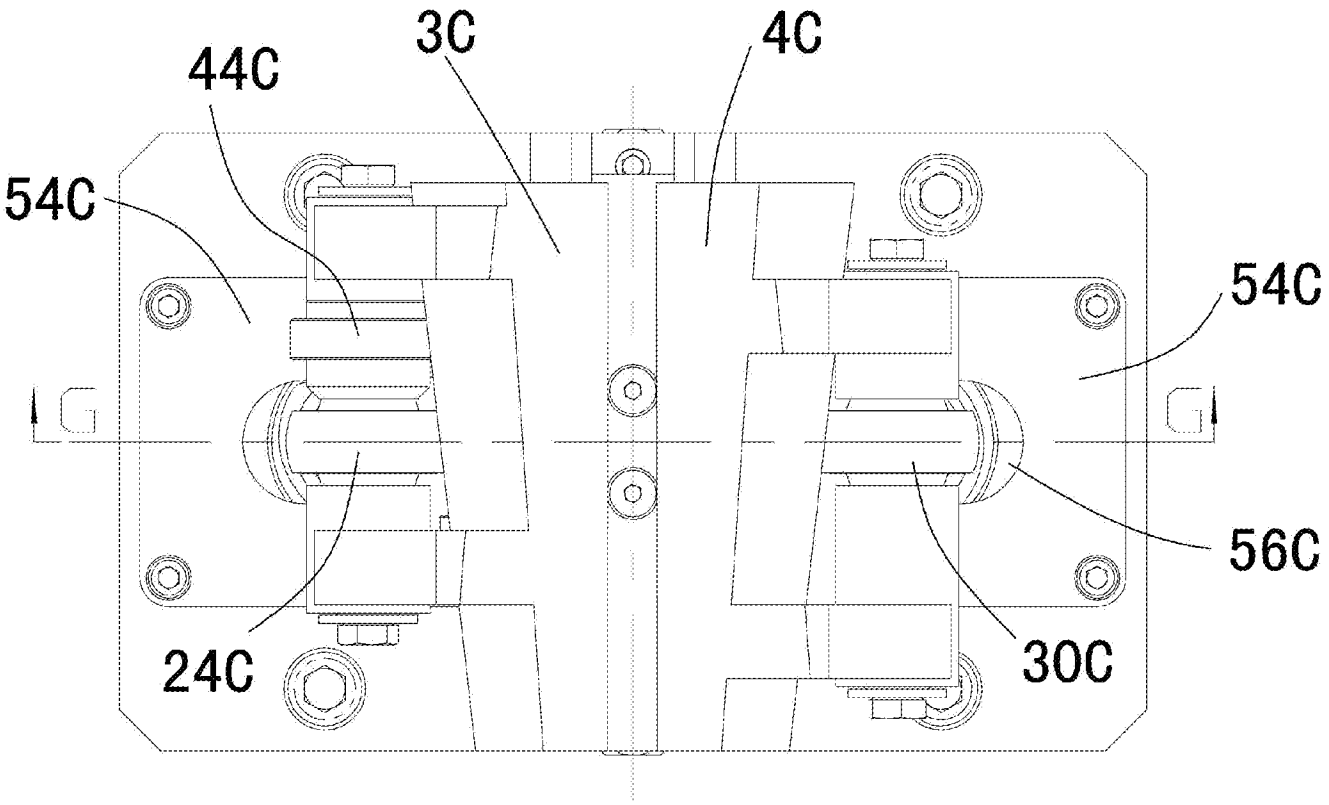
FIG. 10 is a top view of the cup clamp mechanism.
Figure 11:
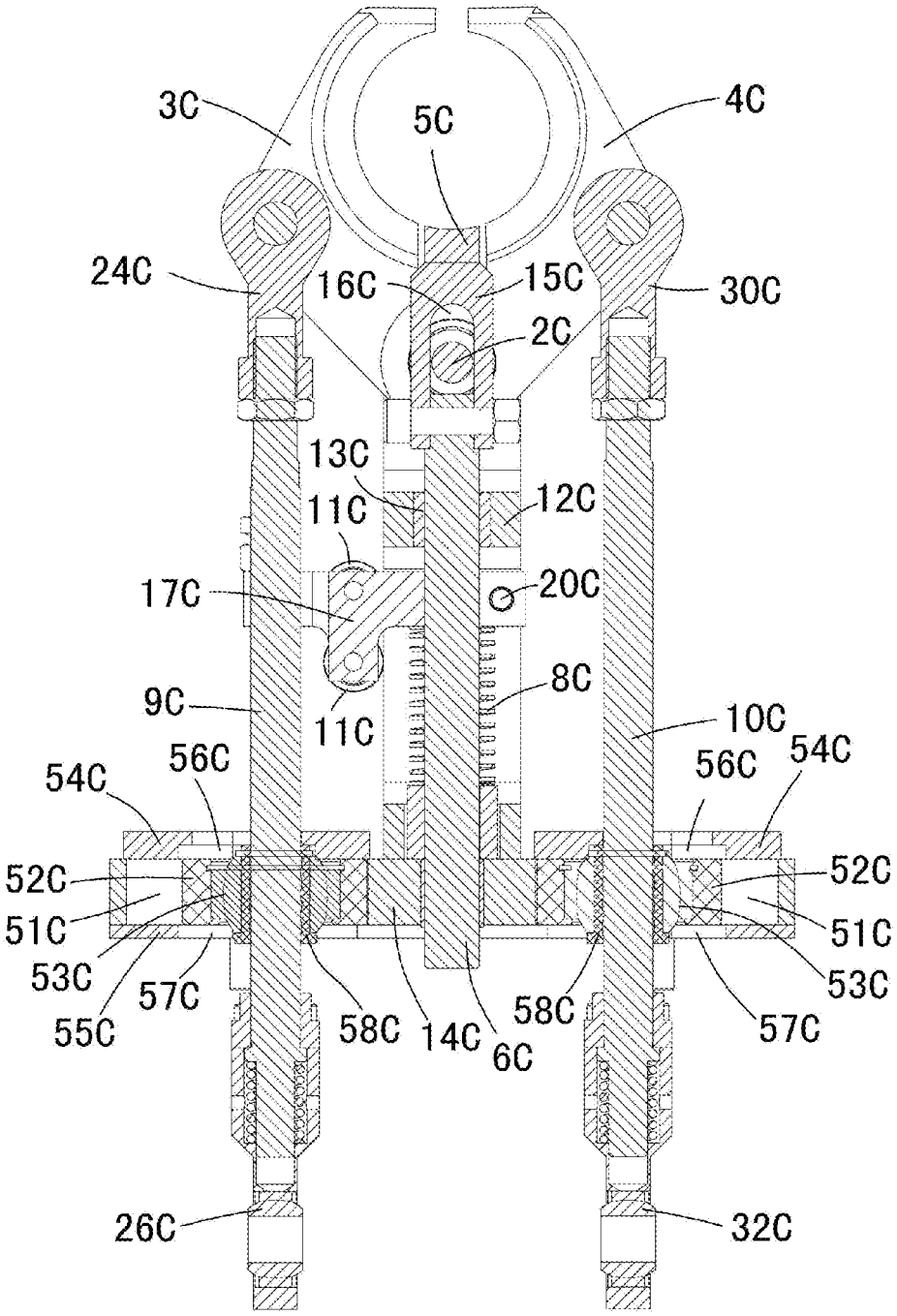
FIG. 11 is the sectional view taken along G-G in FIG. 10.
Figure 12:
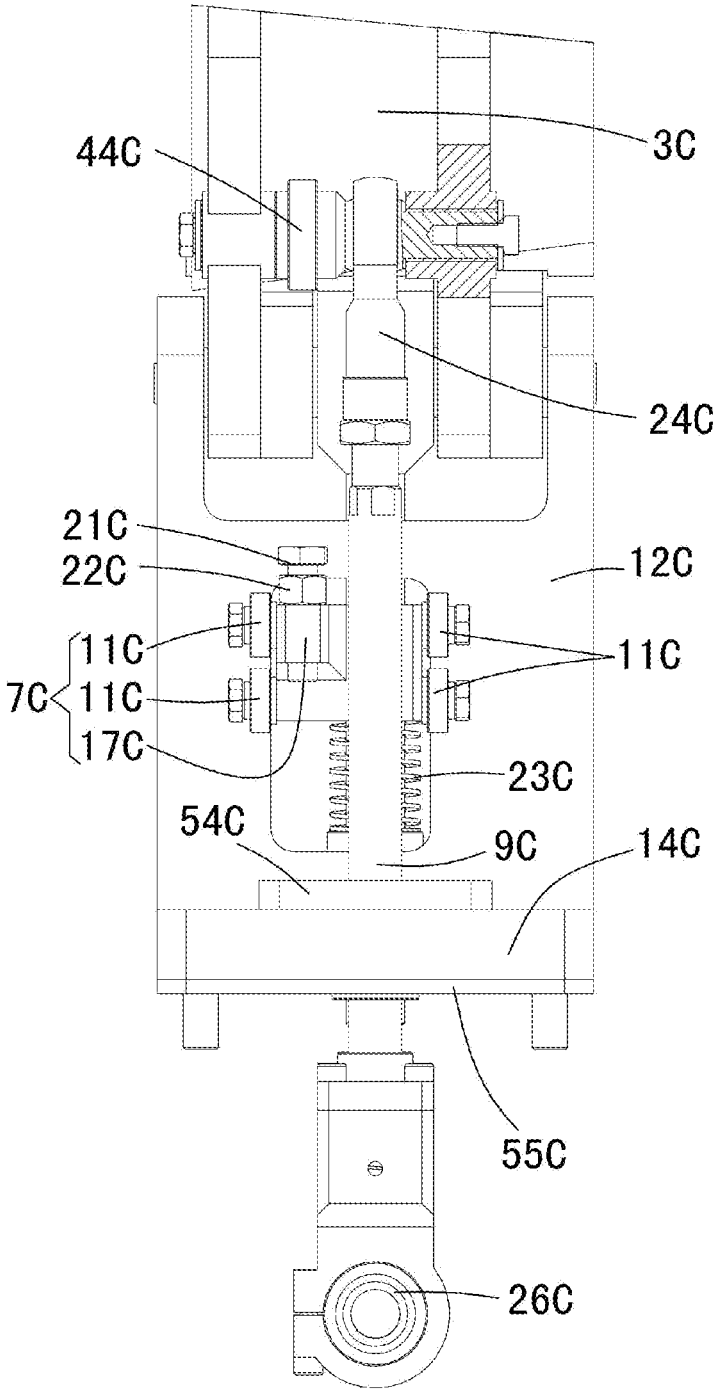
FIG. 12 is the left view of FIG. 10.
Figure 13:
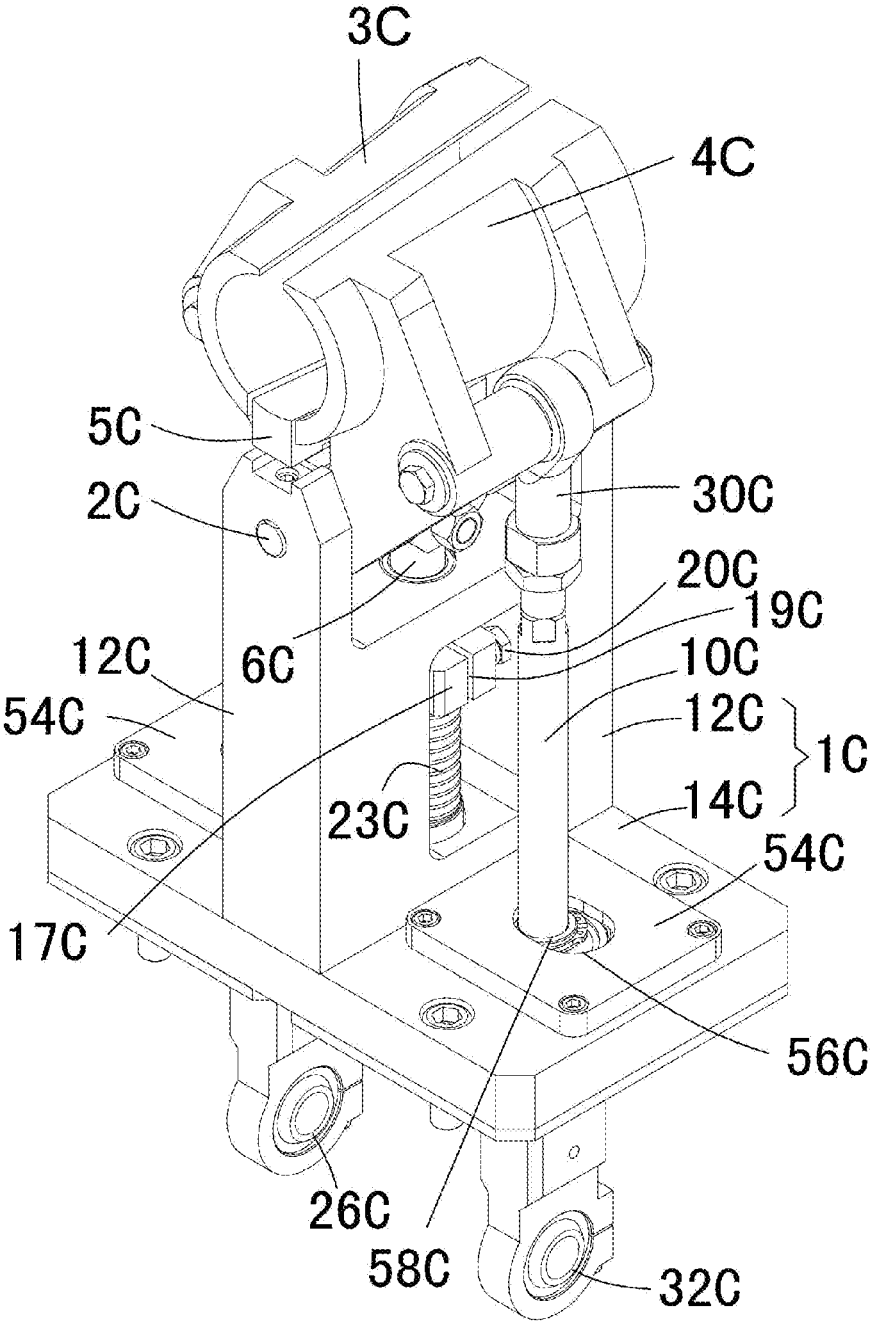
FIG. 13 is a perspective view of the cup clamp mechanism shown in FIG. 12.
Figure 14:
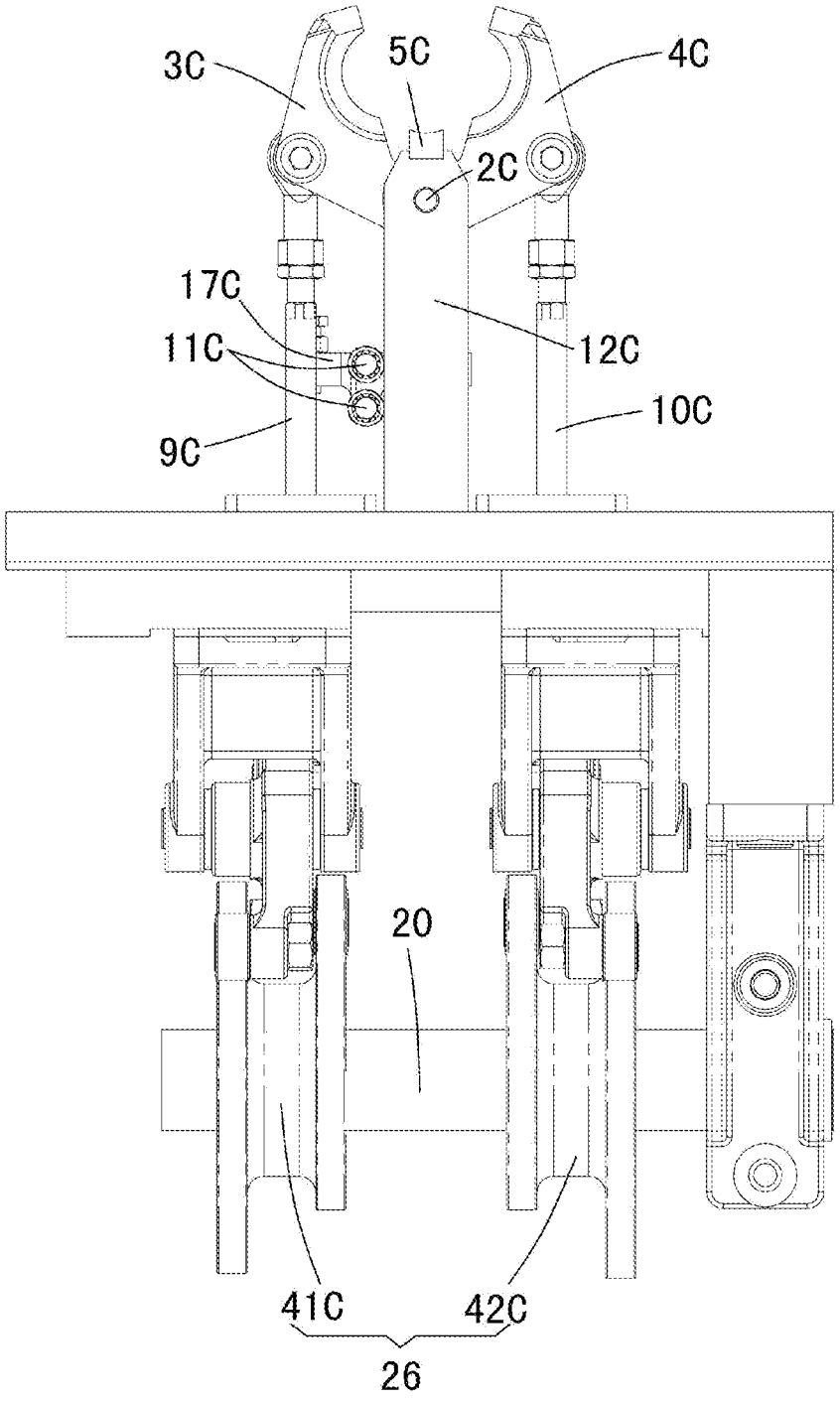
FIG. 14 is a front view of the cup clamp mechanism with the first cam device.
Figure 15:
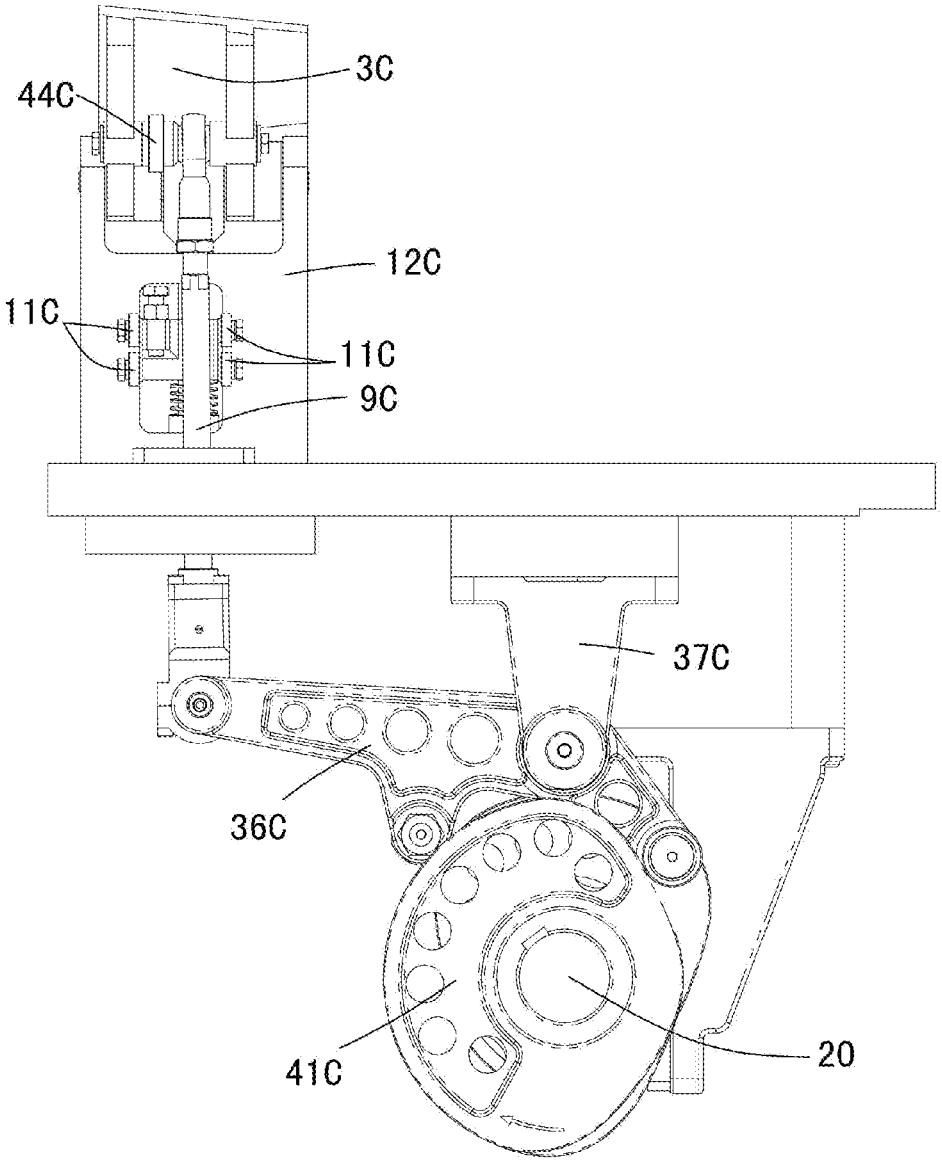
FIG. 15 is the left view of FIG. 14.
Figure 16:
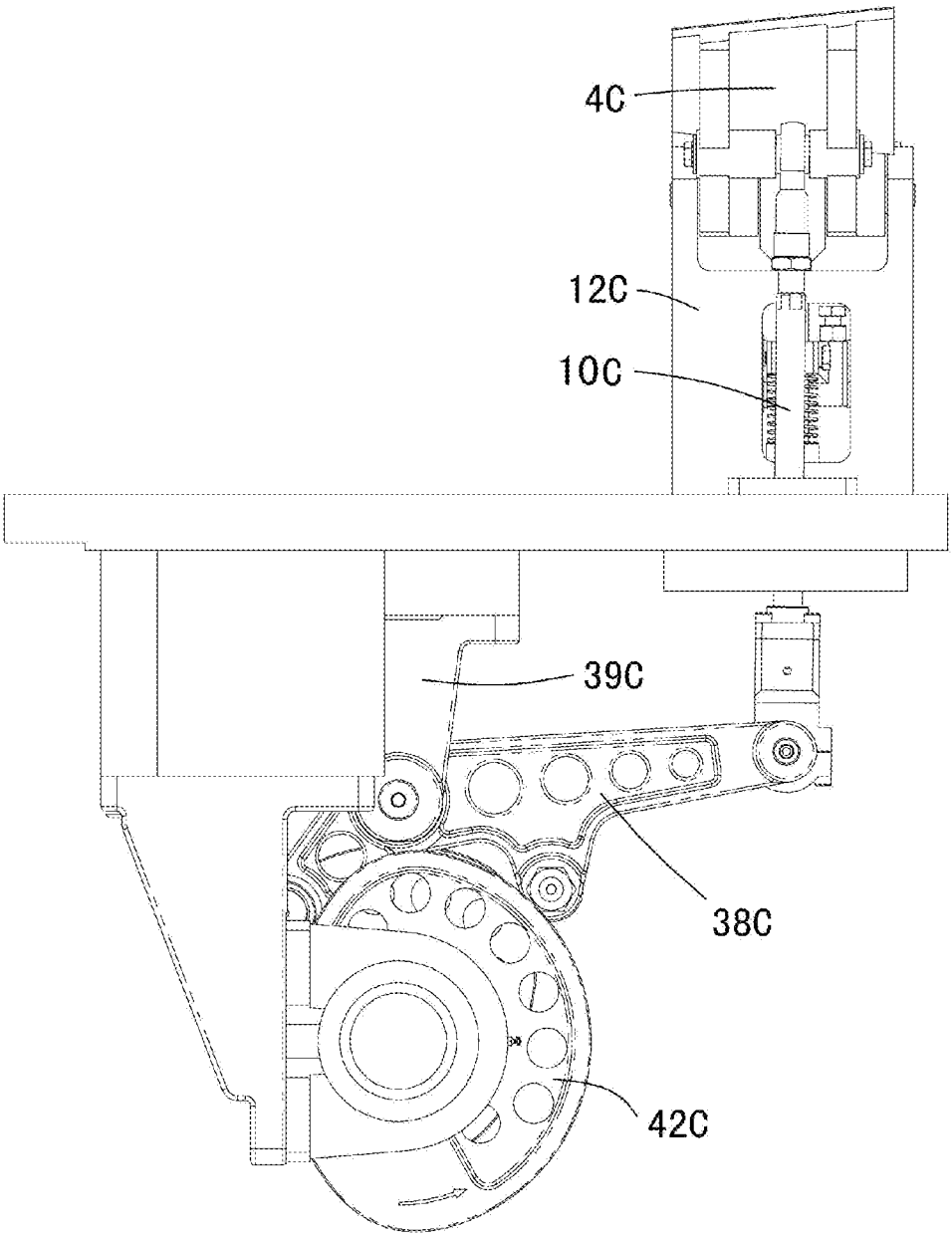
FIG. 16 is the right view of FIG. 14.
Figure 17:
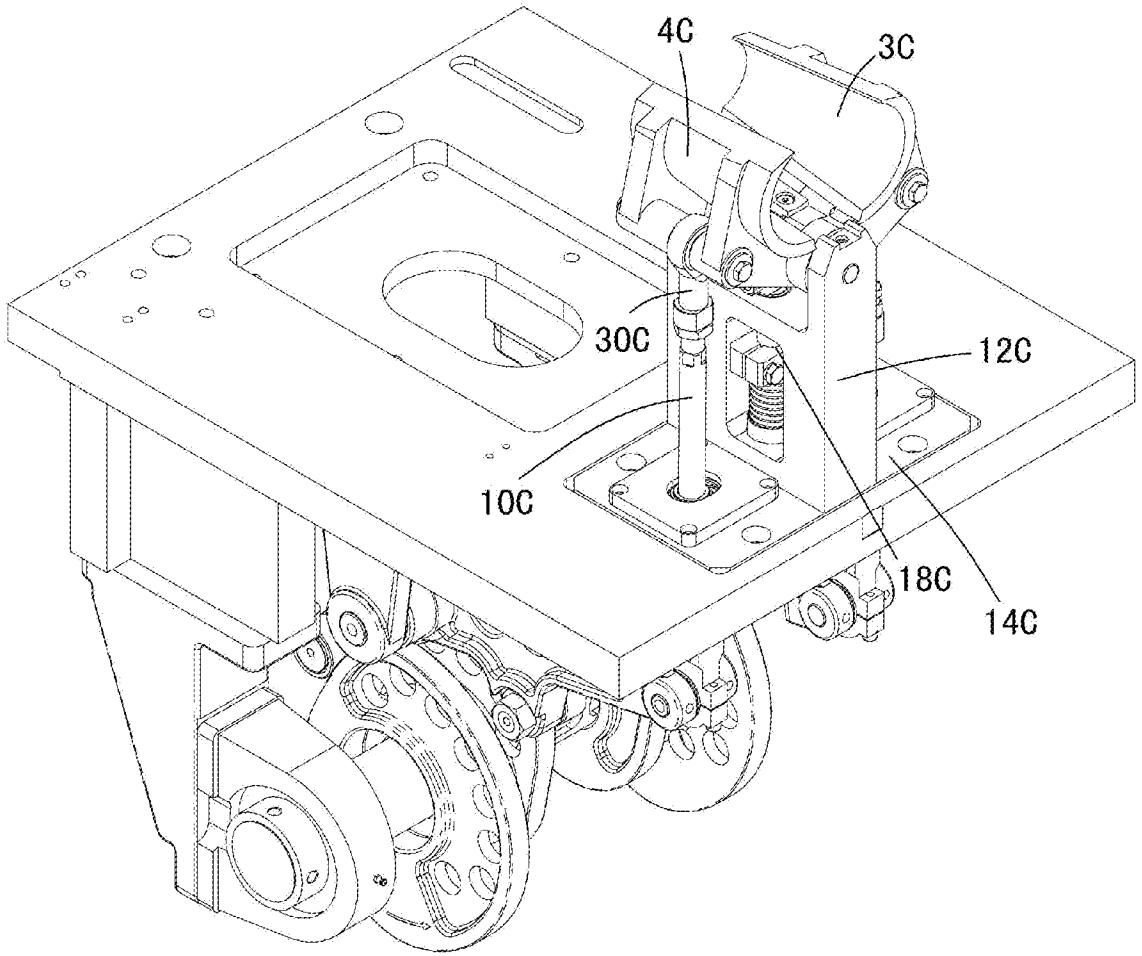
FIG. 17 is a perspective view of the cup clamp mechanism with the first cam device shown in FIG. 14.
Figure 18:
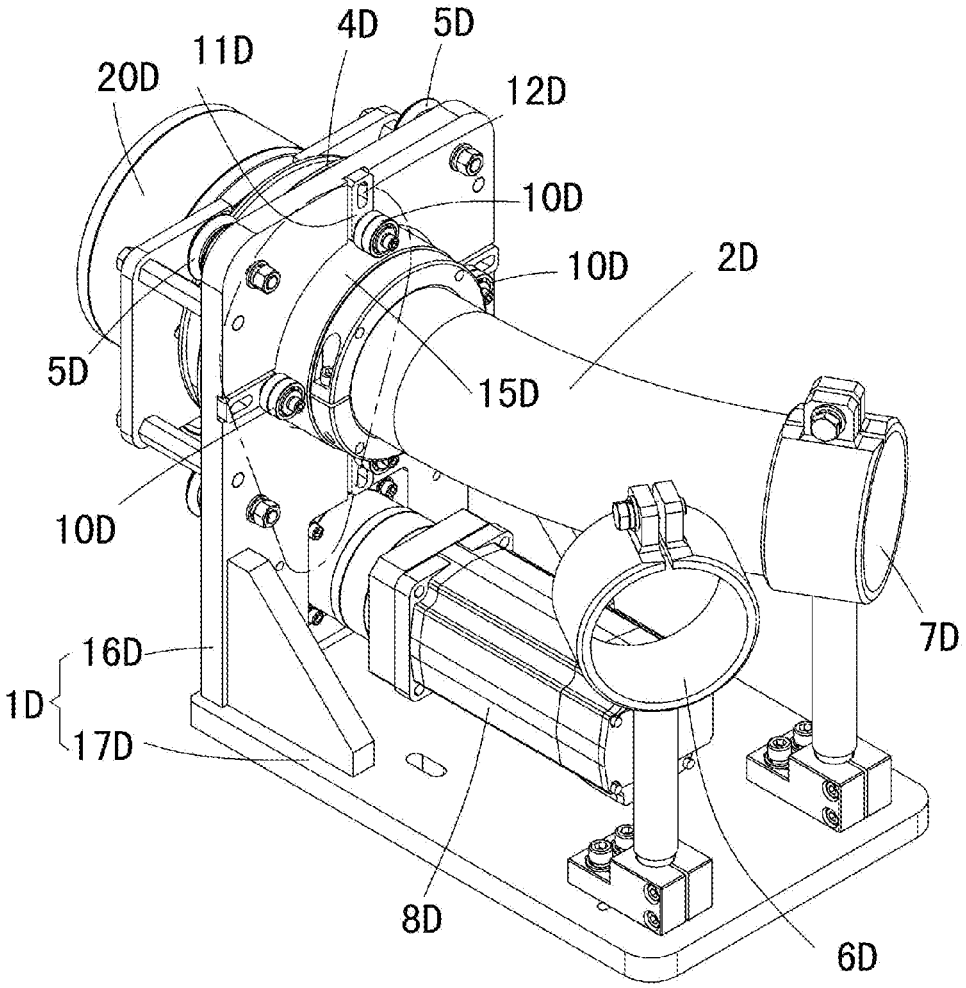
FIG. 18 is a perspective view of the cup outlet mechanism.
Figure 19:
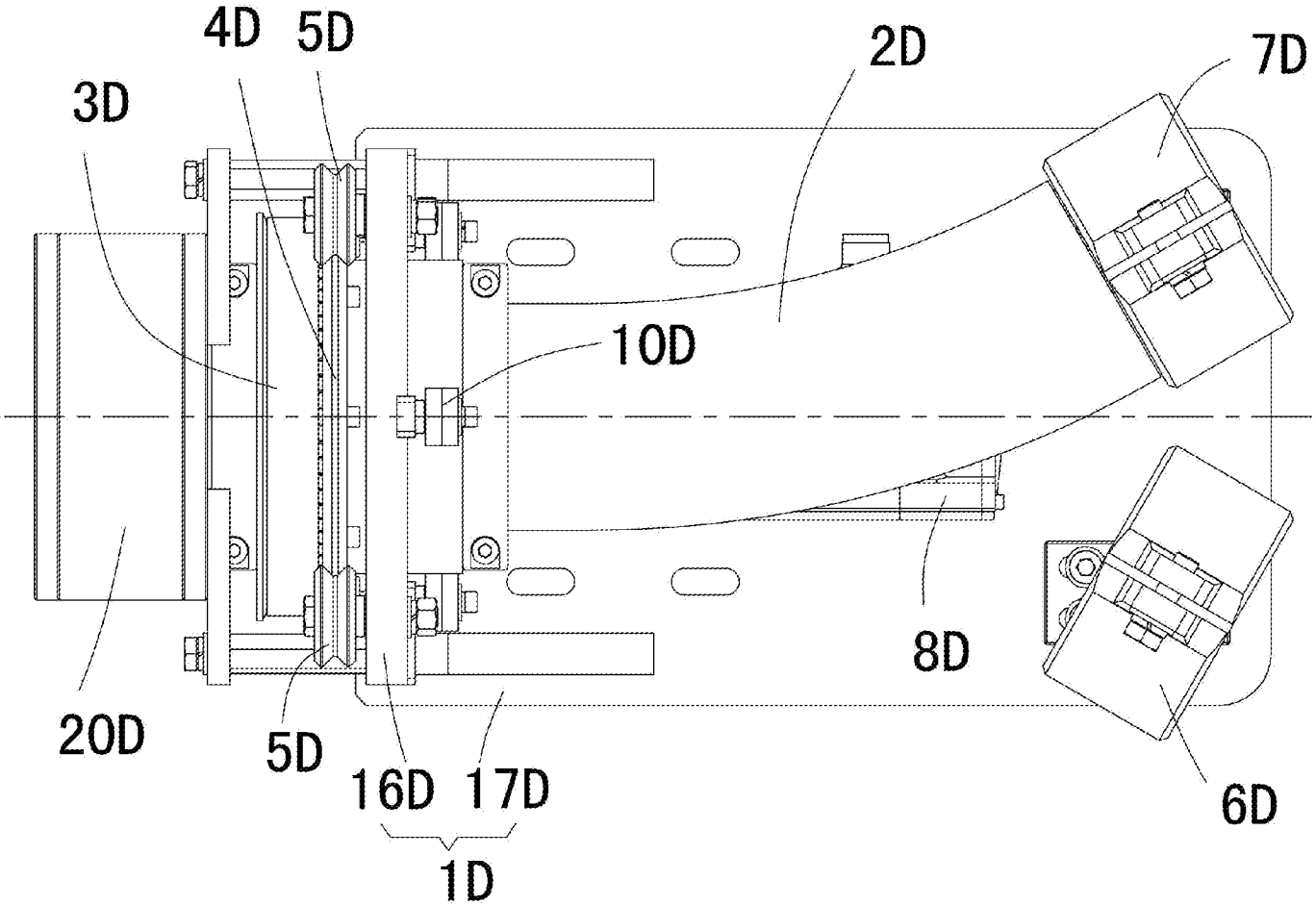
FIG. 19 is the top view of FIG. 18.
Figure 20:
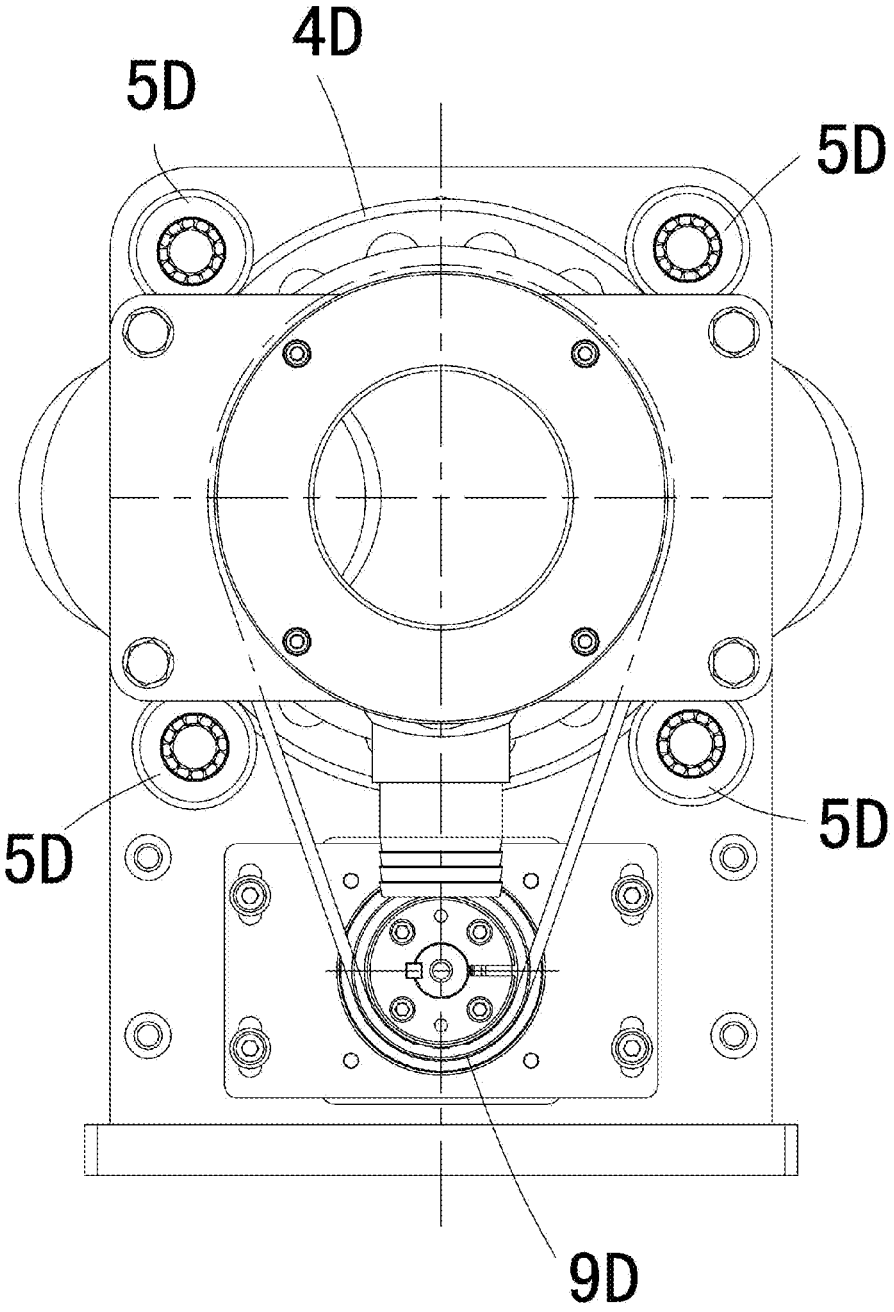
FIG. 20 is the left view of FIG. 19.
Figure 21:
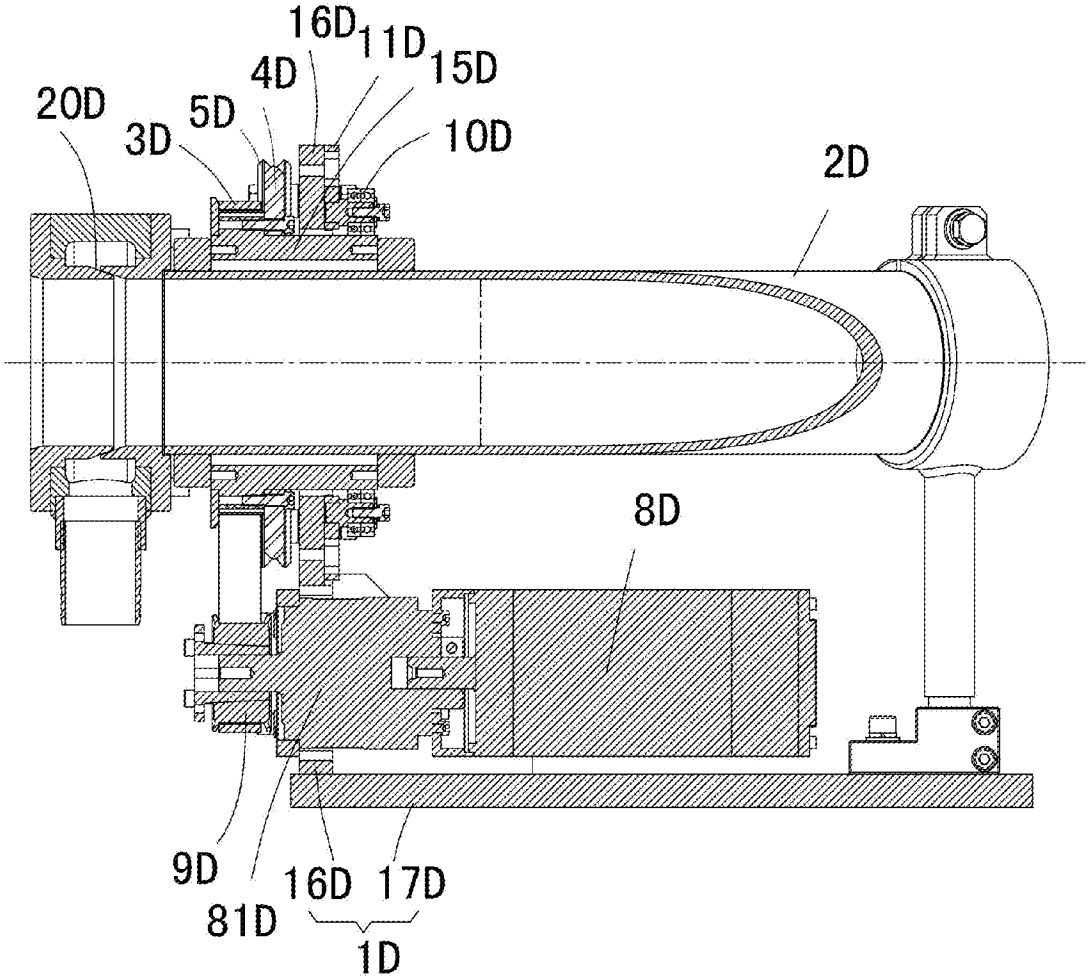
FIG. 21 is a sectional view of the structure of the cup outlet mechanism.
Figure 22:
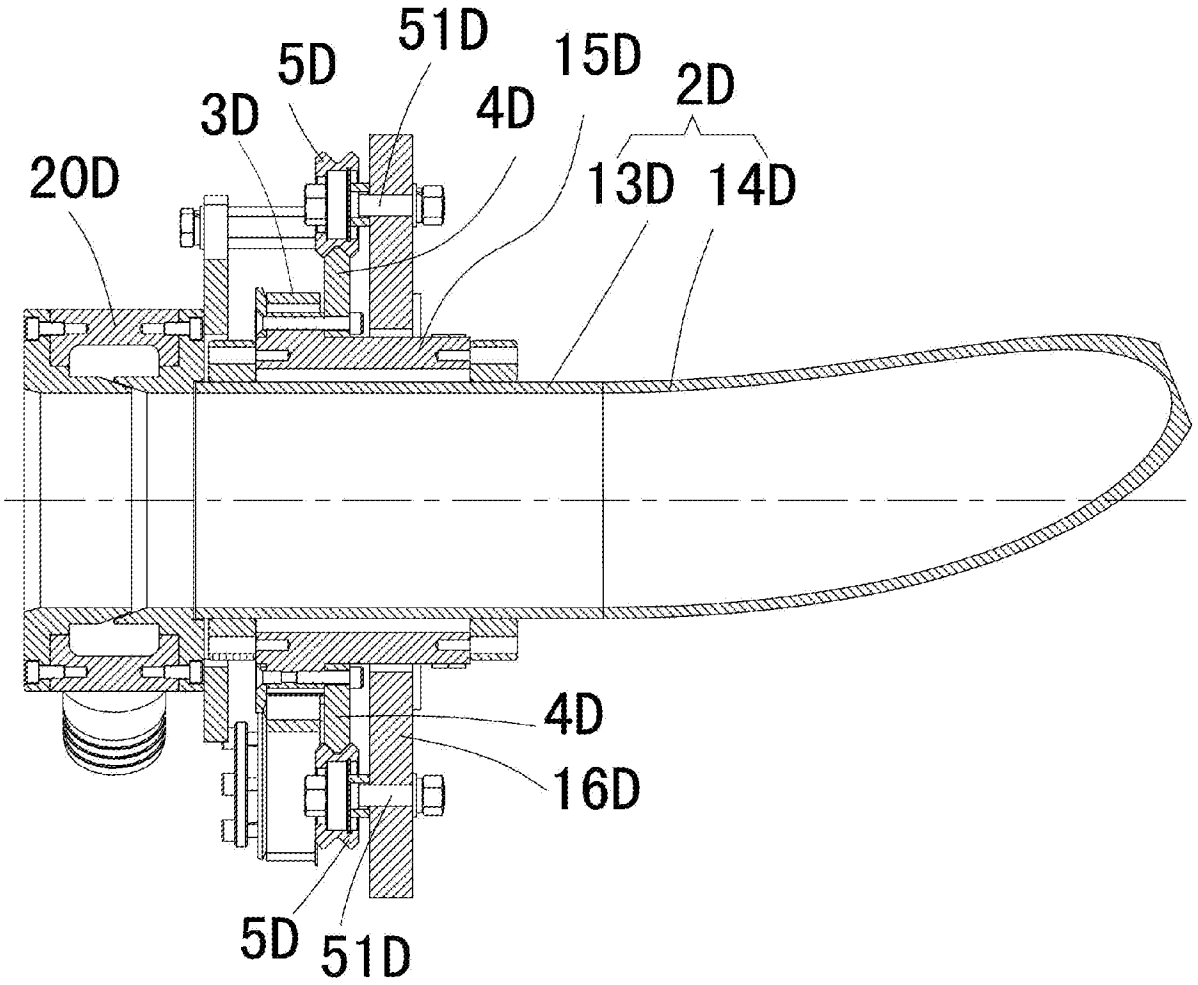
FIG. 22 is a sectional view of the structure of the cup outlet mechanism from another angle.
Figure 23:
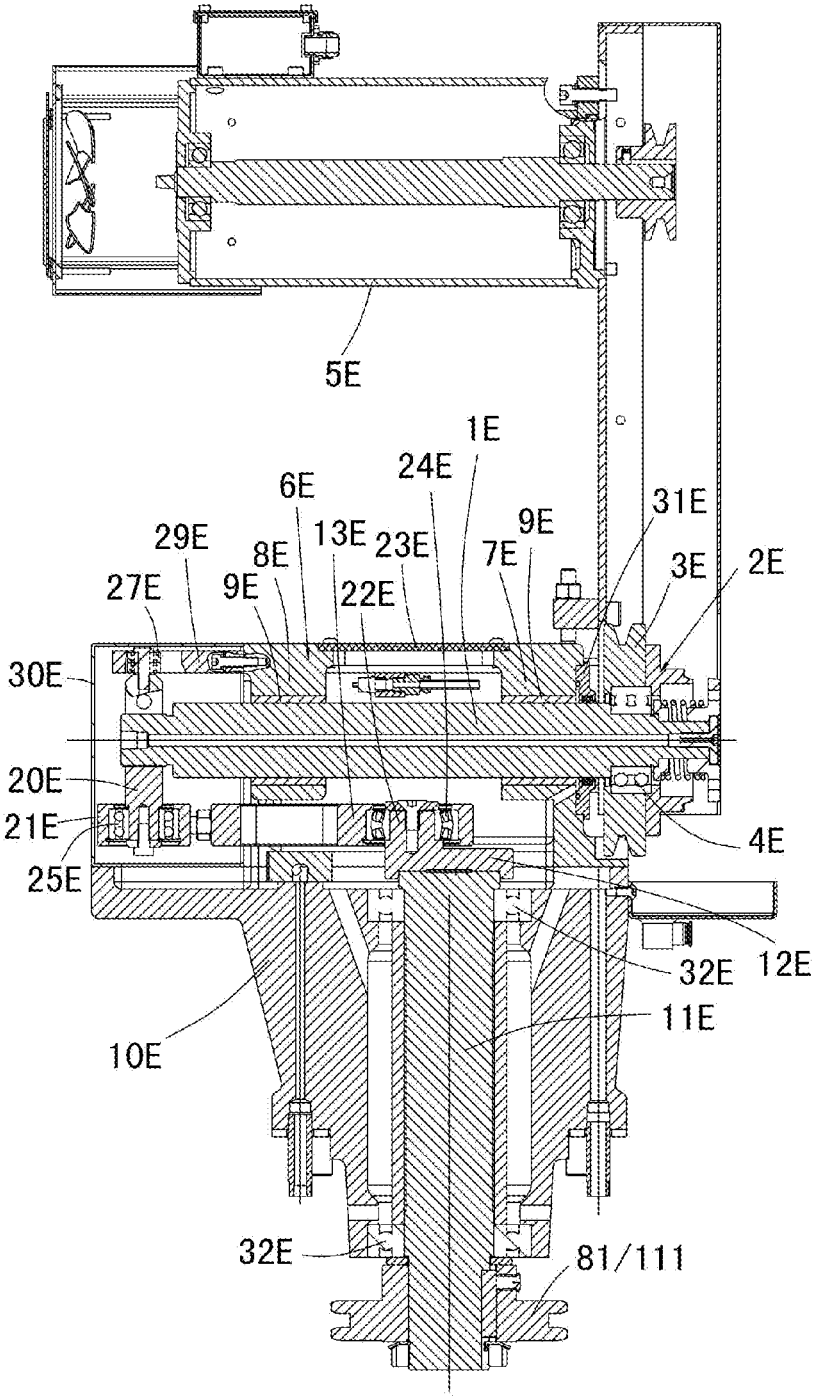
FIG. 23 is a sectional view of the structure of the crimping assembly.
Figure 24:
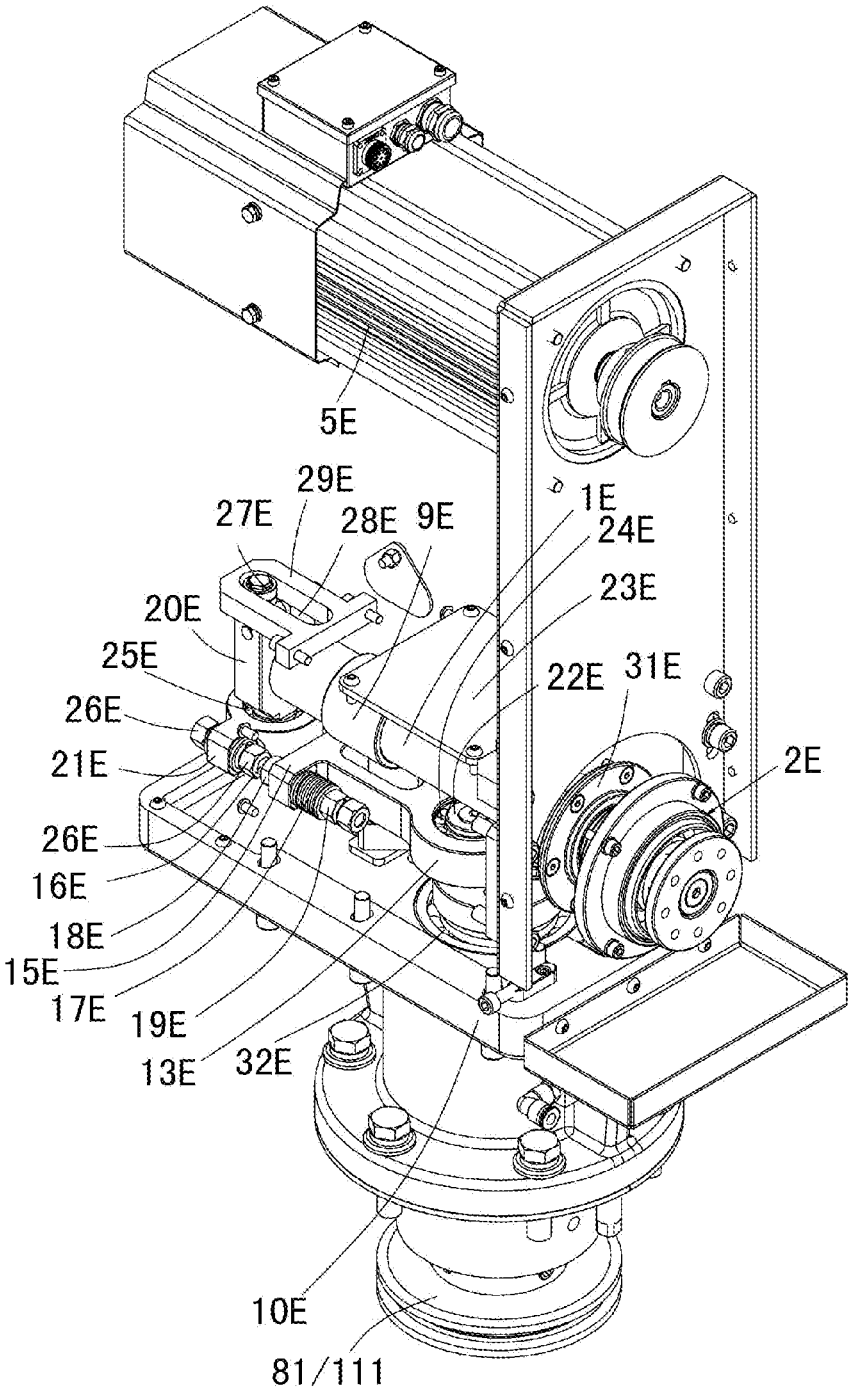
FIG. 24 is a perspective view of the crimping assembly shown in FIG. 23 (hiding some parts).
Figure 25:
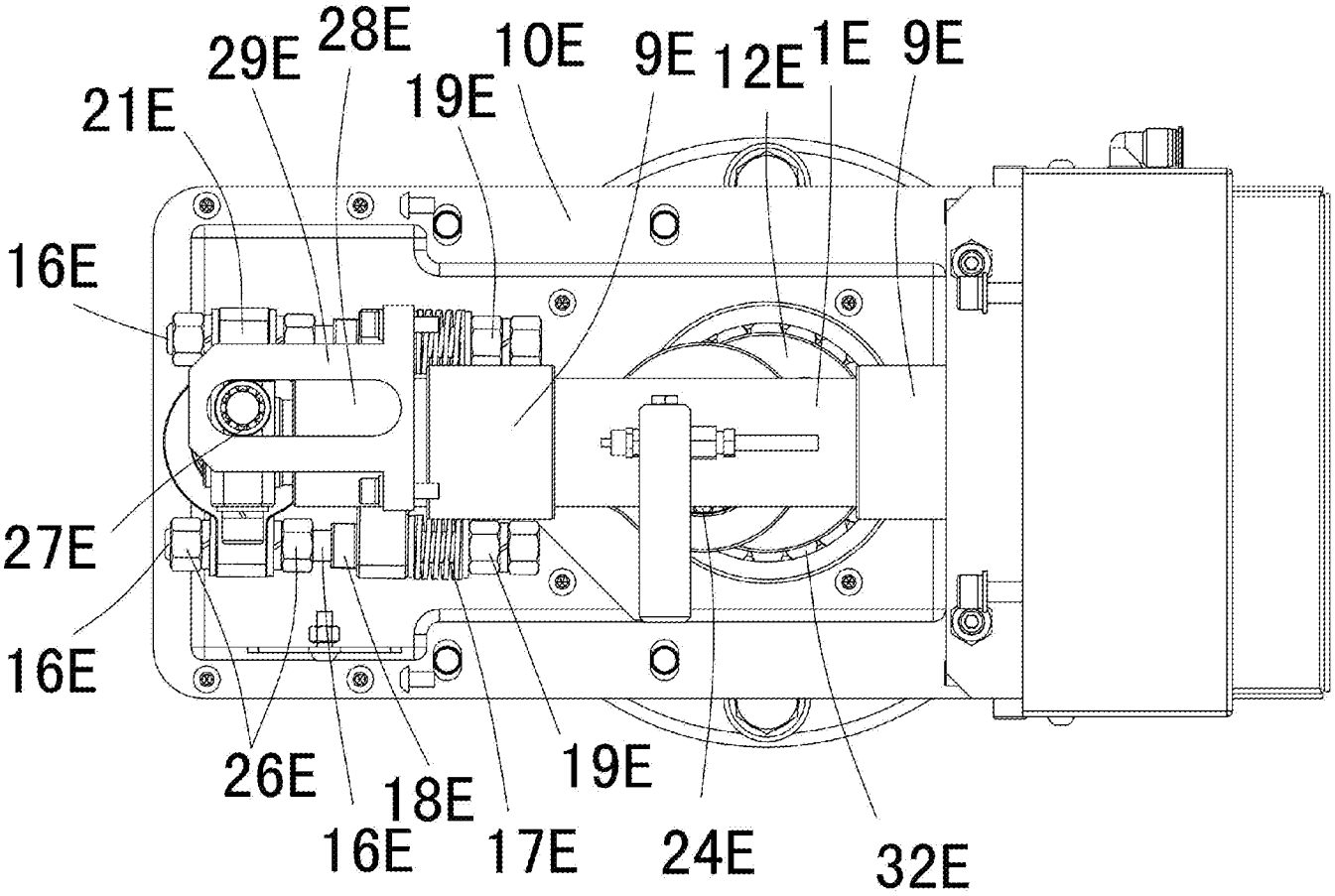
FIG. 25 is the top view of FIG. 24 (hiding the drive device 5E located in the above).

An opening is arranged at the rotation center of the turntable 1A, and the gripper opening lifting shaft 3A is arranged at the opening. The rotation of the turntable 1 does not affect the rising and falling of the gripper opening lifting shaft 3A. The gripper opening lifting shaft 3A is connected to the gripper opening plate 4A, and the gripper opening plate 4A is arranged above the turntable 1A. The gripper device includes the paper gripper 5A. The paper gripper 5A is hinged on the first mounting base 6A. The first mounting base is connected on the turntable, and the paper gripper can swing on the first mounting base. The paper supporting part 7A on the turntable is arranged under the paper gripper 5A. When the paper gripper 5A presses on the paper supporting part 7A, the paper gripper 5A cooperates with the paper supporting part 7A to clamp the paper. Further, the paper gripper 5A is equipped with the gripper reset device 8A, and the gripper reset device 8A maintains the state that the paper gripper cooperates with the paper supporting part to clamp the paper. The gripper opening plate cooperates with the paper gripper in a drive manner, and the gripper opening plate 4A rises and falls with the gripper opening lifting shaft 3A. When the gripper opening plate 4A falls, the gripper opening plate presses on the paper gripper, so as to open the paper gripper for paper input or output. The gripper opening plate is arranged at those stations where the gripper needs to open, such as the paper feeding station and the output station. At the paper feeding station, the gripper on the turntable clamps the paper. At the output station, the gripper releases the paper for follow-up processing. The rotation transmission device 20A includes the servo motor 21A, and the servo motor 21A drives the turntable to rotate. The servo motor drives the turntable to rotate at the predetermined angle. Four gripper devices are arranged on the turntable. The servo motor drives the turntable to rotate 90 degrees each time. The gripper opening plate correspondingly cooperates with the gripper device moving to the front and rear position, and the layout is space-efficient and the structure is compact. Combined with FIG. 4, when the gripper device is located in the front and rear position, the gripper device is located in the paper feeding station and the output station, respectively, and the left and right positions correspond to the vacant station and the heating station, respectively. The turntable paper feeding mechanism has high speed and can meet the needs of high-speed production. The turntable is driven by the servo motor to realize indexing rotation. The structure is simple and compact, and has high stability to meet the needs of high-speed operation. Further, the stop block 17A is arranged. The paper supporting part 7A adopts the edge of the turntable or the paper supporting plate is arranged. The gripper opening lifting shaft 3A is further equipped with the lifting reset device 19A (such as the spring).

The servo motor 21A is connected to the first output wheel 9A in a drive manner. The turntable 1A is connected to the first input wheel 10A. The turntable rotates synchronously with the first input wheel. The first output wheel 9A is connected to the first input wheel 10A in a drive manner. The first output wheel and the first input wheel adopt belt wheels, sprockets, gears and others, and the first output wheel and the first input wheel are connected by belt, chain or gear meshing. In the figures, belt wheel and belt are used to cooperate with the tensioning wheel 34A. The first output wheel 9A is arranged on the hollow support shaft 11A, and the slewing bearing 12A is arranged between the hollow support shaft and the first output wheel. The gripper opening lifting shaft is arranged in the hollow support shaft, and the gripper opening lifting shaft 3A is connected to the second cam device 27. The turntable rotates on the hollow support shaft, and the gripper opening lifting shaft rises and falls in the hollow support shaft, thereby making the turntable cooperate with the gripper opening lifting shaft. The upgrade transmission device drives the gripper opening lifting shaft to rise and fall, and the gripper opening lifting shaft rises and falls in the hollow support shaft. Specifically, the servo motor 21A can be equipped with the reducer 22A to connect to the first output wheel 9A, and the servo motor is used to increase drive speed and respond speed. The hollow support shaft is used for support, and the hollow support shaft is fixed on the frame 31A or the fixing base. The hollow support shaft is connected to the frame or the fixing base through the second mounting base 32A. The servo motor is connected to the hollow support shaft or the frame by the coupling plate 33A.

The second cam device 27 includes the transmission cam, and the transmission cam is arranged under the turntable. The transmission cam cooperates with the gripper opening lifting shaft in a drive manner to drive the gripper opening lifting shaft to rise and fall. The second cam device 27 is connected to the main transmission mechanism.

The paper gripper 5A is connected to the rotation shaft 18A, the rotation shaft 18A is hinged to the first mounting base 6A, and the first mounting base 6A is connected to the turntable 1A. The rotation shaft 18A is provided with the pressure-loaded part 15A, and the gripper opening plate 4A is connected to the pressure applying part 16A. When working, the pressure applying part exerts pressure on the pressure-loaded part, and the rotation shaft 18A rotates to drive the paper gripper 5A to rotate, thereby opening the paper gripper. The paper grippers are arranged at both ends of the rotation shaft to firmly clamp paper. The gripper reset device 8A includes the gripper reset spring, and the gripper reset spring is arranged under the pressure-loaded part. The gripper reset device resets the rotation shaft. The pressure-loaded part 15A is equipped with the pressure-loaded bearing to be pressed, resulting in a smooth cooperation. The pressure applying part 16A is the adjusting bolt, and the length of the adjusting bolt is adjusted to meet different needs.

The forming machine further includes the main transmission mechanism, and the main transmission mechanism includes the main motor 17, the main shaft 18, the first transmission auxiliary shaft 19 and the second transmission auxiliary shaft 20. The main motor 17 adopts the servo motor, the main motor 17 is connected to the main shaft 18 in a drive manner, the main motor 17 drives the main shaft 18 to rotate, and the main motor 17 is driven by the gearbox 171 (including the first bevel gear pair). The main shaft 18 is respectively connected to the A cylindrical indexing camshaft 21 of the seven-station main rotation tower forming mechanism and the B cylindrical indexing camshaft 22 of the seven-station auxiliary rotation tower forming mechanism. The main shaft 18 drives the A cylindrical indexing camshaft and the B cylindrical indexing camshaft to rotate, and the corresponding cylindrical indexing cams rotate to promote the indexing rotation. The A cylindrical indexing camshaft, the B cylindrical indexing camshaft and the main shaft 18 are parallel to the second transmission auxiliary shaft 20. The first transmission auxiliary shaft is connected between the A cylindrical indexing camshaft and the second transmission auxiliary shaft, and the first transmission auxiliary shaft is perpendicular to the second transmission auxiliary shaft, wherein the first transmission auxiliary shaft and the A cylindrical indexing camshaft are connected through the second bevel gear pair in a drive manner, and the first transmission auxiliary shaft and the B cylindrical indexing camshaft are connected through the third bevel gear pair in a drive manner. The layout of the main transmission mechanism is reasonable and compact, and can match with the four-four-seven station layout. The main shaft 18, the first transmission auxiliary shaft 19, the second transmission auxiliary shaft 20, the A cylindrical indexing camshaft and the B cylindrical indexing camshaft are arranged in the same plane. The first transmission auxiliary shaft is located between the main rotation tower forming mechanism and the auxiliary rotation tower forming mechanism. The cam structure is arranged on the first transmission auxiliary shaft for other transmission. For example, the cam assembly is arranged on the first transmission auxiliary shaft, and the cam assembly cooperates with the blank holder spring of the main rotation tower in a drive manner, and the blank holder spring drives the blank holder block to move up and down, which can cushion the lower pressure of the blank holder spring corresponding to each horizontal die. The main shaft and the A cylindrical indexing camshaft are connected by helical gear pair or belt transmission pair in a drive manner, and the main shaft and B cylindrical indexing camshaft are connected by the chain sprocket pair in a drive manner, which facilitates the assembly and improves the matching degree.

The stamping die assembly 4 includes the stamping drive wheel device 41. The first cup bottom preheating assembly 6 includes the first cup bottom preheating drive wheel device 61. The second cup bottom preheating assembly 7 includes the second cup bottom preheating drive wheel device 71. The bottom crimping assembly 8 includes the bottom crimping drive wheel device 81. The rolling assembly 9 includes the rolling drive wheel device 91. The cup rim lubrication assembly 10 includes the cup rim lubrication drive wheel device 101. The pre-crimping assembly 11 includes the pre-crimping drive wheel device 111. The first final crimping assembly 12 includes the first final crimping drive wheel device 121, and the second final crimping assembly 13 includes the second final crimping drive wheel device 131. Each drive wheel device adopts a sprocket assembly, which has a good transmission effect and a more stable high-speed operation. Each drive wheel device is arranged on the rotating vertical shaft, and the eccentric wheel on the rotating vertical shaft drives the corresponding parts to reciprocate back and forth.

The main shaft 18 is connected to the first drive wheel device 23 in a drive manner, and the main shaft 18 transmits power to the first drive wheel device 23, wherein the main shaft and the first drive wheel device are connected by the fourth bevel gear pair in a drive manner. The first drive wheel device 23 is connected to the second final crimping drive wheel device 131 and the first final crimping drive wheel device 121 in a drive manner. The first drive wheel device transmits power to the second final crimping drive wheel device and the first final crimping drive wheel device. The first drive wheel device 23 and the second final crimping drive wheel device 131 are connected by the chain, the second final crimping drive wheel device 131 and the first final crimping drive wheel device 121 are connected by the chain, and the second final crimping drive wheel device has two sets of sprockets for driving. The first drive wheel device 23 is further connected to the rolling drive wheel device 91 and the bottom crimping drive wheel device 81 in a drive manner. The first drive wheel device 23 transmits power to the rolling drive wheel device 91 and the bottom crimping drive wheel device 81. The first drive wheel device 23 and the rolling drive wheel device 91 are connected by the chain, and the rolling drive wheel device 91 and the bottom crimping drive wheel device 81 are connected by the chain. The first drive wheel device has two sets of sprockets for driving, and the rolling drive wheel device has two sets of sprockets for driving.

The second transmission auxiliary shaft 20 is connected to the second drive wheel device 24 and the third drive wheel device 25 in a drive manner, respectively. The second drive wheel device 24 and the third drive wheel device 25 are respectively connected to both ends of the second transmission auxiliary shaft 20. The second transmission auxiliary shaft 20 and the second drive wheel device 24 are connected in a drive manner by the fifth bevel gear pair, and the second transmission auxiliary shaft 20 and the third drive wheel device 25 are connected in a drive manner by the sixth bevel gear pair. The second drive wheel device 24 is connected to the pre-crimping drive wheel device 111, the stamping drive wheel device 41 and the cup rim lubrication drive wheel device 101 in a drive manner. The second drive wheel device 24 and the pre-crimping drive wheel device 111 are connected by the chain, the second drive wheel device 24 and the stamping drive wheel device 41 are connected by the chain, and the stamping drive wheel device 41 and the cup rim lubrication drive wheel device 101 are connected by the chain. The second drive wheel device 24 has two sets of sprockets for driving and the stamping drive wheel device has two sets of sprockets for driving. The third drive wheel device 25 is connected to the first cup bottom preheating drive wheel device 61 and the second cup bottom preheating drive wheel device 71 in a drive manner. The third drive wheel device and the first cup bottom preheating drive wheel device are connected by the chain, and the third drive wheel device and the second cup bottom preheating drive wheel device are connected by the chain.

The second transmission auxiliary shaft 20 is connected to the first cam device 26, and the first cam device is connected to the cup clamp mechanism in a drive manner. The second transmission auxiliary shaft 20 is further connected to the second cam device 27, the second cam device is connected to the lifting shaft at the center of the turntable of the four-station turntable paper feeding mechanism in a drive manner, and the transmission cam of the second cam device is connected to the second transmission auxiliary shaft. The forming machine is further provided with the cup bottom oil dipping station between the second cup bottom preheating station and the bottom crimping station, and the cup bottom oil dipping device is arranged at the cup bottom oil dipping station. The cup bottom oil dipping device includes a cup bottom oil dipping pan. After the cup bottom dips the oil, the bottom is smoothly crimped. During the rotation of the main rotation tower forming mechanism, the paper tube above the main rotation tower forming mechanism will contact the cup bottom oil dipping device without stopping.

The stamping die assembly 4 includes the bottom forming device. The bottom forming device includes the stamping transmission hollow shaft 1B and the forming transmission shaft 2B, and the stamping transmission hollow shaft 1B and the forming transmission shaft 2B are transversely arranged. The front end of the forming transmission shaft 2B is connected to the forming male die 3B, and the front end of the stamping transmission hollow shaft 1B is connected to the stamping male knife 4B. The knife base 5B may be arranged on the stamping transmission hollow shaft 1B for the installation of the stamping male knife 4B.

In order to compartmentalize the structure, run stably and meet the demand of high-speed operation, the first guide sleeves 6B are respectively provided on the outer sides of the front and rear portions of the stamping transmission hollow shaft 1B, and the first guide sleeves 6B support the front and rear portions of the stamping transmission hollow shaft 1B when moving. The first guide sleeve adopts the copper sleeve, and when the stamping transmission hollow shaft moves transversely, the first guide sleeves form the front and rear double support for the stamping transmission hollow shaft, thereby making the operation more stable. The forming transmission shaft 2B is located inside the stamping transmission hollow shaft 1B, the second guide sleeves 6B are respectively provided on the outer sides of the front and rear portions of the forming transmission shaft 2B. The second guide sleeve also adopts the copper sleeve, and the second guide sleeve 7B is located between the stamping transmission hollow shaft 1B and the forming transmission shaft 2B. When the forming transmission shaft moves transversely, the second guide sleeves in the stamping transmission hollow shaft support the front and rear portions of the forming transmission shaft, thereby making the operation more stable. The stamping transmission hollow shaft is connected to the forming transmission shaft, which is compact, reasonable and stable, and can meet the demand of high-speed operation. The first rotation drive vertical shaft 8B is arranged under the stamping transmission hollow shaft 1B, and the first rotation drive vertical shaft 8B is respectively connected to the stamping transmission hollow shaft 1B and the forming transmission shaft 2B in a drive manner. The first rotation drive vertical shaft 8B cooperates with the stamping transmission hollow shaft 1B and the forming transmission shaft 2B, which has higher stability, avoids jitter and meets the need of high-speed operation.

Specifically, the first rotation drive vertical shaft 8B is provided with the cam transmission mechanism and the first eccentric wheel transmission mechanism. The stamping transmission hollow shaft is provided with the lower hollow 9B, the cam transmission mechanism is located at the lower hollow 9B, and the cam transmission mechanism is connected to the forming transmission shaft 2B in a drive manner. The cam transmission mechanism and the forming transmission shaft are connected in a drive manner by the lower hollow. The first eccentric wheel transmission mechanism is connected to the stamping transmission hollow shaft in a drive manner. The transmission structure is reasonable and stable to meet the demand of speed increase. The cam transmission mechanism includes the cam 10B, the cam 10B is connected to the first rotation drive vertical shaft 8B, and the first rotation drive vertical shaft drives the cam to rotate. The first eccentric wheel transmission mechanism includes the first eccentric wheel 11B, the first eccentric wheel 11B is connected to the first rotation drive vertical shaft, and the first rotation drive vertical shaft drives the first eccentric wheel to rotate. The cam 10B is located above the first eccentric wheel.

The cam 10B of the cam transmission mechanism preferably adopts the conjugate cam. The forming transmission shaft 2B is provided with the first front roller 12B and the first rear roller 13B. The first front roller 12B is located on the front side of the conjugate cam, the first rear roller 13B is located on the rear side of the conjugate cam, and the first front roller and the first rear roller are correspondingly connected to the conjugate cam in a drive manner, respectively. The conjugate cam drives the first front roller and the first rear roller of the forming transmission shaft to make the forming transmission shaft move forward and backward. The first front roller, the first rear roller and the conjugate cam are located at the lower hollow 9B of the stamping transmission hollow shaft 1B, and cooperate with each other for transmission.

The anti-rotation device is arranged between the forming transmission shaft and the stamping transmission hollow shaft to avoid the forming transmission shaft rotating in the stamping transmission hollow shaft, thereby making the operation more stable. For example, the anti-rotation device includes the transverse long hole 14B, the anti-rotation block 15B and the anti-rotation wheel groups 16B, wherein the transverse long hole is located on the upper side wall of the stamping transmission hollow shaft 1B, the anti-rotation block is connected on the forming transmission shaft 2B, and the anti-rotation wheel groups are arranged on the outside of the stamping transmission hollow shaft. When passing through the transverse long hole, the anti-rotation block is clamped by the anti-rotation wheel groups. The anti-rotation wheel groups cooperate with the anti-rotation block to guide the forming transmission shaft when the forming transmission shaft moves transversely, thereby avoiding the forming transmission shaft rotating. When the forming transmission shaft moves transversely, the anti-rotation block is clamped by the anti-rotation wheel groups to move forward and backward transversely.

The first eccentric wheel of the first eccentric wheel transmission mechanism is separated from or integrated with the first rotation drive vertical shaft. The figure shows the integral structure of the first eccentric wheel 11B and the first rotation drive vertical shaft 8B. Preferably, the first eccentric wheel 11B is connected to the first sleeve base 17B in a drive manner, and the sleeve hole of the first sleeve base 17B is sleeved on the first eccentric wheel 11B. When the first eccentric wheel 11B rotates with the first rotation drive vertical shaft 8B, the first eccentric wheel 11 drives the first sleeve base 17B to sway. The rear end of the first sleeve base is the first connection part 18B, the left and right sides of the first connection part are respectively provided with the pull rod hole, and the first pull rod 19B is arranged in the pull rod hole, that is, the first pull rod is arranged in the left pull rod hole and the right pull rod hole, respectively. The first spring 20B and the first limiting part 21B are arranged on the first pull rod 19B, and the first limiting part and the first spring are respectively arranged on the front and rear sides of the pull rod hole. The first spring cooperates with the first limiting part to keep the first pull rod stable in the corresponding pull rod hole of the first connection part, and when the first sleeve base is driven to sway, the first pull rod can move slightly relative to the position of the pull rod hole. The first spring is pre-tightened on the pull rod by the pre-tightening nut 53B. The rear part of the stamping transmission hollow shaft 2B is connected to the first transmission block 22B, and the first transmission block 22B is hinged with the first coupling base 23B located under the first transmission block 22B. The left part of the first coupling base 23B is connected to the first pull rod on the left side of the first connection part 18B, and the right part of the first coupling base 23B is connected to the first pull rod on the right side of the first connection part 18B. The first pull rods are respectively connected to the left and right sides of the first coupling base 23B. When the first eccentric wheel 11B drives the first sleeve base 17B to sway, the first pull rod 19B drives the first coupling base 23B to swing and move forward and backward, and the first coupling base drives the first transmission block 22B, as well as stamping transmission hollow shaft 1B connected to the first coupling base, to move forward and backward. The first eccentric wheel transmission mechanism has reasonable structure and stable operation, and can meet the demand of high-speed operation.

The bearing 24B is arranged between the first eccentric wheel 11B and the sleeve hole to make the first eccentric wheel 11B drive the first sleeve base 17B smoothly. The first coupling base 23B is provided with the hinge hole, and the bearing 25B (such as the double-row angular contact ball bearing) is arranged between the first transmission block 22B and the hinge hole to make the transmission between the first coupling base 23B and the first transmission block 22B smooth. The swing gap is left between the pull rod hole and the first pull rod 19B, that is, the first pull rod can swing in the pull rod hole. The first coupling base 23B is provided with the through holes to connect to the first pull rod, and both sides of the through hole are respectively provided with the locking nuts 26B on the first pull rods. The position of the first pull rod relative to the first coupling base can be changed by adjusting the positions of the locking nuts 26B, so as to adjust the starting position of the stamping transmission hollow shaft to meet the needs of the installation of the stamping male knife 4B or the reinstallation of the stamping male knife after the stamping male knife is sharpened.

The fixing frame 34B is arranged in front of the stamping male knife 4B, and the fixing frame 34B is provided with the stamping female knife 35B. The stamping male knife cooperates with the stamping female knife to accomplish stamping. The fixing frame 34B is provided with the molding female die 36B, and the molding male die is matched with the molding female die. The stamping female knife, the stamping male knife, the molding female die, and the molding male die are arranged coaxially. The stamping female knife is integrated with or separated from the molding female die. The figure shows the integration structure of the stamping female knife and the molding female die, which is more convenient to set up and assemble.

The fixing frame is provided with many structures for arranging the stamping female knife and the molding female die. Preferably, the following structure is adopted. The fixing frame includes the rear plate and the front plate, the front plate is connected to the rear plate by fasteners (such as screws). The rear plate is provided with grooves, and the grooves are located between the front plate and the rear plate. The grooves are provided for the paper stock to pass up and down. The front plate is provided with the assembly through hole for the assembly of the stamping female knife and the molding male die, wherein, the assembly through hole adopts the step hole, and the stamping female knife and the molding female die are assembled to the front plate by fasteners (such as screws).

The first guide sleeve 6B is clamped and supported by the upper fixing base 27B and the lower fixing base 28B. The first rotation drive vertical shaft 8B is rotated and supported by the lower fixing base, and the bearing 29B is arranged between the first rotation drive vertical shaft and the lower fixing base. The upper fixing base is coupled to the lower fixing base to form the base body, and the lower part of the first rotation drive vertical shaft 8B is connected to the stamping drive wheel device 41.

In the embodiment, the cup clamp mechanism 5 includes the mounting shaft 2C, and the mounting shaft 2C is arranged on the first support frame 1C. The mounting shaft is connected to the flip cup clamps 3C and 4C. The flip cup clamp 3C is connected to the connecting rod 9C in a drive manner, the flip cup clamp 4C is connected to the connecting rod 10C in a drive manner, and the connecting rod drives the flip cup clamp to flip on the mounting shaft. The flip cup clamp includes the left cup clamp and the right cup clamp, and the left cup clamp and the right cup clamp are respectively driven and flipped by the corresponding connecting rod (including the left connecting rod and the right connecting rod). The opening and closing action of the flip cup clamps cooperate with the mold to form cup.

In order to make the connecting rods 9C and 10C more stable when swinging and lifting, and to ensure the high-speed operation, in the embodiment, the first support frame 1 includes the diaphragm plate 14C. The diaphragm plate 14C is provided with the movable hole 51C. The sliding sleeve 52C is arranged in the movable hole 51C. The first joint bearing 53C is arranged in the sliding sleeve 52C. The upper part of the diaphragm plate 14C is connected to the upper cover 54C located above the diaphragm plate, and the lower part of the diaphragm plate is connected to the lower bracket 55C located under the diaphragm plate. The sliding sleeve 52C in the movable hole 51C slidably cooperates with the upper cover 54C and the lower bracket 55C. The sliding sleeve 52C is clamped in the movable hole 51C by the upper cover 54C and the lower bracket 55C, and the first joint bearing 53C in the sliding sleeve 52C moves with the sliding sleeve 52C. The upper cover 54C is provided with the upper movable channel 56C for the connecting rod to pass through, and the lower bracket 55C is provided with the lower movable channel 57C for the connecting rod to pass through, so that the connecting rod can be connected to the guide sleeve 58C of the first joint bearing in the movable hole to lift and swing, so that the connecting rod can be connected to the first cam device 26 located under the connecting rod in a drive manner. The guide sleeve 58C is arranged in the inner hole of the first joint bearing 53C, that is, the guide sleeve is connected in the inner hole of the inner ring of the first joint bearing. The connecting rods 9C and 10C are configured in the corresponding guide sleeve 58C, and the connecting rod slides axially relatively to the guide sleeve. When the inner ring of the first joint bearing rotates in the outer ring, the guide sleeve is supported and rotated by the first joint bearing, and the connecting rod moves relatively to the guide sleeve. The position of the first joint bearing relative to the die can be adjusted by replacing lower brackets with different thickness specifications.

The connecting rods 9C and 10C can slide axially in the guide sleeve 58C of the first joint bearing. When the connecting rod is driven to swing and lift, the connecting rod can slide axially in the guide sleeve of the first joint bearing, and cooperate with the first joint bearing to slide with the guide sleeve in the movable hole. The inner ring of the first joint bearing rotates in the outer ring, making the connecting rod more stable in the process of swinging and lifting, and meeting the needs of high-speed operation.

The flip cup clamps 3C and 4C are hinged on the mounting shaft 2C so that the flip cup clamps are flipped on the mounting shaft to realize opening and closing. For example, the flip cup clamps 3C and 4C are sleeved on the mounting shaft, and the rotating bearing is arranged between the flip cup clamp and the mounting shaft for smooth rotation. The mounting shaft is located on the supporting vertical plate 12C of the first support frame 1C, and the supporting vertical plate 12C is connected to the diaphragm plate 14C. The second joint bearing 24C is arranged between the connecting rod 9C and the flip cup clamp 3C, and the second joint bearing 30C is arranged between the connecting rod 10 C and the flip cup clamp 4C. The second joint bearing 24 C is connected at the upper end of the connecting rod 9C, and the flip cup clamp 3C is connected to the second joint bearing 24C. The second joint bearing 30 C is connected at the upper end of the connecting rod 10C, and the flip cup clamp 4C is connected to the second joint bearing 30C.

The lower end of the connecting rod 9C is connected to the third joint bearing 26C, and the lower end of the connecting rod 10C is connected to the third joint bearing 32C. The third joint bearings are used for driving the connecting rods 9C and 10C lift and swing. Specifically, the connecting rod 9C is connected to the rocker arm 36C, and the connecting rod 10C is connected to the rocker arm 38C. The rocker arm 36C is hinged on the fixing base 37C, and the rocker arm 38C is hinged on the fixing base 39C. The rocker arms are connected to the first cam device 26. The first cam device 26 drives the rocker arm 36C to swing back and forth on the fixing base 37C, and drives the rocker arm 38C to swing back and forth on the fixing base 39C. The swing of the rocker arm 36C drives the connecting rod 9C to swing back and forth and lift up and down, and the swing of the rocker arm 38C drives the connecting rod 10C to swing back and forth and lift up and down. Specifically, the first cam device 26 includes the conjugate cams 41C and 42C. The conjugate cam 41C drives the rocker arm 36C to swing back and forth, and the conjugate cam 42C drives the rocker arm 38C to swing back and forth. Each rocker arm is provided with two groups of rotors to cooperate with the conjugate cam, so that the transmission is more stable and can meet the needs of more high-speed operation. Specifically, each rocker arm is provided with the transmission shaft, and each transmission shaft is correspondingly connected to the third joint bearings 26C and 32C to realize the transmission connection between the connecting rod and the rocker arm. The conjugate cams 41C and 42C are connected to the second transmission auxiliary shaft 20.

The upper end face of the sliding sleeve 52C slidably cooperates with the upper cover 54C, and the lower end face of the sliding sleeve 52C slidably cooperates with the lower bracket 55C.

The upper end face of the sliding sleeve 52C is always in contact with the upper cover 54C in a sliding and sealing manner, and/or the lower end face of the sliding sleeve 52C is always in contact with the lower bracket 55C in a sliding and sealing manner. When the sliding sleeve slides in the movable hole between the upper cover and the lower bracket, the sliding sleeve will remain in contact with the upper cover or/and the lower bracket in a sliding and sealing manner, so as to prevent the lubrication oil of the transmission part under the diaphragm plate from contaminating to the top part of the diaphragm plate, and to prevent the paper dust and paper powder of the molding part above the diaphragm plate from spreading to the lower part of the diaphragm plate to affect the transmission part. In the figure, the upper movable channel on the upper cover is the through hole (such as the step through hole), and the pore size of the through hole is smaller the pore size of the movable hole.

In order to make the wrapping more stable, the paper pressing strip 5C is arranged between the flip cup clamps 3C and 4C, and is located above the mounting shaft 2C. The paper pressing strip 5C is connected to the lifting shaft 6C in a drive manner. The lifting shaft 6C is provided with the falling transmission part 7C, and the falling transmission part 7C cooperates with the flip cup clamps in a drive manner. The lifting shaft 6C is further connected to the rising reset device 8C. The flip cup clamps flip downward to drive the falling transmission part 7C to fall, and the lifting shaft will also fall. When the flip cup clamps flip upward, the rising reset device 8C drives the lifting shaft 6C to rise. The rise and fall of the lifting shaft will drive the paper pressing strip 5C to rise and fall.

When the flip cup clamp 3C or 4C flips downward (away from the die) to press on the falling transmission part 7C, the falling transmission part is driven to fall, so as to drive the lifting shaft 6C to fall, and the fall of the lifting shaft drives the paper pressing strip to drop down. When the flip cup clamp flips upward (close to the die), the lifting shaft rises under the reset of the rising reset device. The rise and fall of the lifting shaft will, in turn, drive the paper pressing strip 5C to rise and fall. The paper pressing strip rises to press on the lower side of the die to press the paper, so that the flip cup clamps finally close to cooperate with the die to form the paper container. The fall of the paper pressing strip is driven by the corresponding flip cup clamp, and the rise of the paper pressing strip is driven by the rising reset device, which does not need to be equipped with additional power source. The structure is space-efficient and compact, the mechanical linkage efficiency is high, and the operation is stable. The falling transmission part 7C is located under the flip cup clamps. Preferably, the flip cup clamp is connected to the pressure wheel 44C, and the pressure wheel cooperates with the falling transmission part for smooth transmission. The pressure wheel 44C can be arranged on the corresponding connecting shaft, and the connecting shaft on the flip cup clamp is correspondingly connected to the second joint bearing.

The falling transmission part 7C is provided with the wheel groups 11C, the wheel groups 11C rely on the elevation (vertical plane) of the first support frame 1C to roll. The wheel groups 11C rely on the elevation and keep rolling, making the falling transmission part and the lifting shaft rise and fall stably, resulting in the compact structure. To avoid the problem of rotation of the lifting shaft, two wheel groups 11C are arranged on the front and rear side of the elevation, which makes a more stable foundation.

The first support frame 1C includes the support vertical plate 12C, and the mounting shaft 2C is arranged on the support vertical plate 12C. The first support frame is provided with the guide hole 13C, the lifting shaft is arranged in the guide hole 13C, and the guide hole 13C can adopt the guide sleeve to stabilize the lifting shaft. The guide hole is located in the support vertical plate 12C. Specifically, the side surface of the support vertical plate can be used as the elevation of the first support frame, and the support vertical plate 12C is connected to the diaphragm plate 14C to form the first support frame 1C, and the diaphragm plate is also provided with the guide hole for the lifting shaft.

The paper pressing strip is connected to the third mounting base 15C, the third mounting base is provided with the avoidance channel 16C, the third mounting base 15C is connected to the lifting shaft 6C, and the mounting shaft 2C is located in the avoidance channel 16C. The lifting shaft drives the third mounting base 15C to rise and fall, which does not interfere with the mounting shaft, and the structural layout is reasonable and compact.

The falling transmission part 7C includes the locking block 17C, and the locking block 17C is provided with the locking hole 18C and the locking groove 19C. The locking hole is communicated with the locking groove. The locking block is equipped with the locking fastener 20C (such as the fastening bolt), and the lifting shaft 6C is connected in the locking hole 18C. The locking groove and the locking hole can be locked or unlocked by adjusting the locking fastener, the relative upper and lower position of the locking block and the lifting shaft can be adjusted, and the relative upper and lower position of the falling transmission part 7C and the lifting shaft 6C will also be adjusted, the starting position of the working fit of the paper pressing strip can be adjusted, and the position of the right flip cup clamp relative to the left flip cup clamp can be adjusted. The falling transmission part 7C is provided with the adjusting bolt 21C. The position of the falling transmission part 7C relative to the flip cup clamp can be further adjusted by adjusting the height position of the adjusting bolt 21C. The adjusting bolt is further provided with the locking nut 22C, which can lock the adjusting bolt, that is, avoid adjusting bolt unlocked, after adjusting the height of the adjusting bolt. When working, the paper pressing strip first rises and presses on the die, and then the flip cup clamp continues to flip upward and finally closes and presses on the die. After forming the paper container, the flip cup clamp flips downward first, and then drives the paper pressing strip to fall.

Specifically, preferably, the rising reset device 8C includes the reset spring 23C. The reset spring 23C is sleeved on the lifting shaft 6C, and the reset spring 23C cooperates with the falling transmission part 7C. The reset spring can release elastic force to drive the falling transmission part to raise and reset. The reset spring is used to reset the lifting shaft, making the installation convenient. The reset spring can cushion the paper pressing strip when the paper pressing strip comes into contact with the die, so as to avoid crushing the parts. Specifically, the rising reset device 8C can act on the falling transmission part. When the falling transmission part falls under the action of the flip cup clamp, the reset spring deforms and stores energy (compression). When the flip cup clamp flips upward, the reset spring releases elastic force to drive the falling transmission part to raise and reset.

Referring to the figures, the cup outlet assembly 14 includes the cup outlet mechanism, and the cup outlet mechanism includes the second support frame 1D. The second support frame 1D is provided with the bend pipe 2D, and the bend pipe 2D is used for the finished paper container to pass through. The bend pipe 2D is connected to the second input wheel 3D and the rotation positioning disc 4D, the inlet of the bend pipe is coaxially (that is, the coaxial line) arranged with the second input wheel and the rotation positioning disc. The second input wheel is connected to the rotation transmission device, and the rotation transmission device drives the second input wheel 3D to rotate, so that the bend pipe, the second input wheel and the rotation positioning disc will rotate synchronously. Preferably, the inlet of the bend pipe 2D keeps horizontal with the coaxial axis of the second input wheel 3D and the rotation positioning disc 4D, making the assembly more convenient and the operation more stable.

The first receiving port 6D and the second receiving port 7D are arranged at the outlet of the bend pipe 2D, and the bend pipe rotates to enable the switch between the connection of the outlet of the bend pipe with the first receiving port and the connection between the outlet pf the bend pipe with the second receiving port. One of the first receiving port and the second receiving port is used for receiving the qualified product, and the other is used for receiving the unqualified product.

One side of the second support frame 1D is provided with the positioning wheel 5D, and the rotation positioning disc 6D cooperates with the positioning wheel 5D. The positioning wheel 5D supports the rotation positioning disc 6D for positioning, which makes the structure reasonable and the rotation more stable. The bend pipe 2D on the second support frame 1D is supported and positioned only by the positioning wheel 5D and the rotation positioning disc 6D, which can be supported and positioned outside the bend pipe without using large bearings, and lower the cost.

Preferably, the rotation drive device includes the servo motor 8D, the servo motor 8D is connected to the second output wheel 9D. The servo motor is equipped with the reduction device 81D (such as the reduction gear box) connected to the second output wheel 9D. The second output wheel 9D is connected to the second input wheel 3D in a drive manner. The second output wheel and the second input wheel adopt belt wheel, sprocket, gear and so on, and the second output wheel and the second input whee are connected by belt, chain or gear meshing. In the figures, belt wheel and belt are used.

Driving by the servo motor has the advantages of having faster driving and response speeds, controllable and adjustable angle of rotation, and improved accuracy, which can meet the needs of adjustable angles of the first receiving port and the second receiving port. The connection between the outlet and the first receiving port is switched to the connection between the outlet and the second receiving port by the bend pipe rotating 180 degrees or 90 degrees.

Specifically, the second support frame 1D is provided with the support vertical plate 16D, and the support vertical plate 16D is provided with the opening hole for the bend pipe to pass through. The support plate 1D is further provided with the bottom plate 17D for the support vertical plate 16D to connect. The first receiving port 6D and the second receiving port 7D are arranged on the bottom plate 17D. The positioning wheel 5D is arranged on the front side of the support vertical plate 16D of the second support frame. The front side of the second support frame 1D is connected (can be connected by the connecting rod and the connecting plate) to the cup outlet blower 20D. The cup outlet blower 20D is the prior art, and the cup outlet blower 20D is connected to the inlet of the bend pipe 2D.

At least three positioning wheels 5D are arranged around the rotation positioning disc 4D, and the rotating positioning disc 4D is supported and positioned by the positioning wheel 5D. In the figure, four positioning wheels 5D are arranged. The positioning wheel 5D is sleeved on the eccentric shaft 51D, and the eccentric shaft 51D is arranged on the second support frame 1D. The positioning wheel 5D is arranged on the eccentric shaft 51D and cooperates with the rotating positioning disc to make the assembly more convenient. The eccentric shaft rotates to adjust the rotation center of the positioning wheel, and the positioning wheels cooperating with each other can adjust the rotation center of the positioning disc, thereby ensuring that the edge of the rotating positioning disc can match with the positioning wheel (especially when the positioning wheel has annular grooves). The eccentric shaft 51D is provided with the eccentric bolt or the eccentric screw, and the axis of the eccentric shaft is provided with the eccentric part for the installation of the positioning wheel.

Preferably, the other side of the second support frame 1D is provided with the support wheels 10D (such as the bearings), and the support wheels 10D are arranged around the bend pipe 2D, which can rotate and further support the bend pipe 2D to make the rotation more stable. In the figure, the support wheels 10D are located on the rear side of the support vertical plate 16D of the second support frame 1D.

Preferably, the support wheel 10D is connected to the support base 11D, and the support base 11D is connected to the second support frame 1D. The support base 11D is provided with the radial long hole 12D, and the radial long hole and the second support frame 1D are connected by the locking fastener (such as the locking bolt or the locking screw) to adjust the radial position of the support wheel relative to the support base, thereby leaving the support wheel to match and support the bend pipe. Further, the slide grooves are arranged on the second support frame for the corresponding support base to assembly, and the radial position of the support base is adjusted to be stable. In the figure, at least three support wheels (such as four) are arranged, and the support wheels are evenly distributed.

Preferably, the positioning wheel 5D is provided with the annular grooves (such as the V-shaped grooves, which are arranged annularly). The edge of the rotation positioning disc 4D matches the annular groove, and the edge of the rotation positioning disc 4D is embedded in the annular groove, which is more stable.

Specifically, the bend pipe 2D includes the straight pipe part 13D and the bend pipe part 14D. The second input wheel 3D and the rotation positioning disc 4D are connected to the straight pipe part 13D of the bend pipe 2D. Alternatively, referring to the figure, the mounting sleeve 15D is arranged outside of the bend pipe 2D, and is connected to the bend pipe 2D. The second input wheel 3D and the rotation positioning disc 4D are connected to the mounting sleeve 15D, and the bend pipe 2D is made of lighter materials, e.g., polypropylene (PP), polyethylene (PE), with lighter weight and faster rotation, and the mounting sleeve 15D cooperates with the support wheels 10D located around the bend pipe 2D.

The bottom crimping assembly 8 and the pre-crimping assembly 11 adopt the crimping assembly, respectively.

Figure 26:
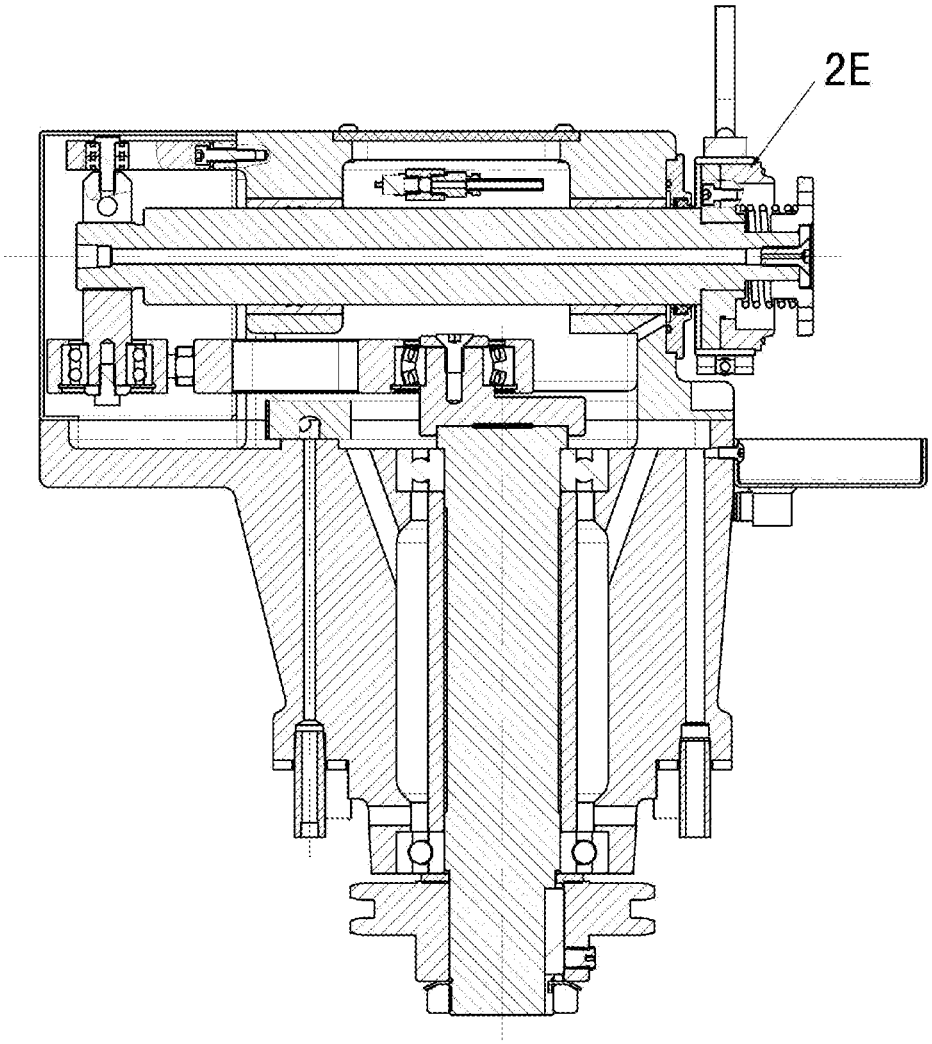
FIG. 26 is a sectional view of the structure of the crimping assembly in another embodiment.
Figure 27:
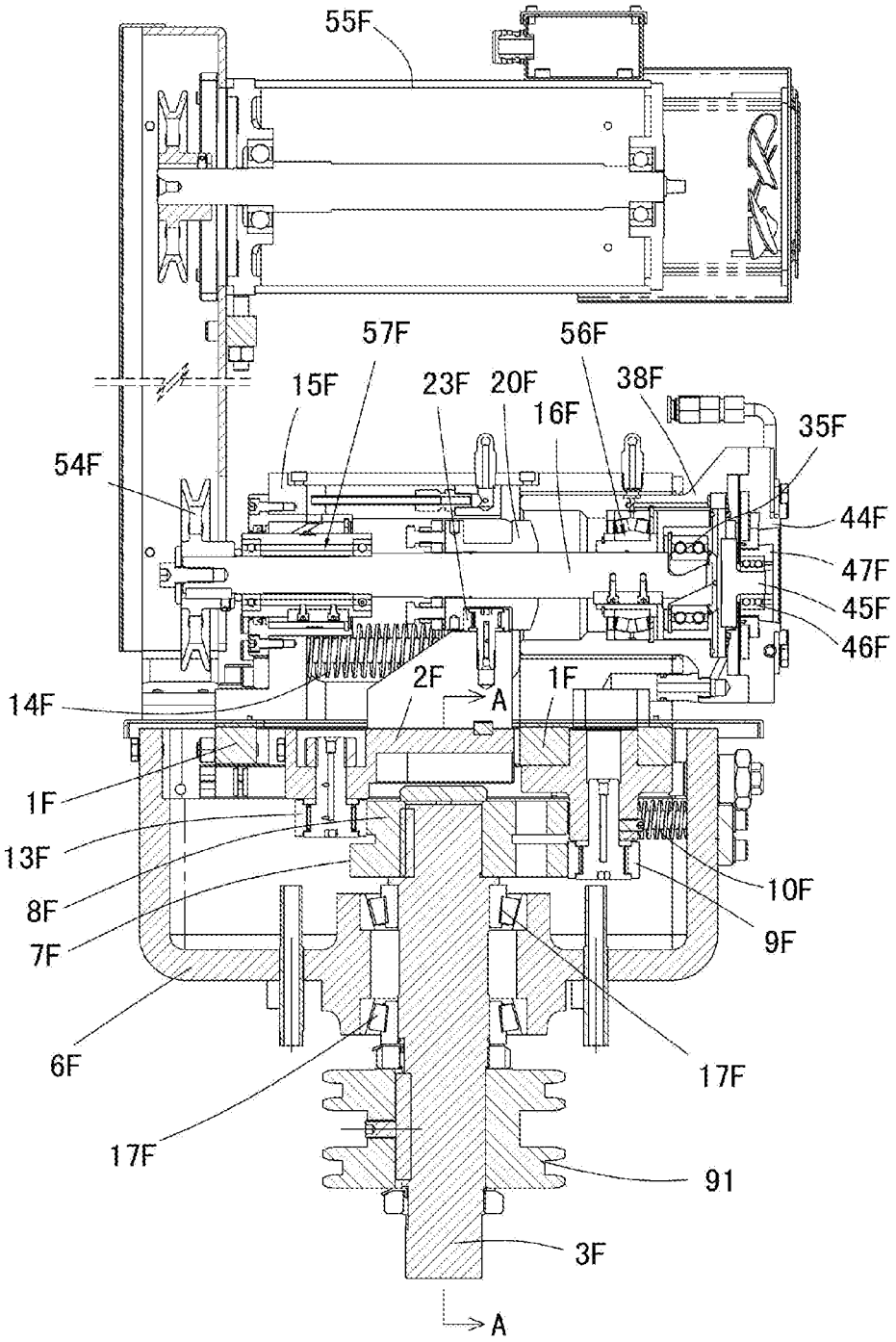
FIG. 27 is a sectional view of the rolling assembly.
Figure 28:
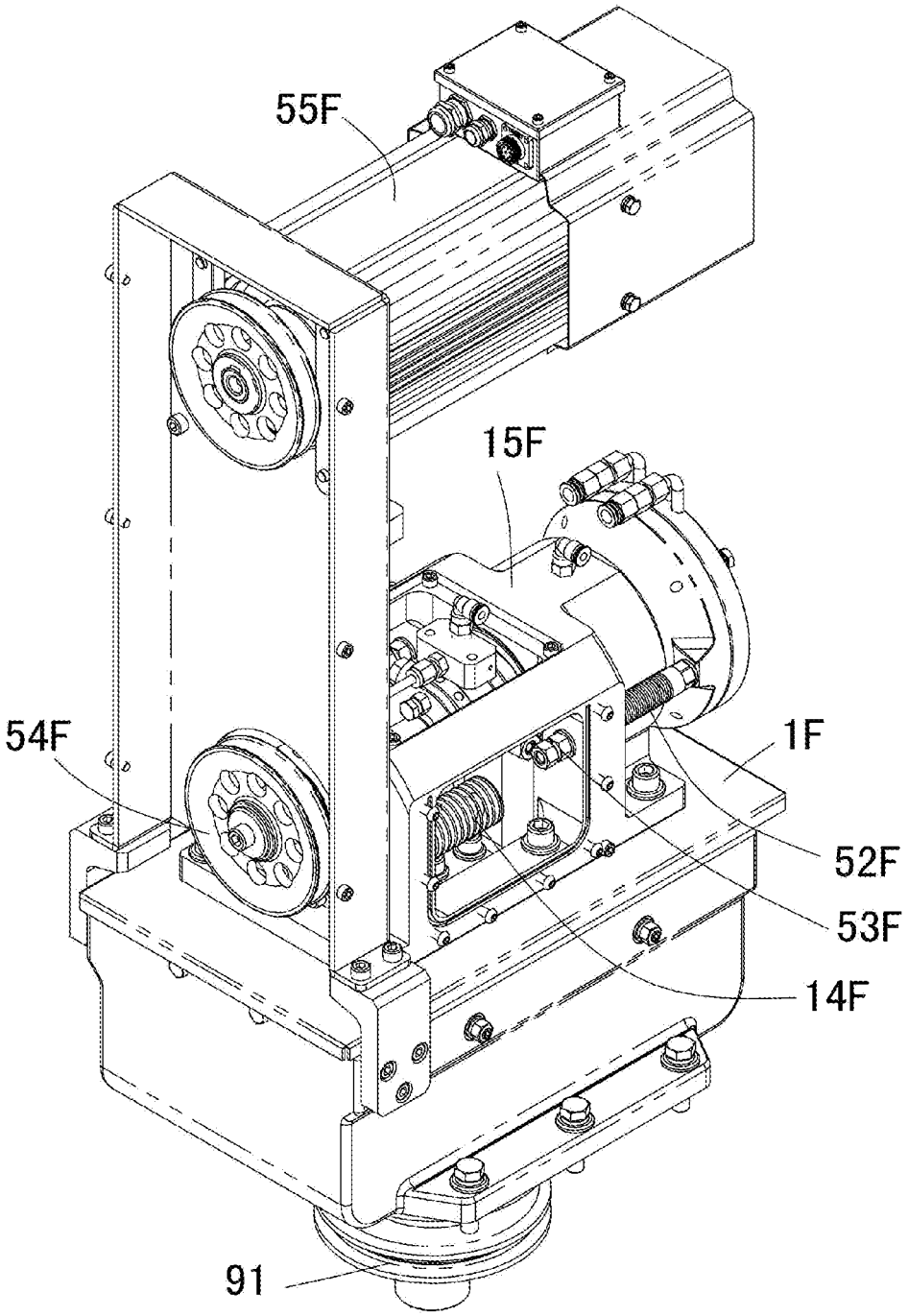
FIG. 28 is a perspective view of the rolling assembly.
Figure 29:
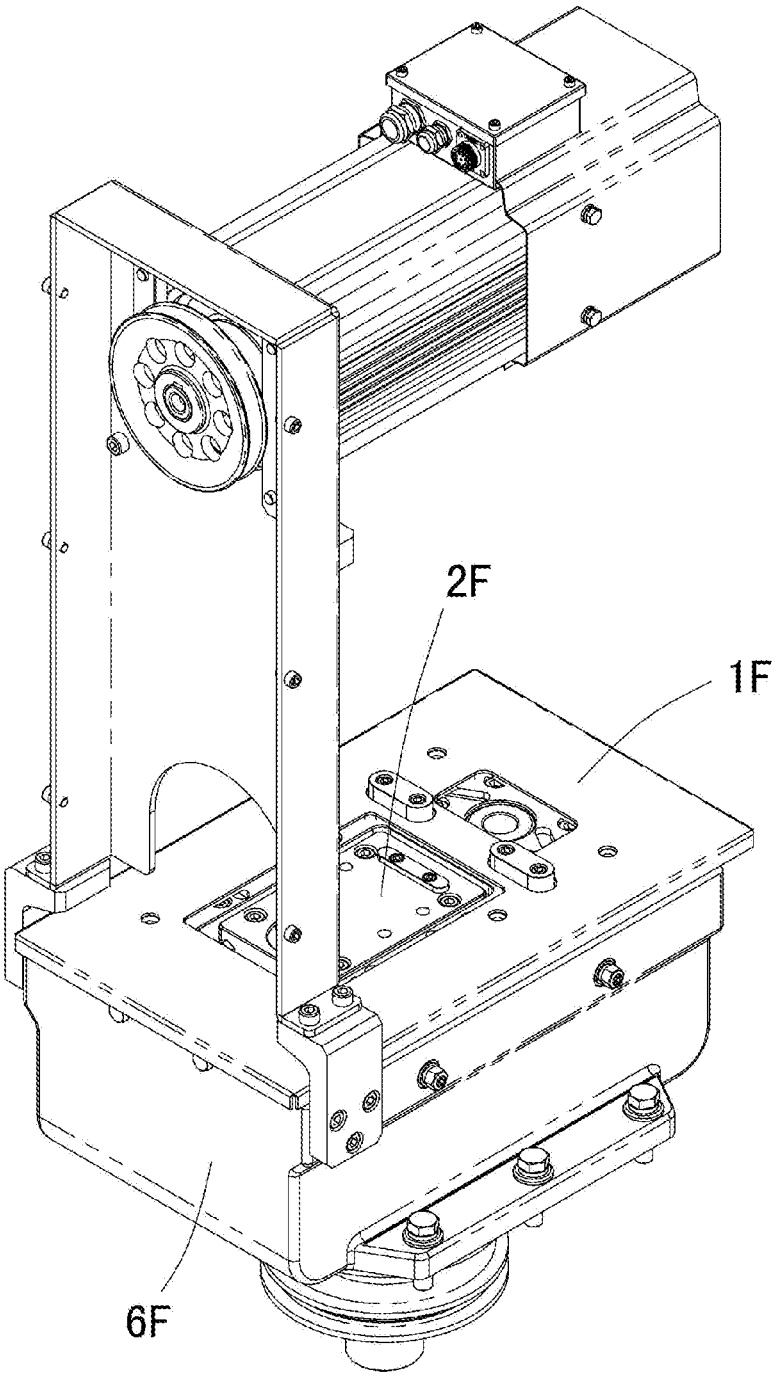
FIG. 29 is a perspective view of the rolling assembly shown in FIG. 28 with some structures hidden.
Figure 30:
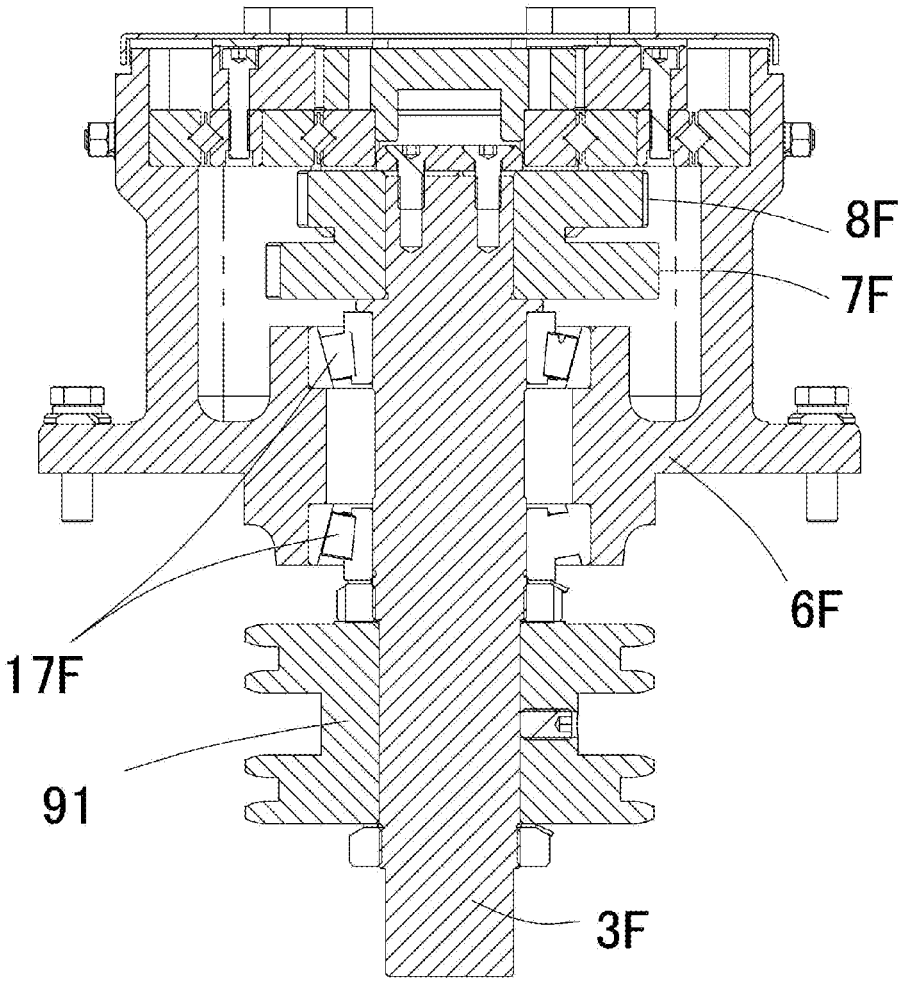
FIG. 30 is the sectional view taken along A-A in FIG. 27.
Figure 31:
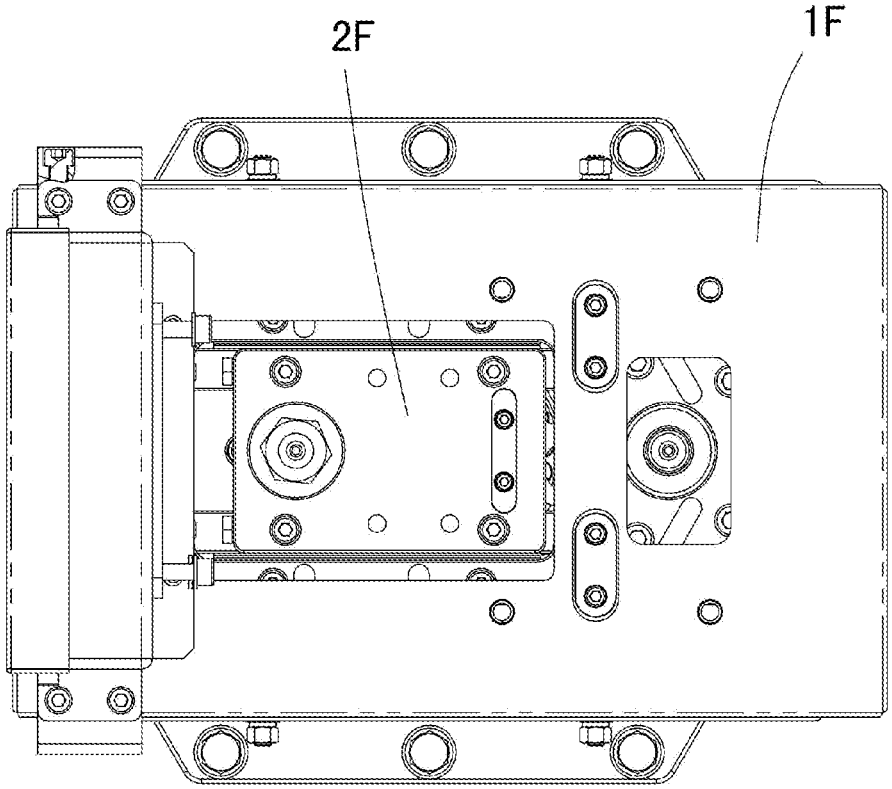
FIG. 31 is a top view of FIG. 30.
Figure 32:
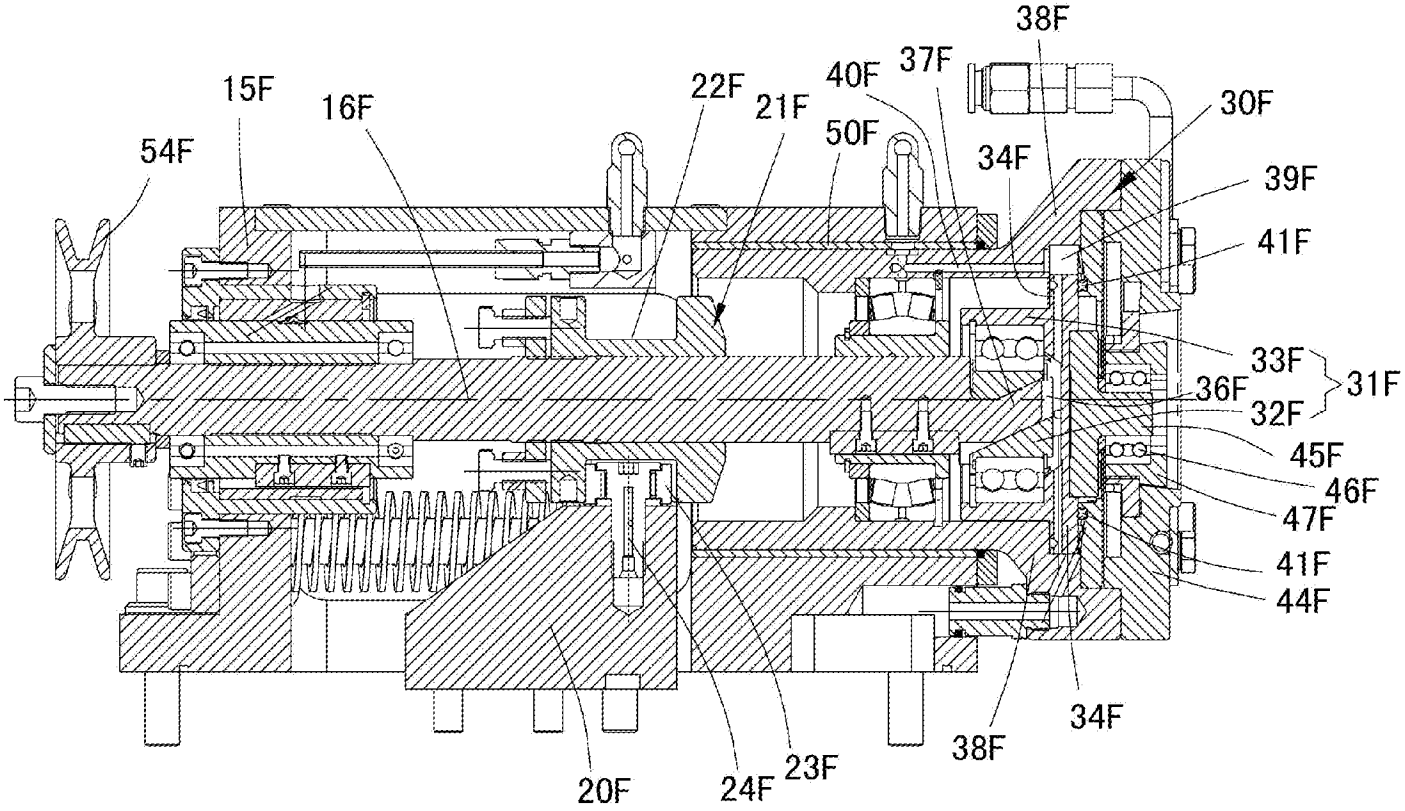
FIG. 32 is a schematic view of the local structure in FIG. 27.
Figure 33:
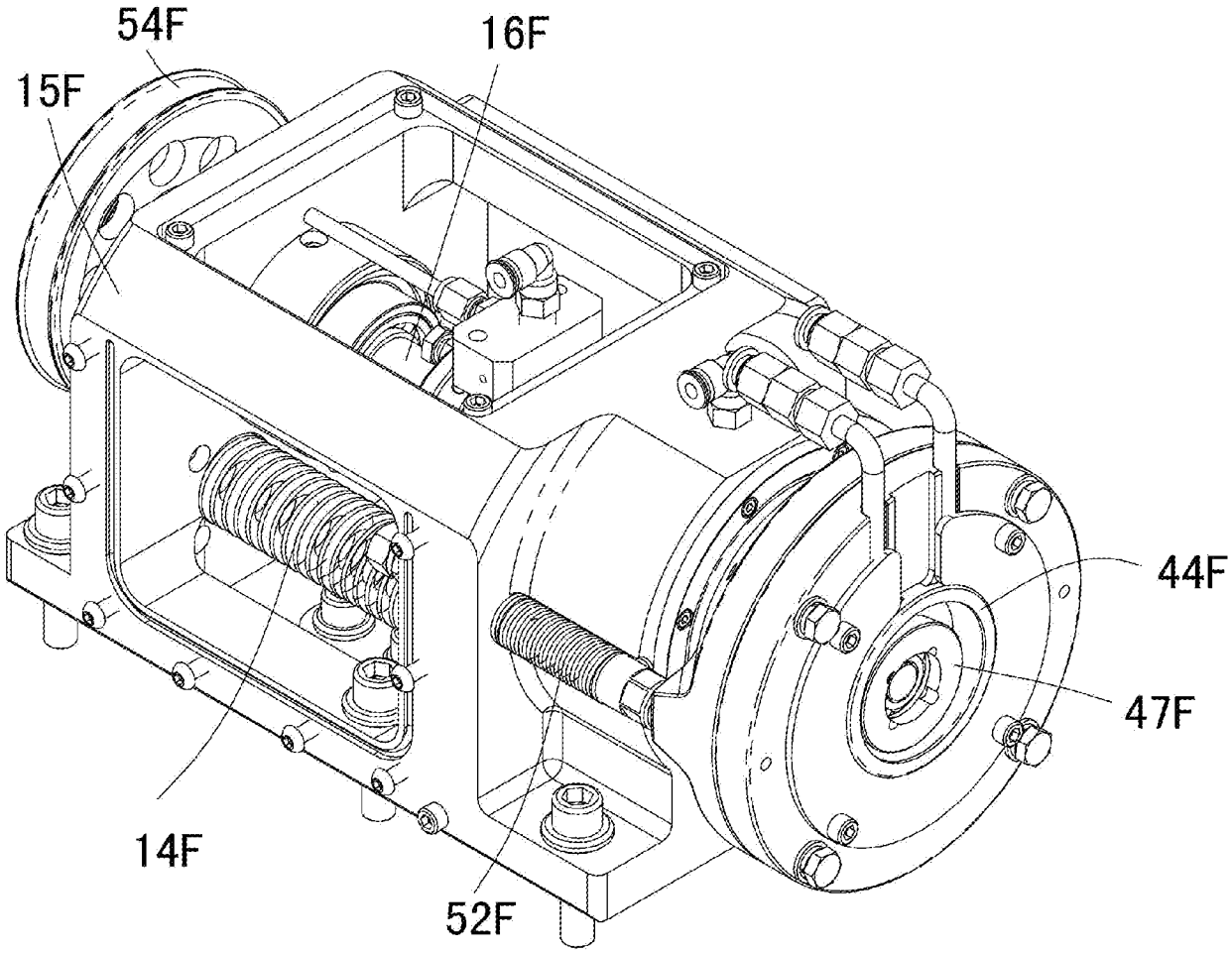
FIG. 33 is a perspective view of the local structure shown in FIG. 32.
Figure 34:
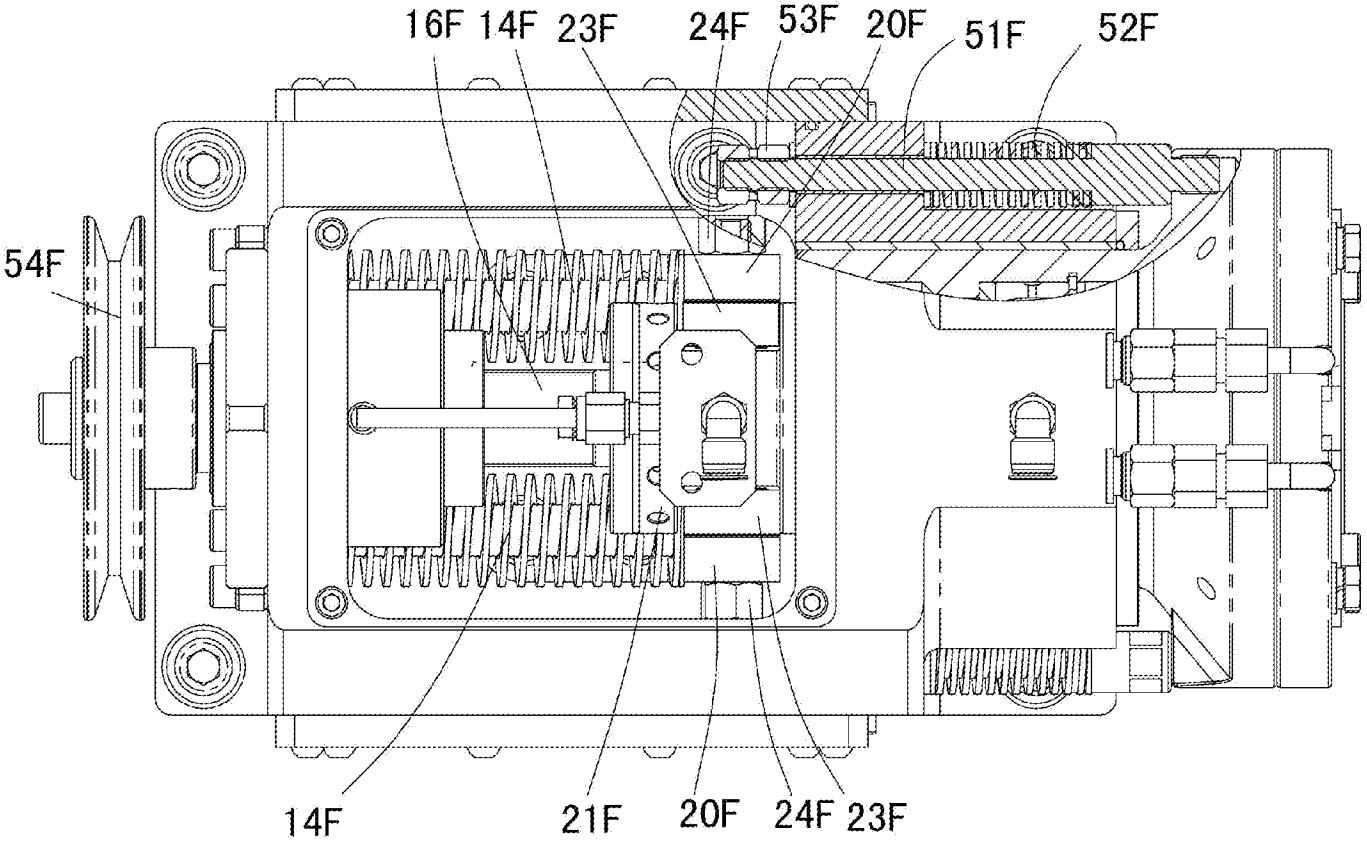
FIG. 34 is the top view of FIG. 33.
Figure 35:
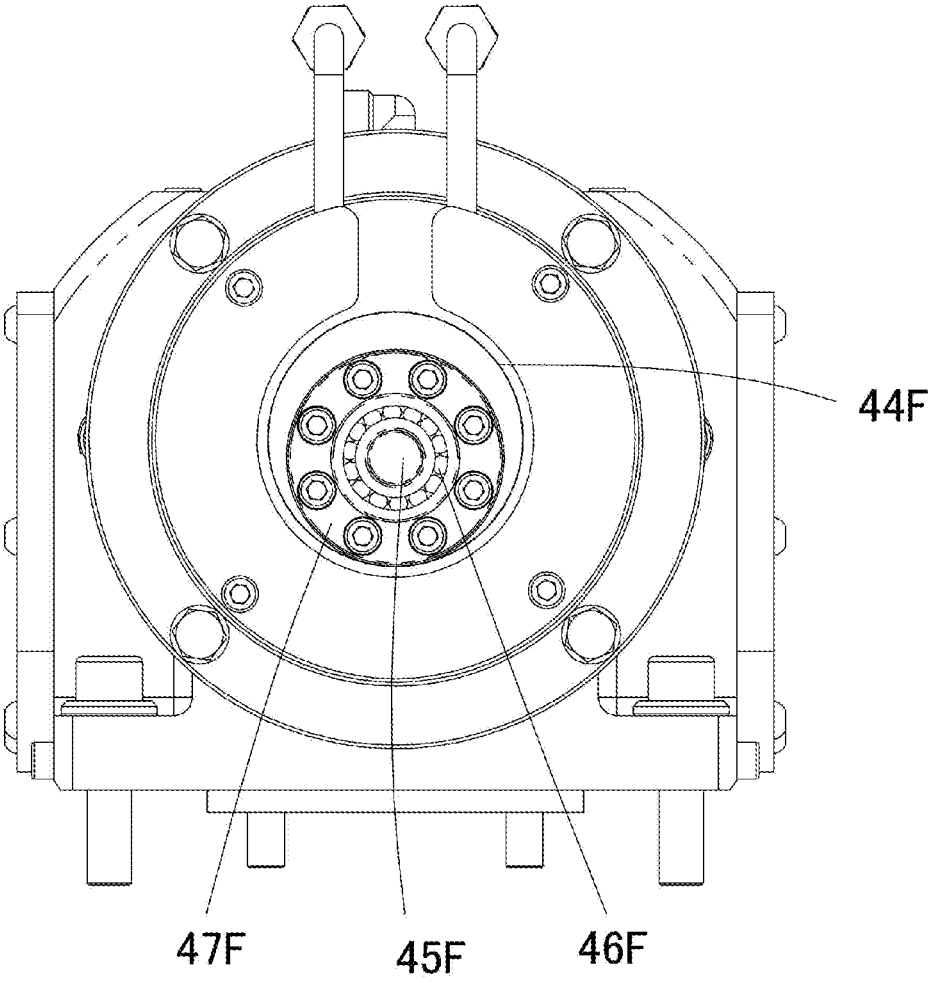
FIG. 35 is the right view of FIG. 32.

The crimping assembly includes the crimping movable shaft 1E, and the crimping movable shaft 1E is transversely arranged. The front part of the crimping movable shaft is provided with the crimping device 2 for crimping. The crimping device 2E adopts the cup rim crimping device or the cup bottom crimping device. The corresponding crimping die (cup rim crimping die or cup bottom crimping die) will be installed at the front of the crimping movable shaft. The crimping movable shaft 1E drives the crimping device 2E to move transversely synchronously back and forth, so as to crimp the bottom and the rim of the paper tube. Some crimping requires the crimping die to rotate. The crimping dies in the first final crimping assembly and the second final crimping assembly do not rotate, and if the crimping die is required to rotate, the crimping movable shaft need be connected to the crimping drive wheel 3E. The first bearing 4E is arranged between the crimping drive wheel 3E and the crimping movable shaft 1E, and the first bearing 4E supports the crimping drive wheel to rotate on the crimping movable shaft. The crimping drive wheel is connected to the drive device 5E (such as motor, drive belt and output wheel). The crimping die of the crimping device is connected to the crimping drive wheel, and the crimping drive wheel drives the crimping die to rotate. The crimping drive wheel moves transversely back and forth with the crimping movable shaft, and the crimping die rotates to cooperate with the crimping movable shaft so as to accomplish crimping. As shown in FIG. 26, the crimping die of the crimping device 2E does not need to rotate and is fixedly connected to the crimping movable shaft, and the corresponding crimping assembly can also be used as the first final crimping assembly and the second final crimping assembly.

In order to make the crimping movable shaft more stable, the crimping movable shaft 1E is transversely arranged on the base cover 6E, and the transparent panel 23E can be installed on the base cover, so as to observe the internal transmission structure and oil channel. The base cover 6E is provided with the front support base 7E and the rear support base 8E, the front support base is provided with the front mounting hole, and the rear support base is provided with the rear mounting hole. The second bearing 9E (such as the copper sleeve) is arranged between the crimping movable shaft and the front mounting hole, and between the crimping movable shaft and the rear mounting hole, respectively. The crimping movable shaft 1E is installed inside the second bearing, and the second bearing 9E supports the crimping movable shaft 1E to move transversely back and forth. The second bearing 9E forms front and rear support points (i.e., front and rear positions) to support the crimping movable shaft 1E transversely moving back and forth. The crimping movable shaft is supported on the base cover by the front and rear support points, which has good support effect and high stability. The base cover can adopt an integral structure.

The base cover 6E is connected to the base 10E, the base 10E is provided with the second rotation drive vertical shaft 11E, and the second rotation drive vertical shaft 11E is connected to the crimping movable shaft 1E in a drive manner. The second rotation drive vertical shaft 11E rotates to drive the crimping movable shaft 1E to move transversely back and forth.

The second rotation drive vertical shaft 11E is provided with the second eccentric wheel transmission mechanism, and the second eccentric wheel transmission mechanism includes the second eccentric wheel 12E connected to the second rotation drive vertical shaft. The second eccentric wheel 12E is connected to the crimping movable shaft 1E in a drive manner. The second eccentric wheel drive mechanism drives the second rotation drive vertical shaft to drive the crimping movable shaft to move transversely. Preferably, the second eccentric wheel 12E is connected to the second sleeve base 13E in a drive manner, and the sleeve hole of the second sleeve base 13E is connected to the second eccentric wheel 12E in a drive manner. The second eccentric wheel 12E rotates with the second rotation drive vertical shaft 11E to drive the second sleeve base 13E to sway. The rear end of the second sleeve base 13E is the second connection part 15E, the left and right sides of the second connection part 15E are respectively provided with the pull rod hole, and the second pull rod 16E is arranged in the pull rod hole. The second spring 17E and the second limiting part 18E are arranged on the second pull rod, and the second limiting part and the second spring are respectively arranged on the front and rear sides of the pull rod hole. The second spring cooperates with the second limiting part to keep the second pull rod stable in the corresponding pull rod hole of the second connection part. When the second sleeve base 13E is driven to sway, the second pull rod can move slightly relative to the pull rod hole. In addition, when the crimping movable shaft moves forth to cooperate with the die, the second spring 17E can act as the buffer to resist the unexpected collision. The second spring can further release elastic force to maintain working, so that the crimping die can perform crimping under the action of elastic force. The time and pressure of crimping operation can be maintained, and the forming effect is better. The second spring is pre-tightened on the second pull rod by the pre-tightening nut 19E. The rear part of the crimping movable shaft is connected to the second transmission block 20E. In the figure, the second transmission block 20E is connected on the crimping movable shaft and is locked by the fastener. The second transmission block 20E is hinged with the second coupling base 21E located under the second transmission block 20E. The left part of the second coupling base 21E is connected to the second pull rod on the left side of the second connection part, and the right part of the second coupling base 21E is connected to the second pull rod on the right side of the second connection part. The second pull rod in the left pull rod hole of the second connection part is connected to the left part of the second coupling base, and the second pull rod in the right pull rod hole of the second connection part is connected to the right part of the second coupling base. When the second eccentric wheel 12E drives the second sleeve base to sway, the second pull rod 16E drives the second coupling base to swing and move back and forth, the second coupling base 21E drives the second transmission block 20E to move back and forth, and the crimping movable shaft connected to the second transmission block will also move transversely back and forth. The second eccentric wheel transmission mechanism has reasonable structure and stable operation, and can meet the need of high-speed operation. The second eccentric wheel is integrated with or separated from the second rotation drive vertical shaft. Preferably, the separation structure is adopted, that is, the second eccentric wheel 12E is mounted on the second rotation drive vertical shaft 11E, the second eccentric wheel and the second rotation drive vertical shaft are connected by the fastener. Compared with the integral structure, the separation structure is more compartmentalized and occupies less space. The second eccentric wheel 12E adopts the disc eccentric wheel and uses the external profile to drive. Preferably, the second eccentric wheel adopts the eccentric wheel with the eccentric column 22E, and the third bearing 24E (for rotating support) is arranged between the eccentric column of the second eccentric wheel and the sleeve hole of the sleeve base, leaving the transmission smooth and stable.

The second coupling base 21E is provided with the hinge hole, and the fourth bearing 25E (such as the double-row angular contact ball bearing) is arranged between the second transmission block 20E and the hinge hole to make the transmission between the second coupling base and the second transmission block smooth and stable. The swing gap is left between the pull rod hole and the second pull rod, that is, the pull rod can swing in the pull rod hole. The second coupling base 23B is provided with the through holes to connect to the second pull rod, and both sides of the through hole are respectively provided with the locking nuts 26E on the second pull rod. The position of the second pull rod relative to the second coupling base can be changed by adjusting the position of the locking nuts 26E, so as to adjust the starting position of the crimping movable shaft.

Preferably, the second transmission block 20E is connected to the guide wheel 27E, the guide wheel 27E is arranged in the guide groove 28E, the guide groove 28E is arranged on the guide base 29E, and the guide base is connected to the base cover 6E. The structural layout is reasonable and compact, and the guide wheel corresponds to the second coupling base 21E arranged under the second transmission block, which is more balanced.

The rear side of the base cover is provided with the rear cover 30E, the front side of the base cover is provided with the front sealing cover 31E, the front sealing cover 31E is provided with the movable through hole, and the crimping movable shaft is located in the movable through hole. The rear cover cooperates with the front sealing cover to cover the internal structure of the crimping assembly, so as to prevent lubrication oil from splashing or leaking. The sealing ring is arranged in the movable through hole of the front sealing cover, and the sealing ring is located between the front sealing cover and the crimping movable shaft, and the crimping movable shaft is sealed when moving in the movable through hole. The sealing element is also arranged between the rear cover and the base cover to ensure the seal.

The fifth bearing 32E is arranged between the second rotation drive vertical shaft 11E and the base 10E, and the fifth bearing supports the second rotation drive vertical shaft to rotate on the base. The lower part of the second rotation drive vertical shaft is connected to the sprocket as the bottom crimping drive wheel device 81 or the pre-crimping drive wheel device 111, which inputs power into the second rotation drive vertical shaft to drive the second rotation drive vertical shaft to rotate.

The crimping drive wheel is arranged such that the front part of the crimping movable shaft is provided with the step for the first bearing 4E to install, and the step is equipped with the retaining ring for limiting axially the first bearing. The crimping drive wheel cooperates with the cup rim crimping die or cup bottom crimping die to clamp the first bearing providing an easy install and efficient combination.

Referring to the figure, the rolling assembly 9 includes the rolling mechanism, and the rolling mechanism includes the support housing 15F. The support housing 15F is provided with the rolling shaft 16F, and the rolling shaft 16F rotates and is arranged axially. The rolling sleeve base device 30F is arranged in front of the support housing 15F. The rolling sleeve base device 30F includes the rolling sleeve base 38F and the profiling die 44F, and the profiling die 44F is connected to the front end of the rolling sleeve base 38F. The front end of the rolling shaft is provided with the wedge part 37F. The front end of the rolling shaft is connected to the movable block device 31F. The movable block device 31F includes the inner movable block 32F and the outer movable block 33F. The inner movable block 32F is provided with the wedge hole 36F to cooperate with the wedge part. When the rolling shaft 16F moves axially, the wedge part cooperates with the wedge hole to make the inner movable block eccentrically move (move toward one side). When the rolling shaft rotates, the wedge part cooperates with the wedge hole to make the inner movable block rotate. When the rolling shaft 16F rotates and moves axially, the inner movable block rotates and moves eccentrically. The sixth bearing 35F is connected between the inner movable block and the outer movable block. The eccentric movement of the inner movable block can cause the eccentric movement of the outer movable block. The sixth bearing 35F makes the inner movable block rotate inside the outer movable block, and the outer movable block revolves. The outer movable block 33F is located in the rolling sleeve base 38F. The outer movable block 33F is provided with the support shaft 45F, and the support shaft 45F moves with the outer movable block (eccentrically moves and revolves). The support shaft is provided with the seventh bearing 46F, and the seventh bearing 46F is provided with the rolling wheel 47F. The seventh bearing 46F supports the rolling wheel 47F to roll on the support shaft. The rolling wheel 47F is located in the inner hole of the profiling die 44F. The rolling wheel 47F eccentrically moves with the support shaft of the outer movable block and revolves. The rolling wheel cooperates with the inner hole of the profiling die to accomplish rolling. The rotation and axial movement of the rolling shaft can cause the rotation and eccentric movement of the inner movable block by the cooperation between the wedge part and the wedge hole, thereby making the outer movable block eccentrically move and revolve in the rolling sleeve base, and finally making the rolling wheel eccentrically move with the support shaft of the outer movable block and revolve. The rolling wheel cooperates with the inner hole of the profiling die to accomplish rolling. By setting the movable block device, the seventh bearing can adopt the small bearing, which makes the structure compact; while the sixth bearing in the movable block device adopts the large bearing to increase the service life of the sixth bearing. The sixth bearing and the seventh bearing are subjected to one-way force respectively, rather than positive and negative two-way forces.

The rolling sleeve base 38F is located in the front support hole of the support housing 15F, and the eighth bearing 50F is arranged between the front support hole and the rolling sleeve base. The eighth bearing 50F (such as copper sleeve) supports the rolling sleeve base 38F to slide axially in the front support hole, so as to provide support for front and rear adjustment and axial buffering. The rolling sleeve base is connected to the guide rod 51F. The support housing 15F is provided with the guide sleeve or the guide hole to connect to the guide rod. The guide rod cooperates with the guide sleeve or the guide hole to make the rolling sleeve base slide axially stably, thereby avoiding rotating. Preferably, the guide rod 51F is equipped with the tension return spring 52F, and the tension return spring is located between the rolling sleeve base and the support housing. The rolling sleeve base is axially buffered on the support housing by the tension return spring. The end of the guide rod is also equipped with the locking nut 53F, and the end of the guide rod is limited by the locking nut on the side of the guide sleeve or the guide hole. The front and rear axial position of the rolling sleeve base on the support housing can be changed by adjusting the position of the locking nut on the guide rod to meet the needs of different specifications.

The outer movable block 33F is provided with the disc part 34F, and the rolling sleeve base 38F is provided with the annular groove 39F. The circumferential edge of the disc part is surrounded by the annular groove 39F, and the circumferential edge of the disc part is matched in the annular groove, so as to prevent the disc part 34F from breaking away from the annular groove 39F to form the leakage point. The annular groove slidably cooperates with the disc part, that is, the circumferential edge of the disc part is always located in the annular groove and slidably cooperates with annular groove, which makes the operation more stable.

The rolling shaft 16F is connected to the rotation drive wheel 54F, and the rotation drive wheel 54F is located outside the support housing 15F. The rotation drive wheel 54F is driven by the motor 55F through the belt to rotate, so as to drive the rolling shaft to rotate. Specifically, the support housing 15F is arranged on the first moving plate 1F, and the rolling shaft 16F is connected to the second moving plate 2F in a drive manner. The first moving plate 1F is connected on the first transverse track, and the first transverse track guides the first moving plate to move. The second moving plate 2F is connected on the second transverse track, and the second transverse track guides the second moving plate to move. The third rotation drive vertical shaft 3F is arranged on the base 6F, and the third rotation drive vertical shaft 3F is connected to the ahead cam 7F and the astern cam 8F in a drive manner. The third rotation drive vertical shaft is in the upright state. The third rotation drive vertical shaft 3F rotates to drive the ahead cam 7F and the astern cam 8F thereon to rotate. For example, both the first transverse track and the second transverse track adopt line rails (such as V-shaped), and the corresponding moving plates are equipped with wheels to move on the line rails.

The first moving plate 1F is provided with the second front roller 9F, the second front roller 9F is located on the front side of the ahead cam 7F, and the ahead cam 7F cooperates with the second front roller 9F (that is, the ahead cam 7F presses on the second front roller 9F to drive the second front roller 9F). The first moving plate 1F further cooperates with the first spring device 10F, and the first spring device 10F is connected between the first moving plate 1F and the base 6F. The second moving plate 2F is provided with the second rear roller 13F, the second rear roller 13F is located on the back side of the astern cam 8F, the astern cam 8F cooperates with the second rear roller 13F (that is, the astern cam 8F presses on the second rear roller 13F to drive the second rear roller 13F). The second moving plate further cooperates with the second spring device 14F, and the second spring device 14F is connected between the second moving plate and the first moving plate. When the ahead cam drives the second front roller to move forth (move right in the figure), the working curve of the ahead cam gradually protrudes, and the second front roller moves forth synchronously with the first moving plate. The first spring device can perform cushion and accumulate elastic force (for example, if the first spring device adopts the compression spring, the first spring device is compressed). After the first moving plate moves in place, the working curve of the ahead cam maintains the position of the second front roller. When the first moving plate moves forth, the second spring device deforms to drive the second moving plate to move forth (for example, if the second spring device adopts the compression spring, the second spring device is compressed). The working curve of the astern cam shrinks and gives way for the second rear roller and the second moving plate to move forth. Until the first moving plate moves in place, the second spring device continues to release the elastic force to drive the second moving plate to move forth until the second moving plate moves in place (which can be used for prolonging the work time of the rolling and cushioning), and then the working curve of the astern cam protrudes to drive the second rear roller to move back (move left in the figure). The second moving plate moves back synchronously with the second rear roller, and then the working curve of the forward cam gives way for the second front roller to move back. If the second moving plate moves back synchronously with the second rear roller, the second spring device can drive the first moving plate to move back, and the first spring device will also drive the first moving plate to move back until in place.

The ahead cam and the astern cam on the third rotation drive vertical shaft 3F cooperate with the first spring device and the second spring device to drive the first moving plate and the second moving plate to move forward and backward, so that the transmission structure is more reasonable and compact, and the operation stability is high, which can meet the needs of further speed increase. The first moving plate is used for installing the supporting housing of the rolling assembly, and the supporting housing is used for installing the rolling sleeve base device. The rolling shaft is rotated on the supporting housing and is arranged axially. The second moving plate is used for connecting the rolling shaft to drive the rolling shaft to move forward and backward. The second spring device can prolong the work time of the rolling and cushioning, and avoid overload collision damage.

The first spring device 10F includes the first spring or the first air cylinder or the first hydraulic cylinder. The second spring device 14F includes the second spring or the second air cylinder or the second hydraulic cylinder. In the figure, the first spring device adopts the first spring (such as the compression spring), and the second spring device adopts the second spring (such as the compression spring), and the corresponding spring mounting bases are arranged for mounting the springs.

The first transverse track is arranged on the base 6F of the rolling assembly, the second transverse track is arranged on the first moving plate 1F, the first moving plate is provided with the notch part, and the second moving plate 2F is arranged at the notch part; the layout is reasonable and the structure is more compact.

Preferably, the ahead cam and the astern cam are two cams of the conjugate cam, and the conjugate cam cooperates with the second front roller and the second rear roller, which is more stable, meets the high-speed demand and has the longer service life.

The bearing 17F is arranged between the third rotation drive vertical shaft 3F and the base 6F, and the third rotation drive vertical shaft 3F is supported by the bearing 17F to rotate vertically on the base. The lower part of the third rotation drive vertical shaft is connected to the rolling drive wheel device 91. The rolling drive wheel device 91 is located under the lower end port of the base and inputs power into the third rotation drive vertical shaft to drive the third rotation drive vertical shaft to rotate. The ahead cam and the astern cam are arranged under the first moving plate and the second moving plate.

The rolling shaft 16F is connected to the drive sleeve 21F in a drive manner, and the drive sleeve 21F is provided with the annular groove 22F arranged circumferentially. When the rolling shaft 16F is driven to rotate, the drive sleeve 21F and the annular groove 22F will rotate synchronously. The second moving plate is provided with the transmission base 20F, and the second spring device is connected to the transmission base in a drive manner. At least three wheels 23F are arranged on the transmission base 20F, and the wheels 23F are arranged in the annular groove 22F, and the three wheels form right triangle or acute triangle to each other. The wheels 23F roll on the transmission base 20F, and the transmission base 20F is provided with the rolling shaft 24F for installing the wheels 23F, and the wheels 23F is arranged in the annular groove 22F. When the transmission base 20F is driven forward and backward (the transmission base is driven forward and backward by the second moving plate), the wheels cooperate with the annual groove of the drive sleeve to drive the rolling shaft forward and backward (axial movement), and the rolling shaft can rotate. The three wheels form right triangle or acute triangle to each other, so that the rolling shaft is surrounded by at least three wheels, which results in increased stability and decreases vibration.

The front rotation and axial sliding support device 56F is arranged between the rolling shaft 16F and the rolling sleeve base 38F to support the rotation and axial sliding of the rolling shaft, and the rear rotation and axial sliding support device 57F is arranged between the rolling shaft and the rear support hole of the support housing to support the rotation and axial sliding of the rolling shaft. Specifically, the front rotation and axial sliding support device includes the ninth bearing and the first guide sleeve (such as the copper sleeve). The rolling shaft is located in the first guide sleeve, and the ninth bearing is arranged between the first guide sleeve and the rolling sleeve base. The rolling shaft is supported to move axially in the first guide sleeve, and the first guide sleeve is supported by the ninth bearing to rotate on the rolling sleeve base. The axial sliding key is arranged between the first guide sleeve and the rolling shaft. The rolling shaft and the first guide sleeve can not only slide axially relative to each other, but also maintain rotating synchronously, which results in increased stability. The rear rotation and axial sliding support device includes the installation sleeve, the support slide sleeve, the tenth bearing and the second guide sleeve (such as the copper sleeve). The installation sleeve is connected to the rear support hole, and the second guide sleeve is located between the installation sleeve and the support slide sleeve. The tenth bearing is arranged between the support slide sleeve and the rolling shaft, and the tenth bearing supports the rolling shaft to rotate on the support slide sleeve, and the second guide sleeve supports the support slide sleeve to slide axially, which facilitates setting lubrication oil channel. The spacer sleeve is arranged in the support slide sleeve to facilitate the installation of the tenth bearing on both sides. The sealing ring is arranged between the installation sleeve and the support slide sleeve, and the sealing ring is arranged in the assembly groove of the installation sleeve.

The rolling sleeve base 38F is provided with the entry channel 40F, and the entry channel communicates with the annular groove. The front side of the annular groove is provided with the sealing ring installation groove, and the sealing ring installation groove is provided with the sealing ring 41F. The front side or the rear side of the annular groove is provided with the groove ring.

What is claimed is:

1. A horizontal high-speed paper cup/paper bowl forming machine, comprising a four-station turntable paper feeding mechanism, a seven-station main rotation tower forming mechanism and a seven-station auxiliary rotation tower forming mechanism, wherein, the seven-station main rotation tower forming mechanism comprises a stamping die station, a paper feeding connection station, a first cup bottom preheating station, a second cup bottom preheating station, a bottom crimping station, a rolling station, and a main and auxiliary tower connection station; the stamping die station, the paper feeding connection station, the first cup bottom preheating station, the second cup bottom preheating station, the bottom crimping station, the rolling station, and the main and auxiliary tower connection station are arranged sequentially along a circumferential direction of the seven-station main rotation tower forming mechanism;

the seven-station auxiliary rotation tower forming mechanism comprises the main and auxiliary tower connection station, a cup rim lubrication station, a pre-crimping station, a first final crimping station, a second final crimping station, a cup outlet station, and a reserved vacant station; the main and auxiliary tower connection station, the cup rim lubrication station, the pre-crimping station, the first final crimping station, the second final crimping station, the cup outlet station, and the reserved vacant station are arranged sequentially along a circumferential direction of the seven-station auxiliary rotation tower forming mechanism;

the stations arranged in sequence along the circumferential direction of the seven-station main rotation tower forming mechanism is an opposite order to the stations arranged in sequence along the circumferential direction of the seven-station auxiliary rotation tower forming mechanism; the seven-station main rotation tower forming mechanism shares the main and auxiliary tower connection station with the seven-station auxiliary rotation tower forming mechanism;

the four-station turntable paper feeding mechanism is connected to the paper feeding connection station; the four-station turntable paper feeding mechanism comprises a turntable; the turntable is connected to a rotation transmission device in a drive manner; a plurality of gripper devices are arranged on the turntable by indexing; an opening is arranged at a rotation center of the turntable, and a gripper opening lifting shaft is arranged at the opening; the gripper opening lifting shaft is connected to a gripper opening plate, and the gripper opening plate is arranged above the turntable; each gripper device of the plurality of gripper devices comprises a paper gripper, and the paper gripper is hinged on a first mounting base; the first mounting base is connected on the turntable; a paper supporting part on the turntable is arranged under the paper gripper; the paper gripper is further equipped with a gripper reset device; the gripper opening plate cooperates with the paper gripper; the rotation transmission device comprises a servo motor.

2. The horizontal high-speed paper cup/paper bowl forming machine of claim 1, wherein, a stamping die assembly is arranged at the stamping die station; a cup clamp mechanism is further arranged at the paper feeding connection station; a first cup bottom preheating assembly is arranged at the first cup bottom preheating station; a second cup bottom preheating assembly is arranged at the second cup bottom preheating station; a bottom crimping assembly is arranged at the bottom crimping station; a rolling assembly is arranged at the rolling station; a cup rim lubrication assembly is arranged at the cup rim lubrication station; a pre-crimping assembly is arranged at the pre-crimping station; a first final crimping assembly is arranged at the first final crimping station; a second final crimping assembly is arranged at the second final crimping station; a cup outlet assembly is arranged at the cup outlet station.

3. The horizontal high-speed paper cup/paper bowl forming machine of claim 2, wherein, the stamping die assembly comprises a bottom forming device; the bottom forming device comprises a stamping transmission hollow shaft and a forming transmission shaft, and the stamping transmission hollow shaft and the forming transmission shaft are transversely arranged; a first guide sleeve is respectively provided on an outer side of a front portion of the stamping transmission hollow shaft and an outer side of a rear portion of the stamping transmission hollow shaft; the forming transmission shaft is located inside the stamping transmission hollow shaft; a second guide sleeve is respectively provided on an outer side of a front portion of the forming transmission shaft and an outer side of a rear portion of the forming transmission shaft, and the second guide sleeve is located between the stamping transmission hollow shaft and the forming transmission shaft; a first rotation drive vertical shaft is arranged under the stamping transmission hollow shaft, and the first rotation drive vertical shaft is respectively connected to the stamping transmission hollow shaft and the forming transmission shaft in a drive manner;

a front end of the forming transmission shaft is connected to a forming male die, and a front end of the stamping transmission hollow shaft is connected to a stamping male knife; a fixing frame is arranged in front of the stamping male knife, and the fixing frame is provided with a stamping female knife; the fixing frame is further provided with a molding female die; the stamping female knife is integrated with or separated from the molding female die;

the first rotation drive vertical shaft is provided with a cam transmission mechanism and a first eccentric wheel transmission mechanism; the stamping transmission hollow shaft is provided with a lower hollow; the cam transmission mechanism is located at the lower hollow, and the cam transmission mechanism is connected to the forming transmission shaft in a drive manner; the first eccentric wheel transmission mechanism is connected to the stamping transmission hollow shaft in a drive manner; the cam transmission mechanism comprises a cam connected to the first rotation drive vertical shaft; the first eccentric wheel transmission mechanism comprises a first eccentric wheel connected to the first rotation drive vertical shaft; the cam is located above the first eccentric wheel.

4. The horizontal high-speed paper cup/paper bowl forming machine of claim 3, wherein, the cam adopts a conjugate cam; the forming transmission shaft is provided with a first front roller and a first rear roller; the first front roller is located on a front side of the conjugate cam, the first rear roller is located on a rear side of the conjugate cam, and the first front roller and the first rear roller are correspondingly connected to the conjugate cam in a drive manner, respectively; the stamping transmission hollow shaft is provided with the lower hollow; the first front roller, the first rear roller and the conjugate cam are located at the lower hollow;

the first eccentric wheel is connected to a first sleeve base in a drive manner, and a sleeve hole of the first sleeve base is sleeved on the first eccentric wheel in a drive manner; a rear end of the first sleeve base is a first connection part, a left side of the first connection part and a right side of the first connection part are respectively provided with a first pull rod hole, and a first pull rod is arranged in the first pull rod hole; a first spring and a first limiting part are arranged on the first pull rod, the first limiting part is arranged on a front side of the first pull rod hole, and the first spring is arranged on a rear side of the first pull rod hole; the rear portion of the stamping transmission hollow shaft is connected to a first transmission block, and the first transmission block is hinged with a first coupling base located under the first transmission block; a left part of the first coupling base is connected to the first pull rod on the left side of the first connection part, and a right part of the first coupling base is connected to the first pull rod on the right side of the first connection part.

5. The horizontal high-speed paper cup/paper bowl forming machine of claim 2, wherein, the cup clamp mechanism comprises a mounting shaft arranged on a first support frame; the mounting shaft is connected to a first flip cup clamp and a second flip cup clamp, the first flip cup clamp is connected to a first connecting rod in a drive manner and the second flip cup clamp is connected to a second connecting rod in a drive manner; the first support frame comprises a diaphragm plate; the diaphragm plate is provided with a movable hole; a sliding sleeve is arranged in the movable hole; a first joint bearing is arranged in the sliding sleeve; an upper part of the diaphragm plate is connected to an upper cover located above the diaphragm plate, and a lower part of the diaphragm plate is connected to a lower bracket located under the diaphragm plate; the sliding sleeve in the movable hole slidably cooperates with the upper cover and the lower bracket; the upper cover is provided with an upper movable channel for the first connecting rod and the second connecting rod to pass through, and the lower bracket is provided with a lower movable channel for the first connecting rod and the second connecting rod to pass through; a guide sleeve is arranged in an inner hole of the first joint bearing, and the first connecting rod and the second connecting rod are arranged in the guide sleeve;

a paper pressing strip is arranged between the first flip cup clamp and the second flip cup clamp, and the paper pressing strip is located above the mounting shaft; the paper pressing strip is connected to a lifting shaft in a drive manner, and the lifting shaft is provided with a falling transmission part; the falling transmission part cooperates with the first flip cup clamp and the second flip cup clamp; the lifting shaft is further connected to a rising reset device.

6. The horizontal high-speed paper cup/paper bowl forming machine of claim 2, wherein, the cup outlet assembly comprises a cup outlet mechanism, and the cup outlet mechanism comprises a second support frame; the second support frame is provided with a bend pipe, and the bend pipe is connected to a second input wheel and a rotation positioning disc; an inlet of the bend pipe is coaxially arranged with the second input wheel and the rotation positioning disc; the second input wheel is connected to the rotation transmission device; one side of the second support frame is provided with a positioning wheel, and the rotation positioning disc cooperates with the positioning wheel; a first receiving port and a second receiving port are arranged at an outlet of the bend pipe.

7. The horizontal high-speed paper cup/paper bowl forming machine of claim 2, wherein, the bottom crimping assembly is a first crimping assembly and the pre-crimping assembly is a second crimping assembly; each of the first crimping assembly and the second crimping assembly comprises a crimping movable shaft arranged transversely; a front part of the crimping movable shaft is provided with a crimping device; the crimping movable shaft is arranged on a base cover; the base cover is provided with a front support base and a rear support base, the front support base is provided with a front mounting hole, and the rear support base is provided with a rear mounting hole; a second bearing is arranged between the crimping movable shaft and the front mounting hole, and between the crimping movable shaft and the rear mounting hole, respectively; the base cover is connected to a base, the base is provided with a second rotation drive vertical shaft, and the second rotation drive vertical shaft is connected to the crimping movable shaft in a drive manner;

the second rotation drive vertical shaft is provided with a second eccentric wheel transmission mechanism, and the second eccentric wheel transmission mechanism comprises a second eccentric wheel connected to the second rotation drive vertical shaft; the second eccentric wheel is connected to the crimping movable shaft in a drive manner; the second eccentric wheel is connected to a second sleeve base in a drive manner, and a sleeve hole of the second sleeve base is connected to the second eccentric wheel; a rear end of the second sleeve base is a second connection part, a left side of the second connection part and a right side of the second connection part are respectively provided with a second pull rod hole, and a second pull rod is arranged in the second pull rod hole; a second spring and a second limiting part are arranged on the second pull rod, the second limiting part is arranged on a front side of the second pull rod hole and the second spring is arranged on a rear side of the second pull rod hole; a rear part of the crimping movable shaft is connected to a second transmission block; the second transmission block is hinged with a second coupling base located under the second transmission block; a left part of the second coupling base is connected to the second pull rod on the left side of the second connection part, and a right part of the second coupling base is connected to the second pull rod on the right side of the second connection part.

8. The horizontal high-speed paper cup/paper bowl forming machine of claim 2, wherein, the rolling assembly comprises a rolling mechanism, and the rolling mechanism comprises a support housing; the support housing is provided with a rolling shaft, and the rolling shaft rotates and is arranged axially; a rolling sleeve base device is arranged in front of the support housing; the rolling sleeve base device comprises a rolling sleeve base and a profiling die, and the profiling die is connected to a front end of the rolling sleeve base; a front end of the rolling shaft is provided with a wedge part; the front end of the rolling shaft is connected to a movable block device; the movable block device comprises an inner movable block and an outer movable block; the inner movable block is provided with a wedge hole to cooperate with the wedge part; a sixth bearing is connected between the inner movable block and the outer movable block; the outer movable block is located in the rolling sleeve base; the outer movable block is further provided with a support shaft, the support shaft is provided with a seventh bearing, and the seventh bearing is provided with a rolling wheel; the rolling wheel is located in an inner hole of the profiling die.

9. The horizontal high-speed paper cup/paper bowl forming machine of claim 2, further comprising a main transmission mechanism, wherein, the main transmission mechanism comprises a main motor, a main shaft, a first transmission auxiliary shaft and a second transmission auxiliary shaft; the main motor is connected to the main shaft in a drive manner; the main shaft is respectively connected to a cylindrical indexing camshaft of the seven-station main rotation tower forming mechanism and a cylindrical indexing camshaft of the seven-station auxiliary rotation tower forming mechanism; the cylindrical indexing camshaft of the seven-station main rotation tower forming mechanism, the cylindrical indexing camshaft of the seven-station auxiliary rotation tower forming mechanis and the main shaft are parallel to the second transmission auxiliary shaft; the first transmission auxiliary shaft is connected between the cylindrical indexing camshaft of the seven-station main rotation tower forming mechanism and the second transmission auxiliary shaft in a drive manner; the first transmission auxiliary shaft is perpendicular to the second transmission auxiliary shaft.

10. The horizontal high-speed paper cup/paper bowl forming machine of claim 9, wherein, the stamping die assembly comprises a stamping drive wheel device; the first cup bottom preheating assembly comprises a first cup bottom preheating drive wheel device; the second cup bottom preheating assembly comprises a second cup bottom preheating drive wheel device; the bottom crimping assembly comprises a bottom crimping drive wheel device; the rolling assembly comprises a rolling drive wheel device; the cup rim lubrication assembly comprises a cup rim lubrication drive wheel device; the pre-crimping assembly comprises a pre-crimping drive wheel device; the first final crimping assembly comprises a first final crimping drive wheel device; the second final crimping assembly comprises a second final crimping drive wheel device;

the main shaft is connected to a first drive wheel device in a drive manner; the first drive wheel device is connected to the second final crimping drive wheel device and the first final crimping drive wheel device in a drive manner; the first drive wheel device is further connected to the rolling drive wheel device and the bottom crimping drive wheel device in a drive manner;

the second transmission auxiliary shaft is connected to a second drive wheel device and a third drive wheel device in a drive manner, respectively; the second drive wheel device is connected to the pre-crimping drive wheel device, the stamping drive wheel device and the cup rim lubrication drive wheel device in a drive manner; the third drive wheel device is connected to the first cup bottom preheating drive wheel device and the second cup bottom preheating drive wheel device in a drive manner;

the second transmission auxiliary shaft is connected to a first cam device, and the first cam device is connected to the cup clamp mechanism in a drive manner; the second transmission auxiliary shaft is further connected to a second cam device; the second cam device is connected to a lifting shaft at a center of the turntable of the four-station turntable paper feeding mechanism in a drive manner.

* * * * *